US007331271B2

(12) United States Patent
Sanderson et al.

(10) Patent No.: US 7,331,271 B2
(45) Date of Patent: Feb. 19, 2008

(54) VARIABLE STROKE/CLEARANCE MECHANISM

(75) Inventors: Albert E. Sanderson, Carlisle, MA (US); John Dieckmann, Belmount, MA (US)

(73) Assignee: R. Sanderson Management, Inc., Denton, TX (US)

( * ) Notice: Subject to any disclaimer, the term of this patent is extended or adjusted under 35 U.S.C. 154(b) by 167 days.

(21) Appl. No.: 10/509,115

(22) PCT Filed: Mar. 31, 2003

(86) PCT No.: PCT/US03/09702

§ 371 (c)(1),
(2), (4) Date: Jun. 16, 2005

(87) PCT Pub. No.: WO03/085259

PCT Pub. Date: Oct. 16, 2003

(65) Prior Publication Data

US 2006/0008361 A1 Jan. 12, 2006

Related U.S. Application Data

(63) Continuation-in-part of application No. 11/150,476, filed on Jun. 13, 2005.

(60) Provisional application No. 60/368,525, filed on Apr. 1, 2002, provisional application No. 60/267,500, filed on Feb. 8, 2001.

(51) Int. Cl.
*F16B 3/02* (2006.01)

(52) U.S. Cl. ..... 92/12.2

(58) Field of Classification Search ..... 92/12.2; 74/60

See application file for complete search history.

(56) References Cited

U.S. PATENT DOCUMENTS

| | | | |
|---|---|---|---|
| 748,559 | A | 12/1903 | Peet |
| 812,636 | A | 2/1906 | Callan |
| 821,546 | A | 5/1906 | Smallbone |
| 1,019,521 | A | 3/1912 | Pratt |
| 1,131,614 | A | 3/1915 | Radtke |
| 1,161,152 | A | 11/1915 | Nyborg |
| 1,194,258 | A | 8/1916 | Walker |
| 1,210,649 | A | 1/1917 | Holley et al. |
| 1,255,973 | A | 2/1918 | Almen |
| RE15,442 | E | 9/1922 | Almen |
| 1,577,010 | A | 3/1926 | Whatley |
| 1,648,000 | A | 11/1927 | Lee |

(Continued)

FOREIGN PATENT DOCUMENTS

| | | |
|---|---|---|
| DE | 89352 | 12/1895 |

(Continued)

OTHER PUBLICATIONS

Advanced diaphragm metering pump technology for lower pressure applications, LEWAecodos®.

Bloomfield, Louis A., "How Things Work: Electric Motors," howthingswork.Virginia.edu, Oct. 25, 2001, http://rabi.phys.virginia.edu/HTW/electric_motors.html.

(Continued)

*Primary Examiner*—F. Daniel Lopez
(74) *Attorney, Agent, or Firm*—Fish & Richardson P.C.

(57) ABSTRACT

An assembly includes a cylinder (232) and a piston assembly (212) housed within the cylinder and configured for reciprocal motion relative to the cylinder. The piston assembly and cylinder include a magnet (230) and coil (234) configured to undergo relative motion of the piston assembly and cylinder. The assembly includes a transition arm (214) and a rotating member (222) coupled to the piston assembly by the transition arm. The reciprocal motion is linear in space and sinusoidal in time.

25 Claims, 60 Drawing Sheets

U.S. PATENT DOCUMENTS

| | | | | |
|---|---|---|---|---|
| 1,659,374 | A | 2/1928 | Robson | |
| 1,673,280 | A | 6/1928 | Evans | |
| 1,772,977 | A | 8/1930 | Arrighi | |
| 1,817,063 | A | 8/1931 | James et al. | |
| 1,842,322 | A | 1/1932 | Hulsebos | |
| 1,857,656 | A | 5/1932 | Oldfield | |
| 1,886,770 | A | 11/1932 | Wehr | |
| 1,894,033 | A | 1/1933 | Farwell | |
| 1,968,470 | A | 7/1934 | Szombathy | |
| 2,042,730 | A | 6/1936 | Redrup | |
| 2,048,272 | A | 7/1936 | Linthicum | |
| 2,104,391 | A | 1/1938 | Redrup | |
| 2,112,934 | A | 4/1938 | Stinnes et al. | |
| 2,151,614 | A | 3/1939 | Nevatt et al. | |
| 2,247,527 | A | 7/1941 | Stinnes | |
| 2,256,079 | A | 9/1941 | Dinzl | |
| 2,263,561 | A | 11/1941 | Biermann | |
| 2,282,722 | A | 5/1942 | Hall | |
| 2,302,995 | A | 11/1942 | Holmes | |
| 2,303,838 | A | 12/1942 | Hall | |
| 2,335,048 | A | 11/1943 | Feroy | |
| 2,341,203 | A | 2/1944 | Borer | |
| 2,357,735 | A | 9/1944 | Hall | |
| 2,465,510 | A | 3/1949 | Bonnafe | |
| 2,513,083 | A | 6/1950 | Eckert | |
| 2,532,254 | A | 11/1950 | Bouchard | |
| 2,539,880 | A | 1/1951 | Wildhaber | 74/60 |
| 2,653,484 | A | 9/1953 | Zecher | |
| 2,737,895 | A | 3/1956 | Ferris | |
| 2,827,792 | A | 3/1958 | Hopkins | |
| 2,910,973 | A | 11/1959 | Witzky | |
| 2,940,325 | A | 6/1960 | Nesch | |
| 2,957,421 | A | 10/1960 | Mock | |
| 3,000,367 | A | 9/1961 | Eagleson | |
| 3,076,345 | A | 2/1963 | Leciercq | |
| 3,077,118 | A | 2/1963 | Robbins | |
| 3,176,667 | A | 4/1965 | Hammer | |
| 3,182,644 | A | 5/1965 | Drtina | |
| 3,198,022 | A | 8/1965 | Algor de Waern | |
| 3,273,344 | A | 9/1966 | Christenson | |
| 3,292,554 | A | 12/1966 | Hessler | |
| 3,386,425 | A | 6/1968 | Morsell | |
| 3,528,317 | A | 9/1970 | Cummins | |
| 3,590,188 | A | 6/1971 | Frink et al. | |
| 3,654,906 | A | 4/1972 | Airas | |
| 3,842,440 | A | 10/1974 | Karlson | |
| 3,847,124 | A | 11/1974 | Kramer | |
| 3,861,829 | A | 1/1975 | Roberts et al. | |
| 3,877,839 | A | 4/1975 | Ifield | |
| 3,906,841 | A | 9/1975 | Heyl et al. | |
| 3,939,809 | A | 2/1976 | Rohs | |
| 3,945,359 | A | 3/1976 | Asaga | |
| 3,956,942 | A | 5/1976 | Seki et al. | |
| 3,959,983 | A | 6/1976 | Roberts et al. | |
| 3,968,699 | A | 7/1976 | van Beukering | |
| 3,969,046 | A | 7/1976 | Wynn | |
| 3,974,714 | A | 8/1976 | Fritsch | |
| 4,011,842 | A | 3/1977 | Davies et al. | |
| 4,060,178 | A | 11/1977 | Miller | |
| 4,066,049 | A | 1/1978 | Teodorescu et al. | |
| 4,075,933 | A | 2/1978 | Stephens | |
| 4,077,269 | A | 3/1978 | Hodgkinson | 92/12.1 |
| 4,094,202 | A | 6/1978 | Kemper | |
| 4,100,815 | A | 7/1978 | Kemper | |
| 4,112,826 | A | 9/1978 | Cataldo | |
| 4,144,771 | A | 3/1979 | Kemper et al. | |
| 4,152,944 | A | 5/1979 | Kemper | |
| 4,168,632 | A | 9/1979 | Fokker | |
| 4,171,072 | A | 10/1979 | Davis, Jr. | |
| 4,174,684 | A | 11/1979 | Roseby et al. | |
| 4,178,135 | A | 12/1979 | Roberts | |
| 4,178,136 | A | 12/1979 | Reid et al. | |
| 4,203,396 | A | 5/1980 | Berger | |
| 4,208,926 | A | 6/1980 | Hanson | |
| 4,231,724 | A | 11/1980 | Hope et al. | |
| 4,235,116 | A | 11/1980 | Meijer et al. | |
| 4,236,881 | A | 12/1980 | Pfleger | |
| 4,270,495 | A | 6/1981 | Freudenstein et al. | |
| 4,285,303 | A | 8/1981 | Leach | |
| 4,285,640 | A | 8/1981 | Mukai | |
| 4,294,139 | A | 10/1981 | Bex et al. | |
| 4,297,085 | A | 10/1981 | Brucken | |
| 4,323,333 | A | 4/1982 | Apter et al. | |
| 4,342,544 | A | 8/1982 | Pere | |
| 4,345,174 | A | 8/1982 | Angus | |
| 4,349,130 | A | 9/1982 | Bair | |
| 4,418,586 | A | 12/1983 | Maki et al. | |
| 4,433,596 | A | 2/1984 | Scalzo | |
| 4,449,444 | A | 5/1984 | Forster | |
| 4,454,426 | A | 6/1984 | Benson | |
| 4,473,763 | A | 9/1984 | McFarland et al. | |
| 4,478,136 | A | 10/1984 | Heiser et al. | |
| 4,489,682 | A | 12/1984 | Kenny | |
| 4,491,057 | A | 1/1985 | Ziegler | |
| 4,505,187 | A | 3/1985 | Burgio di Aragona | |
| 4,513,630 | A | 4/1985 | Pere et al. | |
| 4,515,067 | A | 5/1985 | Heyl | |
| 4,545,507 | A | 10/1985 | Barall | |
| 4,569,314 | A | 2/1986 | Milu | |
| 4,602,174 | A | 7/1986 | Redlich | |
| 4,602,554 | A | 7/1986 | Wagenseil et al. | |
| 4,708,099 | A | 11/1987 | Ekker | |
| 4,715,791 | A | 12/1987 | Berlin et al. | |
| 4,729,717 | A | 3/1988 | Gupta | |
| 4,776,259 | A | 10/1988 | Takai | |
| 4,780,060 | A | 10/1988 | Terauchi | |
| 4,811,624 | A | 3/1989 | Fritsch | |
| 4,852,418 | A | 8/1989 | Armstrong | |
| 4,869,212 | A | 9/1989 | Sverdlin | |
| 4,920,859 | A | 5/1990 | Smart et al. | |
| 4,941,809 | A | 7/1990 | Pinkerton | |
| 4,966,042 | A | 10/1990 | Brown | |
| 5,002,466 | A | 3/1991 | Inagaki et al. | 92/12.2 |
| 5,007,385 | A | 4/1991 | Kitaguchi | |
| 5,025,757 | A | 6/1991 | Larsen | |
| 5,027,756 | A | 7/1991 | Shaffer | |
| 5,044,889 | A | 9/1991 | Pinkerton | |
| 5,049,799 | A | 9/1991 | Tsai et al. | |
| 5,063,829 | A | 11/1991 | Takao et al. | |
| 5,076,769 | A | 12/1991 | Shao | |
| 5,088,902 | A | 2/1992 | Marioni | |
| 5,094,195 | A | 3/1992 | Gozalez | |
| 5,102,306 | A | 4/1992 | Liu | |
| 5,113,809 | A | 5/1992 | Ellenburg | |
| 5,129,797 | A | 7/1992 | Kanamaru | |
| 5,136,987 | A | 8/1992 | Schechter et al. | |
| 5,154,589 | A | 10/1992 | Ruhl et al. | |
| 5,201,261 | A | 4/1993 | Kayukawa et al. | |
| 5,261,358 | A | 11/1993 | Rorke | |
| 5,280,745 | A | 1/1994 | Maruno | |
| 5,329,893 | A | 7/1994 | Drengel et al. | |
| 5,336,056 | A | 8/1994 | Kimura et al. | |
| 5,351,657 | A | 10/1994 | Buck | |
| 5,397,922 | A | 3/1995 | Paul et al. | |
| 5,405,252 | A | 4/1995 | Nikkamen | |
| 5,429,482 | A | 7/1995 | Takenaka et al. | |
| 5,437,251 | A | 8/1995 | Anglim et al. | |
| 5,535,709 | A | 7/1996 | Yashizawa | |
| 5,542,382 | A | 8/1996 | Clarke | |
| 5,553,582 | A | 9/1996 | Speas | |
| 5,562,069 | A | 10/1996 | Gillbrand et al. | |
| 5,572,904 | A | 11/1996 | Minculescu | |
| 5,596,920 | A | 1/1997 | Umemura et al. | |
| 5,605,120 | A | 2/1997 | Hedelin | |

| | | | |
|---|---|---|---|
| 5,630,351 | A | 5/1997 | Clucas |
| 5,634,852 | A | 6/1997 | Kanamaru |
| 5,676,037 | A | 10/1997 | Yoshizawa |
| 5,699,715 | A | 12/1997 | Forster |
| 5,699,716 | A | 12/1997 | Ota et al. |
| 5,704,274 | A | 1/1998 | Forster |
| 5,762,039 | A | 6/1998 | Gonzalez |
| 5,768,974 | A | 6/1998 | Ikeda et al. |
| 5,782,219 | A | 7/1998 | Frey et al. |
| 5,785,503 | A | 7/1998 | Ota et al. |
| 5,818,132 | A | 10/1998 | Konotchick |
| 5,839,347 | A | 11/1998 | Nomura et al. |
| 5,890,462 | A | 4/1999 | Bassett |
| 5,894,782 | A | 4/1999 | Nissen et al. |
| 5,897,298 | A | 4/1999 | Umemura |
| 5,927,560 | A | 7/1999 | Lewis et al. |
| 5,931,645 | A | 8/1999 | Goto et al. |
| 6,012,903 | A | 1/2000 | Boelkins |
| 6,053,091 | A | 4/2000 | Tojo |
| 6,065,433 | A | 5/2000 | Hill |
| 6,074,174 | A | 6/2000 | Lynn et al. |
| 6,155,798 | A | 12/2000 | Deininger et al. |
| 6,397,794 | B1 | 6/2002 | Sanderson et al. |
| 6,422,831 | B1 | 7/2002 | Ito et al. |
| 6,446,587 | B1 | 9/2002 | Sanderson et al. |
| 6,460,450 | B1 | 10/2002 | Sanderson et al. |
| 6,637,312 | B1 | 10/2003 | Clucas et al. |
| 6,647,813 | B2 | 11/2003 | Green |
| 6,829,978 | B2 | 12/2004 | Sanderson et al. |
| 6,854,377 | B2 | 2/2005 | Sanderson et al. |
| 6,915,765 | B1 | 7/2005 | Sanderson et al. |
| 6,925,973 | B1 | 8/2005 | Sanderson et al. |
| 6,957,604 | B1 | 10/2005 | Tiedemann et al. |
| 7,011,469 | B2 | 3/2006 | Sanderson et al. |
| 2002/0059907 | A1 | 5/2002 | Thomas |
| 2002/0106238 | A1 | 8/2002 | Sanderson et al. |
| 2002/0194987 | A1 | 12/2002 | Sanderson et al. |
| 2003/0084785 | A1 | 5/2003 | Sanderson et al. |
| 2003/0138331 | A1 | 7/2003 | Sanderson et al. |
| 2005/0005763 | A1 | 1/2005 | Sanderson |
| 2005/0079006 | A1 | 4/2005 | Sanderson |
| 2005/0118049 | A1 | 6/2005 | Sanderson |
| 2005/0207907 | A1 | 9/2005 | Sanderson |
| 2005/0224025 | A1 | 10/2005 | Sanderson |
| 2005/0268869 | A1 | 12/2005 | Sanderson |
| 2006/0008361 | A1 | 1/2006 | Sanderson |
| 2006/0034703 | A1 | 2/2006 | Sanderson |

FOREIGN PATENT DOCUMENTS

| | | |
|---|---|---|
| DE | 345813 | 7/1917 |
| DE | 515359 | 12/1930 |
| DE | 698243 | 10/1940 |
| DE | 1 037 799 | 12/1958 |
| DE | 1451926 | 5/1965 |
| DE | 2030978 | 1/1971 |
| DE | 2346836 A1 | 3/1975 |
| DE | 2612270 | 9/1977 |
| DE | 27 51 846 | 11/1977 |
| DE | 26 33 618 | 2/1978 |
| DE | 29 31 377 | 2/1981 |
| DE | 3420529 | 12/1985 |
| DE | 37 00 005 | 7/1988 |
| DE | 4303745 | 8/1993 |
| DE | 199 39 131 | 3/2001 |
| EP | 0608144 | 7/1994 |
| EP | 0 856 663 | 8/1998 |
| EP | 1 251 275 | 10/2002 |
| FR | 461343 | 12/1913 |
| FR | 815794 | 4/1937 |
| FR | 1 015 857 | 10/1952 |
| FR | 1416219 | 9/1965 |
| FR | 1450354 | 7/1966 |
| FR | 2149754 | 3/1973 |
| FR | 2271459 | 11/1973 |
| FR | 2 300 262 | 2/1975 |
| FR | 2453332 | 4/1979 |
| FR | 0052387 | 10/1981 |
| FR | 2 566 460 | 12/1985 |
| FR | 2 649 755 | 1/1991 |
| GB | 121961 | 1/1920 |
| GB | 220594 | 3/1924 |
| GB | 282125 | 12/1927 |
| GB | 499023 | 1/1939 |
| GB | 629318 | 9/1947 |
| GB | 651893 | 4/1951 |
| GB | 801952 | 9/1958 |
| GB | 1127291 | 9/1968 |
| GB | 2030254 | 10/1978 |
| GB | 1595600 | 8/1981 |
| GB | 2358845 | 8/2001 |
| JP | 55-37541 | 9/1978 |
| JP | 60-164677 | 8/1985 |
| JP | 61-212656 | 9/1986 |
| JP | 62-113938 | 4/1987 |
| JP | 4-143469 | 5/1992 |
| JP | 09151840 | 6/1997 |
| WO | WO 91/02889 | 3/1991 |
| WO | WO 92/11449 | 7/1992 |
| WO | WO 97/10415 | 3/1997 |
| WO | WO 99/14471 | 3/1999 |
| WO | WO 00/15955 | 3/2000 |
| WO | 01/11214 | 2/2001 |
| WO | WO 01/11237 | 2/2001 |
| WO | WO 02/063139 | 8/2002 |
| WO | WO 03/040559 | 5/2003 |
| WO | WO 03/100231 | 12/2003 |
| WO | WO 2004/113724 | 12/2004 |

OTHER PUBLICATIONS

Den Hartog, J.P. (Jacob Pieter), "Problem 144" 1956 New York.

ECycle Inc. schematic.

Freudenstein, "Development of an Optimum Variable-Stroke Internal-Combustion Engine Mechanism from the Viewpoint . . . ," Journal of Mechanisms, Transmissions, and Automation in Design, vol. 105, pp. 259-266, 1984.

Freudenstein, "Kinematic Structure of Mechanisms for Fixed and Variable-Stroke Axial-Piston Reciprocating Machines," Journal of Mechanisms, Transmissions, and Automation in Design, VI. 106, pp. 355-363, 1984.

Metering Pumps, LEWA modular®, American Lewa, The Technology Advantage.

Red Barn Engineering Presents, "Internal Combustion Motor with Integral Electric Generator For Use In Electric Vehicles," The MOGEN—Motor Generator—Hybrid Vehicles, http://www.mogen.net/index.shtml, copyright 1998.

Redlich, Robert, "A Summary of Twenty Years Experience with Linear Motors and Alternators," Sunpower, Inc., Athens, Ohio, U.S.A., 1996, http://www.sunpower.com/tech_papers/pub64/linmot.html.

Sunpower, Inc., "High Efficiency, Oil-Free Compressor: Better Machines for A Better World," http://www.sunpower.com/compressors/compressor/index.html.

D M Clucas, PhD and J K Raine, PhD, "Development of a Hermetically Sealed Stirling Engine Battery Charger," Proc Instn Mech Engrs, Part C: Journal of Mech Eng Science, vol. 208, pp. 357-366.

DM Clucas, PhD and J K Raine, PhD, "A new wobble drive with particular application in a Stirling engine," Proc Instn Mech Engrs, Part C: Journal of Mech Eng Science, vol. 208, pp. 337-346.

The MOGEN—Motor Generator—Hybrid Vehicles, Red Barn Engineering Presents, "Internal Combustion Motor with Integral Electric Generator For Use In Electric Vehicles," http://www.mogen.net/index.shtml.

Olson, John R., "Speed Varying Loads Affect the Stability of Hydrostatic Transmissions", www.nfpa.com, 1970.

| Θ | STROKE | NO COMP | LINEAR COMP | 2ND ORDER COMP |
|---|---|---|---|---|
| 8 | 316 | 343 | 0 | 58 |
| 9 | 356 | 323 | 43 | 13 |
| 10 | 397 | 303 | 72 | 0 |
| 11 | 437 | 282 | 92 | 0 |
| 12 | 478 | 262 | 104 | 5 |
| 13 | 519 | 241 | 111 | 10 |
| 14 | 561 | 220 | 113 | 15 |
| 15 | 603 | 199 | 111 | 19 |
| 16 | 645 | 178 | 107 | 21 |
| 17 | 688 | 157 | 99 | 23 |
| 18 | 731 | 135 | 90 | 22 |
| 19 | 775 | 114 | 79 | 21 |
| 20 | 819 | 91 | 66 | 18 |
| 21 | 864 | 69 | 51 | 15 |
| 22 | 909 | 46 | 35 | 10 |
| 23 | 955 | 23 | 18 | 5 |
| 24 | 1002 | 0 | 0 | 0 |

VARIABLE STROKE/CLEARANCE MECHANISM

The present application is a National Stage of International Application No. PCT/US03/09702, filed Mar. 31, 2003, which claims priority from U.S. Provisional Application Ser. No. 60/368,525, filed Apr. 1, 2002, and titled "Linear Generator/Motor." The present application also claims priority from International Application No. PCT/US02/03220, filed Feb. 6, 2002, which claims priority from U.S. Provisional Application Ser. No. 60/267,500, filed Feb. 8, 2001, and entitled "Variable Stroke/Clearance Mechanism", the entire contents of the prior applications are incorporated herein by reference. This application is also a continuation-in-part of U.S. application Ser. No. 11/150,476, filed Jun. 13, 2005.

BACKGROUND OF THE INVENTION

This invention relates to a variable stroke/clearance mechanism, and more particularly to compressors with variable stroke and clearance.

Most piston driven engines have pistons that are attached to offset portions of a crankshaft such that as the pistons are moved in a reciprocal direction transverse to the axis of the crankshaft, the crankshaft will rotate.

U.S. Pat. No. 5,535,709, defines an engine with a double ended piston that is attached to a crankshaft with an off set portion. A lever attached between the piston and the crankshaft is restrained in a fulcrum regulator to provide the rotating motion to the crankshaft.

U.S. Pat. No. 4,011,842, defines a four cylinder piston engine that utilizes two double ended pistons connected to a T-shaped connecting member that causes a is crankshaft to rotate. The T-shaped connecting member is attached at each of the T-cross arm to a double ended piston. A centrally located point on the T-cross arm is rotatably attached to a fixed point, and the bottom of the T is rotatably attached to a crank pin which is connected to the crankshaft by a crankthrow which includes a counter weight.

In each of the above examples, double ended pistons are used that drive a crankshaft that has an axis transverse to the axis of the pistons.

SUMMARY OF THE INVENTION

According to the invention, an assembly includes a cylinder and a piston assembly housed within the cylinder and configured for reciprocal motion relative to the cylinder. The piston assembly and cylinder include a magnet and coil configured to undergo relative motion with the relative motion of the piston assembly and cylinder. The assembly includes a transition arm, and a rotating member coupled to the piston assembly by the transition arm.

Embodiments of this aspect of the invention may include one or more of the following features.

The reciprocal motion is linear in space and sinusoidal in time. The magnet is coupled to the piston assembly for reciprocal motion therewith. The coil is coupled to the cylinder. The piston assembly is single-ended or double-ended. A magnet and coil are positioned at both ends of the double-ended piston assembly. One end of the double-ended piston assembly is configured to function as a gasoline engine or a pump. The piston assembly has a piston head at one end and a guide rod at the other end. The rotating member is coupled to the piston assembly such that alternating current is produced at the coil at a revolving frequency of the rotating member. The assembly comprises three 120° spaced cylinders and piston assemblies. The coil is positioned inside the magnet. The coil is positioned outside the magnet.

In an illustrated embodiment, the assembly is a pump or compressor and the piston assembly includes a piston head coupled to the magnet and coil by a piston rod. The assembly includes a second piston assembly driven by the same magnet and coil.

The rotating member is a flywheel. The transition arm is coupled to a stationary support, e.g., a U-joint. In a particular implementation, the assembly is configured for converting between phases.

According to another aspect of the invention, a method of generating power includes providing a rotating member coupled to a piston assembly by a transition arm. The piston assembly is housed within a cylinder and configured for reciprocal motion relative to the cylinder. The piston assembly and cylinder includes a magnet and coil configured to undergo relative motion with the relative motion of the piston assembly and cylinder. The method includes rotating the rotating member such that power is generated by the magnet and coil.

Embodiments of this aspect of the invention may include that the reciprocal motion is linear in space and sinusoidal in time.

According to another aspect of the invention, a method includes providing a rotating member coupled to a piston assembly by a transition arm. The piston assembly is housed within a cylinder and configured for reciprocal motion relative to the cylinder. The piston assembly and cylinder include a magnet and coil configured to undergo relative motion with the relative motion of the piston assembly and cylinder. The method includes applying power to the coil to cause the rotating member to rotate.

Embodiments of this aspect of the invention may include that the reciprocal motion is linear in space and sinusoidal in time.

According to another aspect of the invention, the rotating member is driven by the output shaft of another piston assembly.

The details of one or more embodiments of the invention are set forth in the accompanying drawings and the description below. Other features, objects, and advantages of the invention will be apparent from the description and drawings.

DESCRIPTION OF THE PREFERRED EMBODIMENTS

Figure 1:
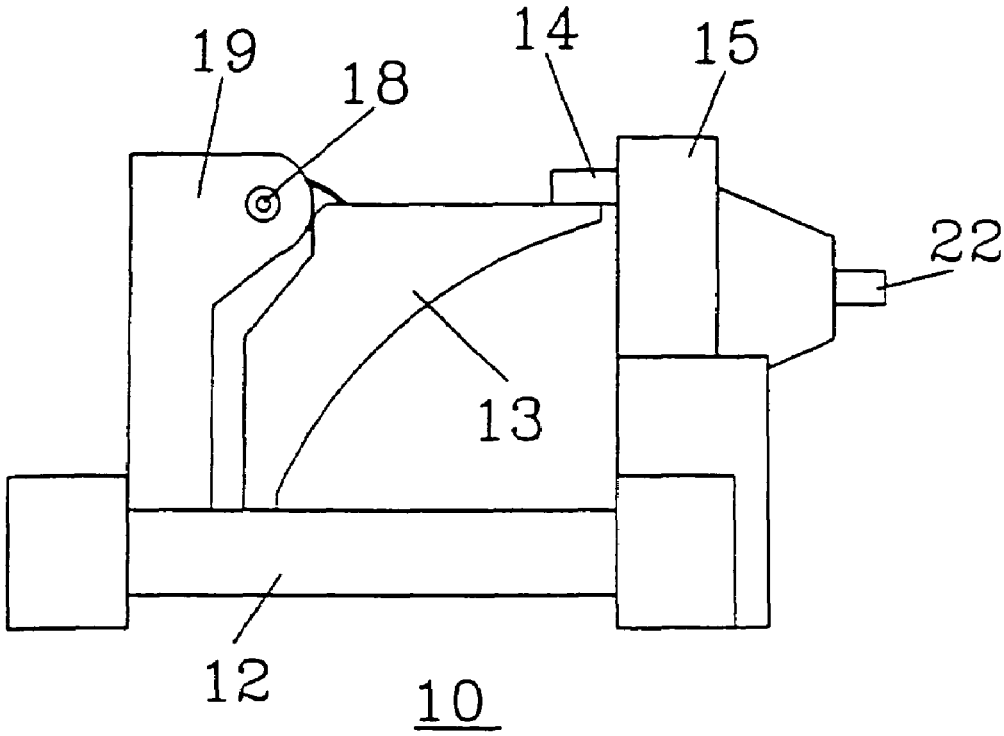
FIGS. 1 and 2 are side view of a simplified illustration of a four cylinder engine of the present invention.

FIG. 1 is a pictorial representation of a four piston engine 10 of the present invention. Engine 10 has two cylinders 11 (FIG. 3) and 12. Each cylinder 11 and 12 house a double ended piston. Each double ended piston is connected to transition arm 13 which is connected to flywheel 15 by shaft 14. Transition arm 13 is connected to support 19 by a universal joint mechanism, including shaft 18, which allows transition arm 13 to move up an down and shaft 17 which allows transition arm 13 to move side to side. FIG. 1 shows flywheel 15 in a position shaft 14 at the top of wheel 15.

Figure 2:
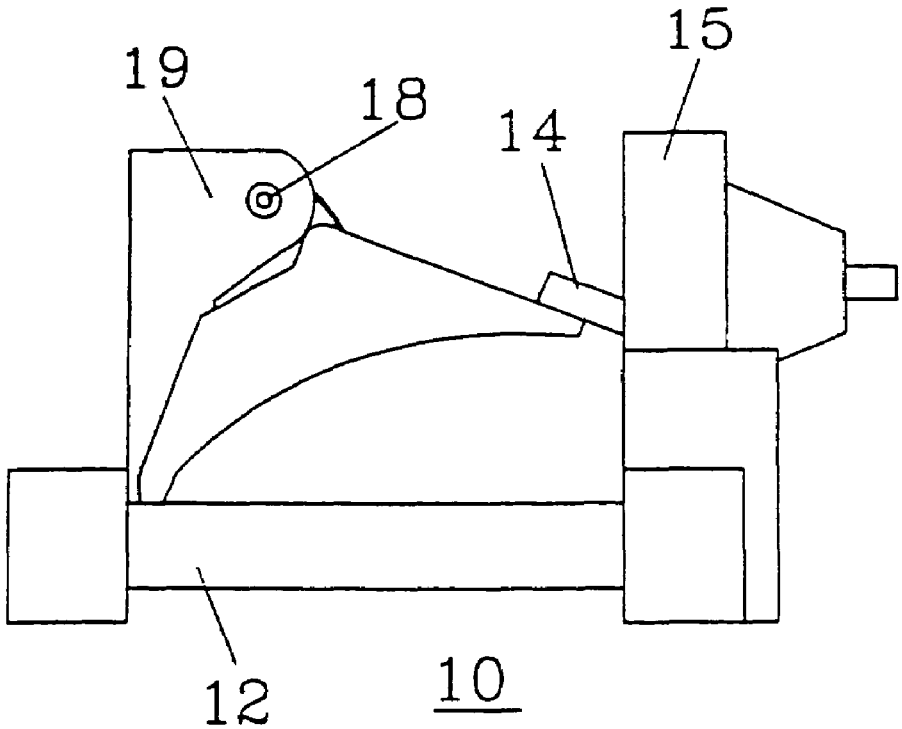

FIG. 2 shows engine 10 with flywheel 15 rotated so that shaft 14 is at the bottom of flywheel 15. Transition arm 13 has pivoted downward on shaft 18.

Figure 3:
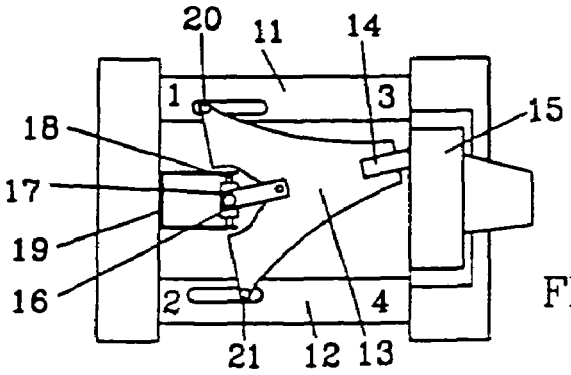
FIGS. 3, 4, 5 and 6 are a top views of the engine of FIG. 1 showing the pistons and flywheel in four different positions.
Figure 3A:
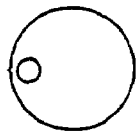
Figure 4:
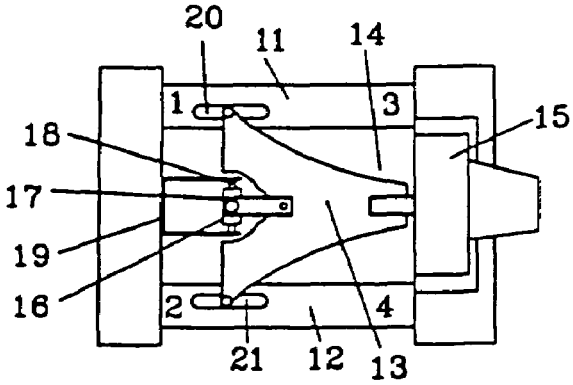
Figure 4A:
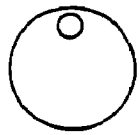
Figure 5:
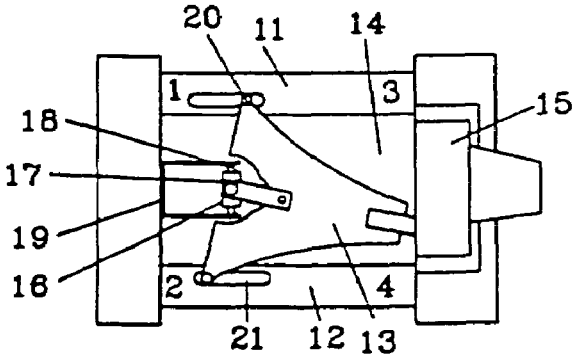
Figure 5A:
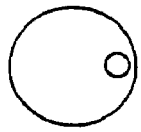
Figure 6:
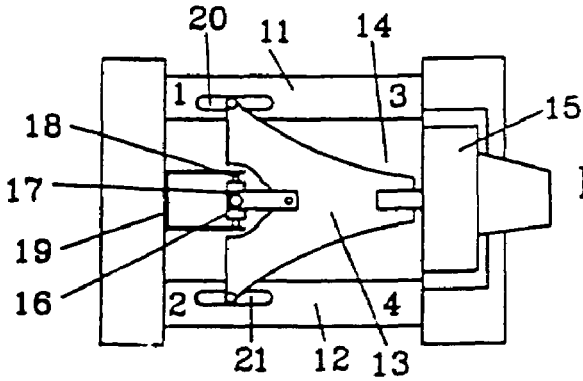
Figure 6A:
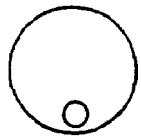

FIGS. 3-6 show a top view of the pictorial representation, showing the transition arm 13 in four positions and shaft moving flywheel 15 in 90° increments. FIG. 3 shows flywheel 15 with shaft 14 in the position as illustrated in FIG. 3*a*. When piston 1 fires and moves toward the middle of cylinder 11, transition arm 13 will pivot on universal joint 16 rotating flywheel 15 to the position shown in FIG. 2. Shaft 14 will be in the position shown in FIG. 4*a*. When piston 4 is fired, transition arm 13 will move to the position shown in FIG. 5. Flywheel 15 and shaft 14 will be in the position shown in FIG. 5*a*. Next piston 2 will fire and transition arm 13 will be moved to the position shown in FIG. 6. Flywheel 15 and shaft 14 will be in the position shown in FIG. 6*a*. When piston 3 is fired, transition arm 13 and flywheel 15 will return to the original position that shown in FIGS. 3 and 3*a*.

When the pistons fire, transition arm will be moved back and forth with the movement of the pistons. Since transition arm 13 is connected to universal joint 16 and to flywheel 15 through shaft 14, flywheel 15 rotates translating the linear motion of the pistons to a rotational motion.

Figure 7:
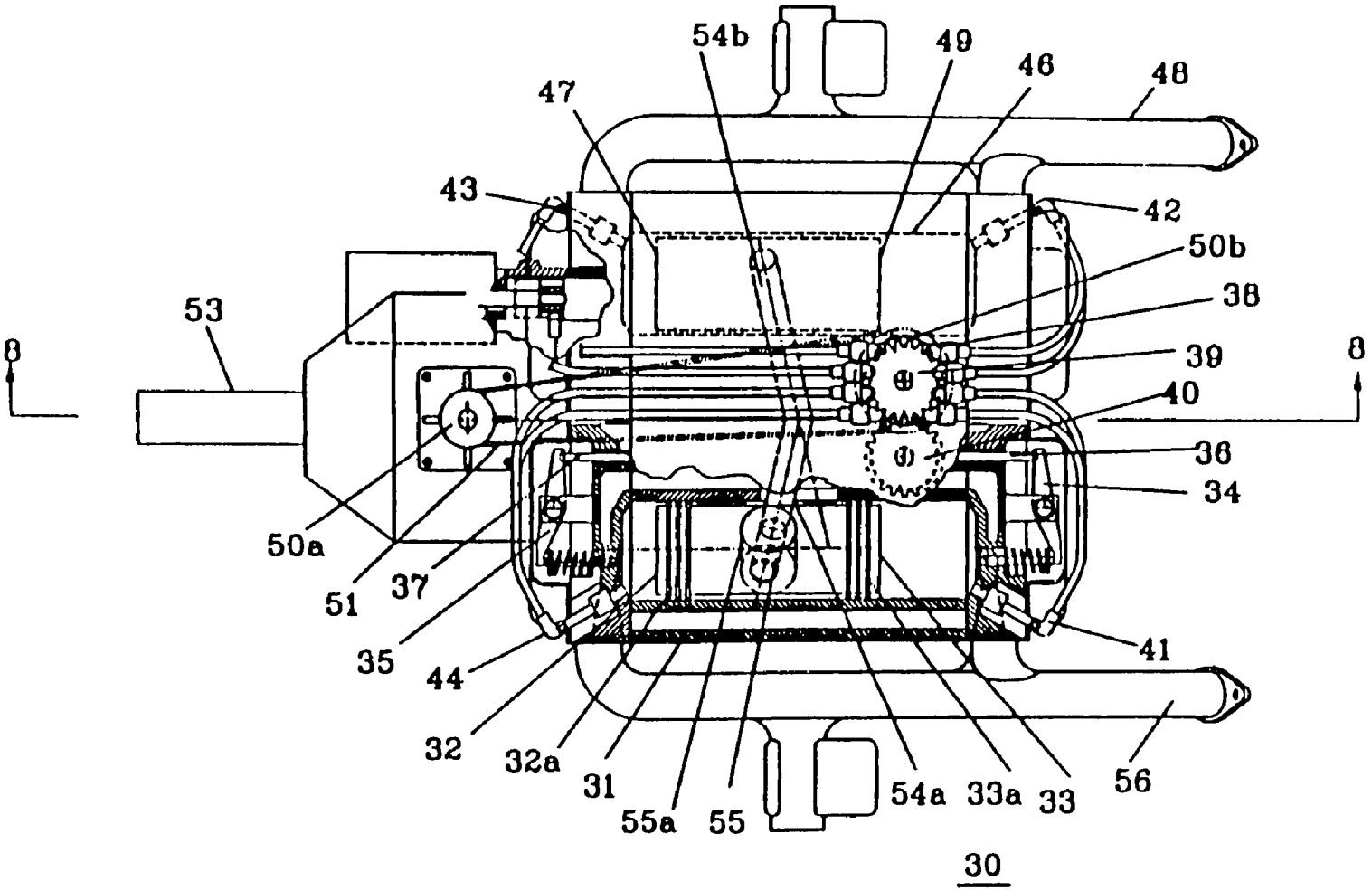
FIG. 7 is a top view, partially in cross-section of an eight cylinder engine of the present invention.

FIG. 7 shows (in partial cross-section) a top view of an embodiment of a four double piston, eight cylinder engine 30 according to the present invention. There are actually only four cylinders, but with a double piston in each cylinder, the engine is equivalent to a eight cylinder engine. Two cylinders 31 and 46 are shown. Cylinder 31 has double ended piston 32, 33 with piston rings 32*a* and 33*a*, respectively. Pistons 32, 33 are connected to a transition arm 60 (FIG. 8) by piston arm 54*a* extending into opening 55*a* in piston 32, 33 and sleeve bearing 55. Similarly piston 47, 49, in cylinder 46 is connected by piston arm 54*b* to transition arm 60.

Each end of cylinder 31 has inlet and outlet valves controlled by a rocker arms and a spark plug. Piston end 32 has rocker arms 35*a* and 35*b* and spark plug 44, and piston end 33 has rocker arms 34*a* and 34*b*, and spark plug 41. Each piston has associated with it a set of valves, rocker arms and a spark plug. Timing for firing the spark plugs and opening and closing the inlet and exhaust values is controlled by a timing belt 51 which is connected to pulley 50*a*. Pulley 50*a* is attached to a gear 64 by shaft 63 (FIG. 8) turned by output shaft 53 powered by flywheel 69. Belt 50*a* also turns pulley 50*b* and gear 39 connected to distributor 38. Gear 39 also turns gear 40. Gears 39 and 40 are attached to cam shaft 75 (FIG. 8) which in turn activate push rods that are attached to the rocker arms 34, 35 and other rocker arms not illustrated.

Exhaust manifolds 48 and 56 as shown attached to cylinders 46 and 31 respectively. Each exhaust manifold is attached to four exhaust ports.

Figure 8:
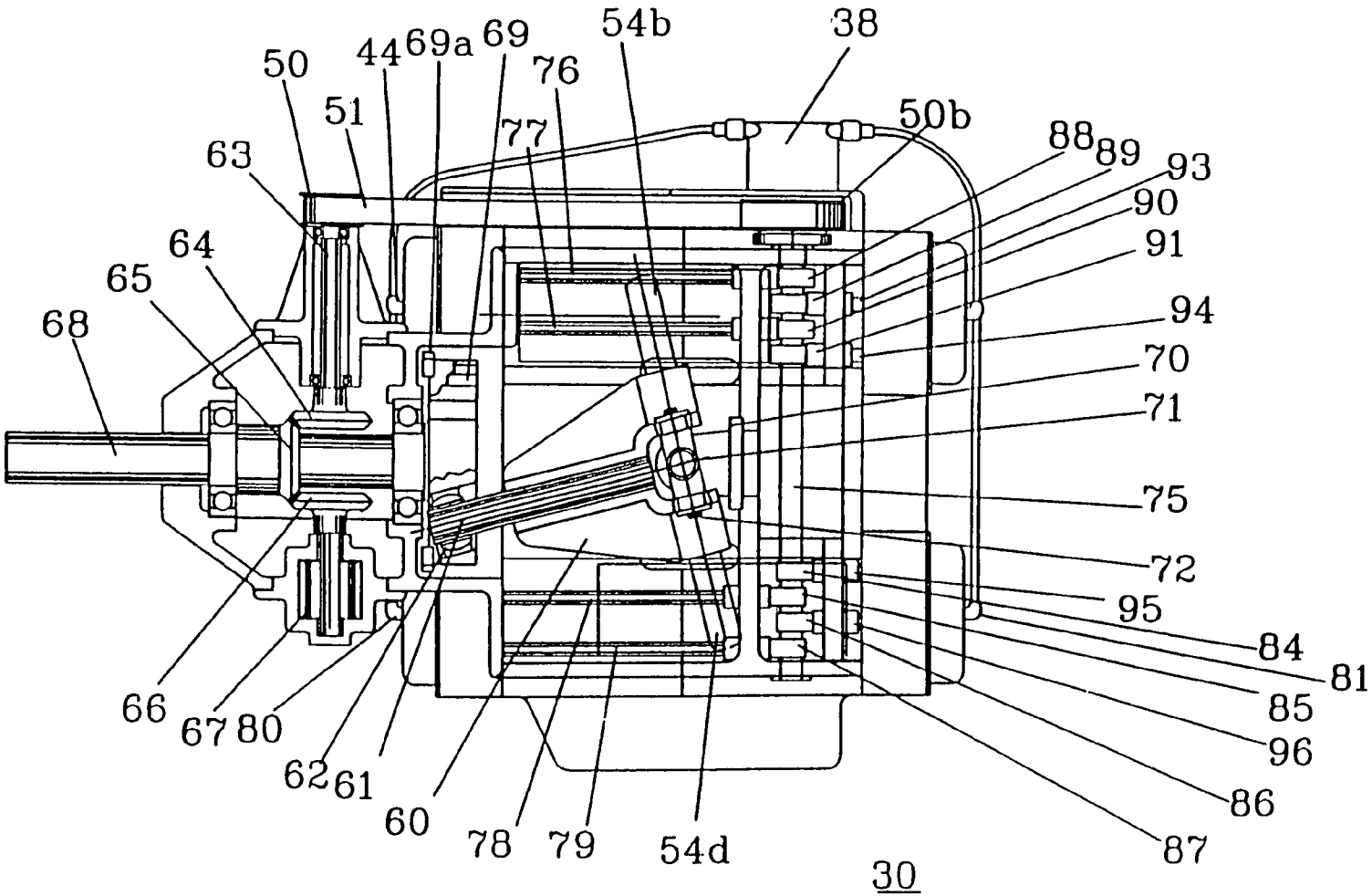
FIG. 8 is a side view in cross-section of the engine of FIG. 7.

FIG. 8 is a side view of engine 30, with one side removed, and taken through section 8-8 of FIG. 7. Transitions arm 60 is mounted on support 70 by pin 72 which allows transition arm to move up and down (as viewed in FIG. 8) and pin 71 which allows transition arm 60 to move from side to side. Since transition arm 60 can move up and down while moving side to side, then shaft 61 can drive flywheel 69 in a circular path. The four connecting piston arms (piston arms 54*b* and 54*d* shown in FIG. 8) are driven by the four double end pistons in an oscillator motion around pin 71. The end of shaft 61 in flywheel 69 causes transition arm to move up and down as the connection arms move back and forth. Flywheel 69 has gear teeth 69*a* around one side which may be used for turning the flywheel with a starter motor 100 (FIG. 11) to start the engine.

The rotation of flywheel 69 and drive shaft 68 connected thereto, turns gear 65 which in turn turns gears 64 and 66. Gear 64 is attached to shaft 63 which turns pulley 50*a*. Pulley 50*a* is attached to belt 51. Belt 51 turns pulley 50*b* and gears 39 and 40 (FIG. 7). Cam shaft 75 has cams 88-91 on one end and cams 84-87 on the other end. Cams 88 and 90 actuate push rods 76 and 77, respectively. Cams 89 and 91 actuate push rods 93 and 94, respectively. Cams 84 and 86 actuate push rods 95 and 96, respectively, and cams 85 and 87 actuate push rods 78 and 79, respectively. Push rods 77, 76, 93, 94, 95, 96 and 78, 79 are for opening and closing the intake and exhaust valves of the cylinders above the pistons. The left side of the engine, which has been cutaway, contains an identical, but opposite valve drive mechanism.

Gear 66 turned by gear 65 on drive shaft 68 turns pump 67, which may be, for example, a water pump used in the engine cooling system (not illustrated), or an oil pump.

Figure 9:
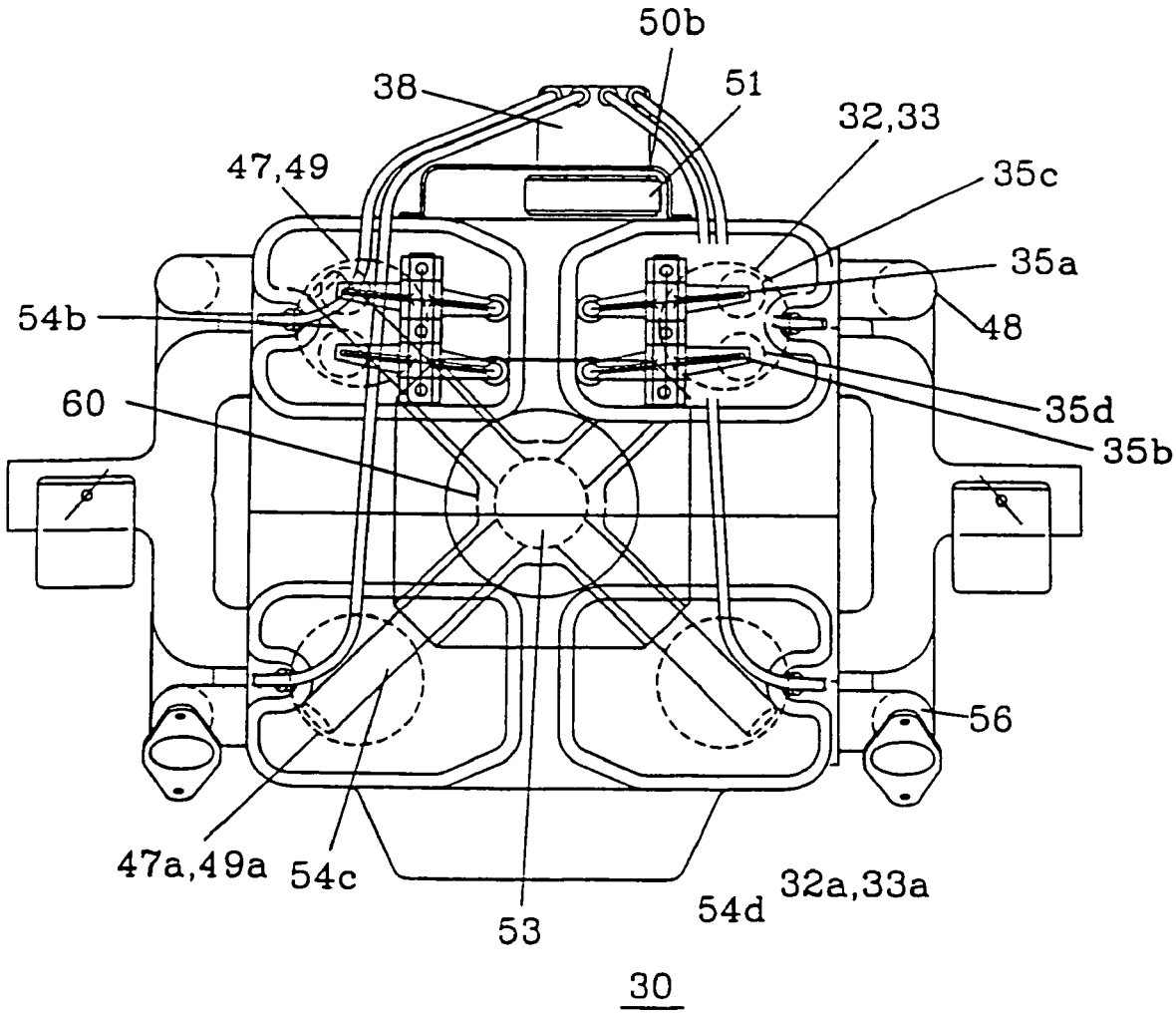
FIG. 9 is a right end view of FIG. 7.

FIG. 9 is a rear view of engine 30 showing the relative positions of the cylinders and double ended pistons. Piston 32, 33 is shown in dashed lines with valves 35*c* and 35*d* located under lifter arms 35*a* and 35*b*, respectively. Belt 51 and pulley 50*b* are shown under distributor 38. Transition arm 60 and two, 54*c* and 54*d*, of the four piston arms 54*a*, 54*b*, 54*c* and 54*d* are shown in the pistons 32-33, 32*a*-33*a*, 47-49 and 47*a*-49*a*.

Figure 10:
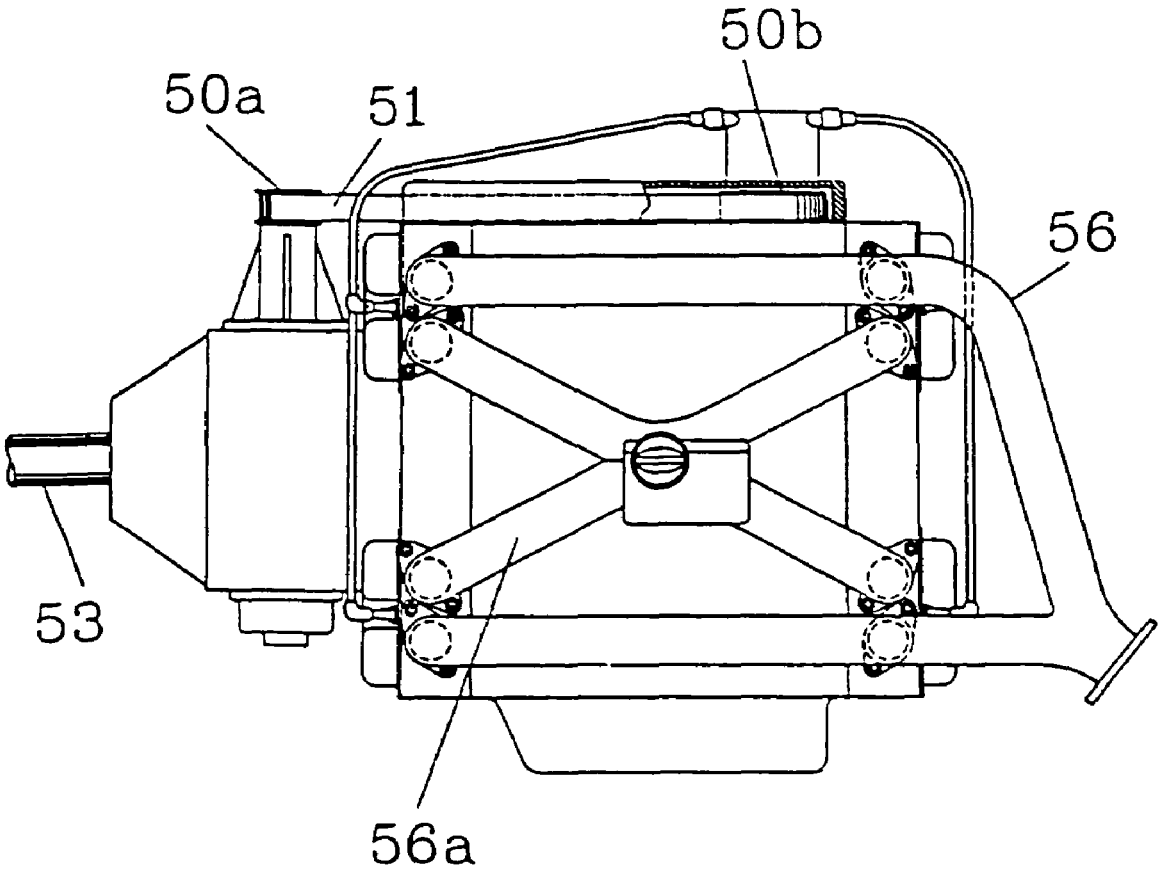
FIG. 10 is a side view of FIG. 7.

FIG. 10 is a side view of engine 30 showing the exhaust manifold 56, intake manifold 56*a* and carburetor 56*c*. Pulleys 50*a* and 50*b* with timing belt 51 are also shown.

Figure 11:
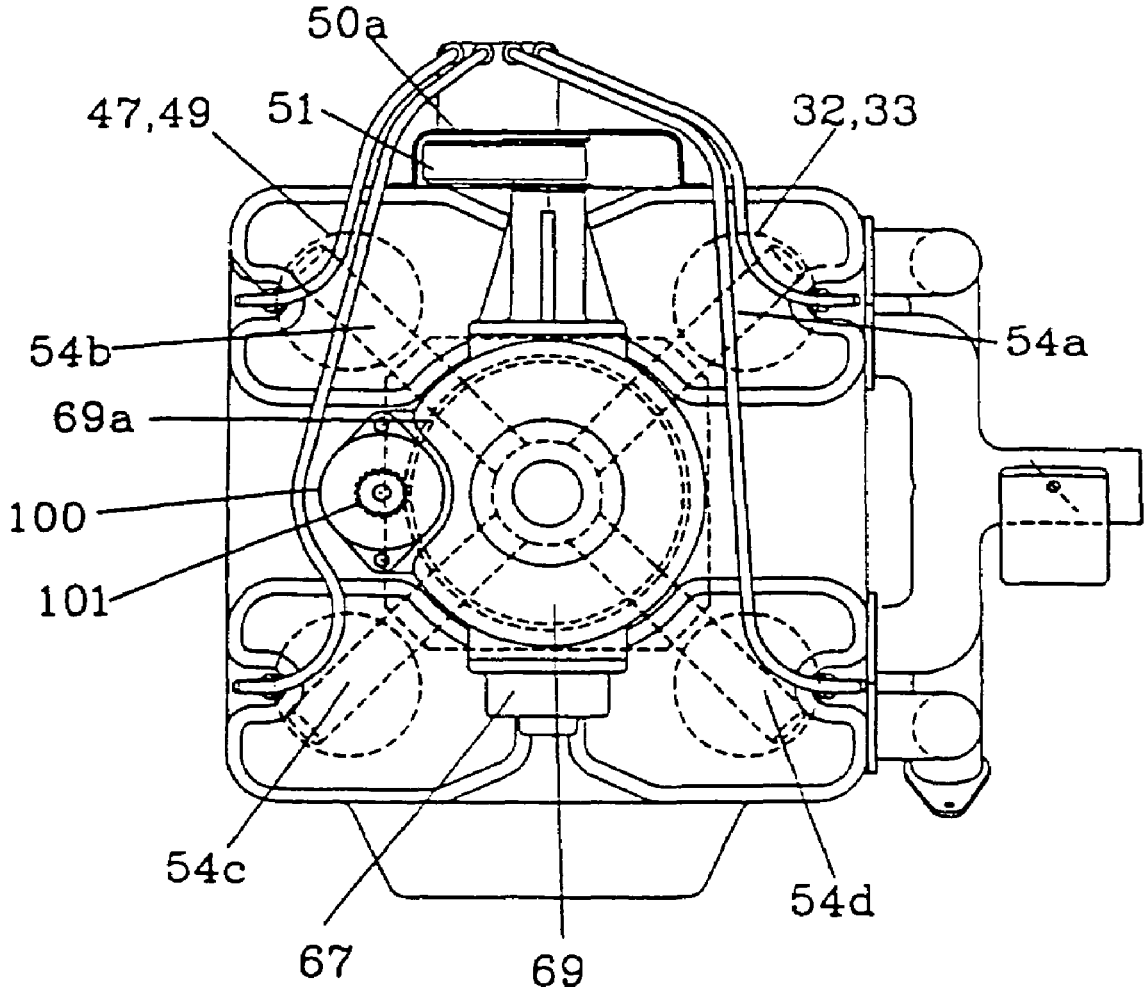
FIG. 11 is a left end view of FIG. 7.

FIG. 11 is a front end view of engine 30 showing the relative positions of the cylinders and double ended pistons 32-33, 32*a*-33*a*, 47-49 and 47*a*-49*a* with the four piston arms 54*a*, 54*b*, 54*c* and 54*d* positioned in the pistons. Pump 67 is shown below shaft 53, and pulley 50*a* and timing belt 51 are shown at the top of engine 30. Starter 100 is shown with gear 101 engaging the gear teeth 69*a* on flywheel 69.

A feature of the invention is that the compression ratio for the engine can be changed while the engine is running. The end of arm 61 mounted in flywheel 69 travels in a circle at the point where arm 61 enters flywheel 69. Referring to FIG.

13, the end of arm 61 is in a sleeve bearing ball bushing assembly 81. The stroke of the pistons is controlled by arm 61. Arm 61 forms an angle, for example about 15°, with shaft 53. By moving flywheel 69 on shaft 53 to the right or left, as viewed in FIG. 13, the angle of arm 61 can be changed, changing the stroke of the pistons, changing the compression ratio. The position of flywheel 69 is changed by turning nut 104 on threads 105. Nut 104 is keyed to shaft 53 by thrust bearing 106*a* held in place by ring 106*b*. In the position shown in FIG. 12, flywheel 69 has been moved to the right, extending the stroke of the pistons.

Figure 12:
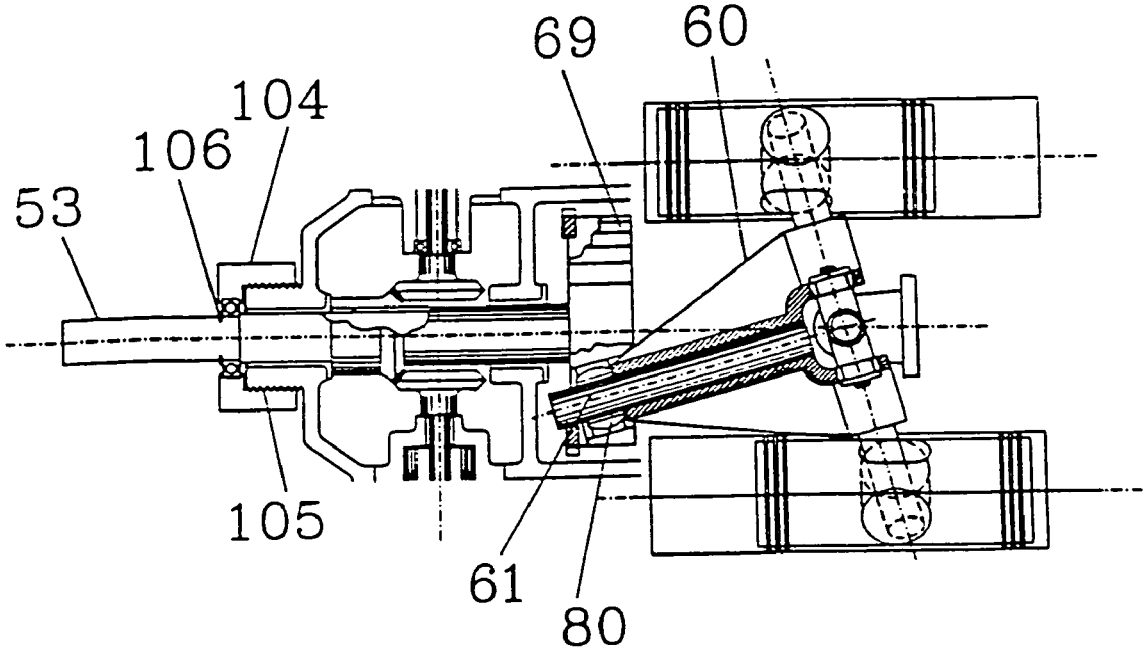
FIG. 12 is a partial top view of the engine of FIG. 7 showing the pistons, drive member and flywheel in a high compression position.

FIG. 12 shows flywheel moved to the right increasing the stroke of the pistons, providing a higher compression ratio. Nut 105 has been screwed to the right, moving shaft 53 and flywheel 69 to the right. Arm 61 extends further into bushing assembly 80 and out the back of flywheel 69.

Figure 13:
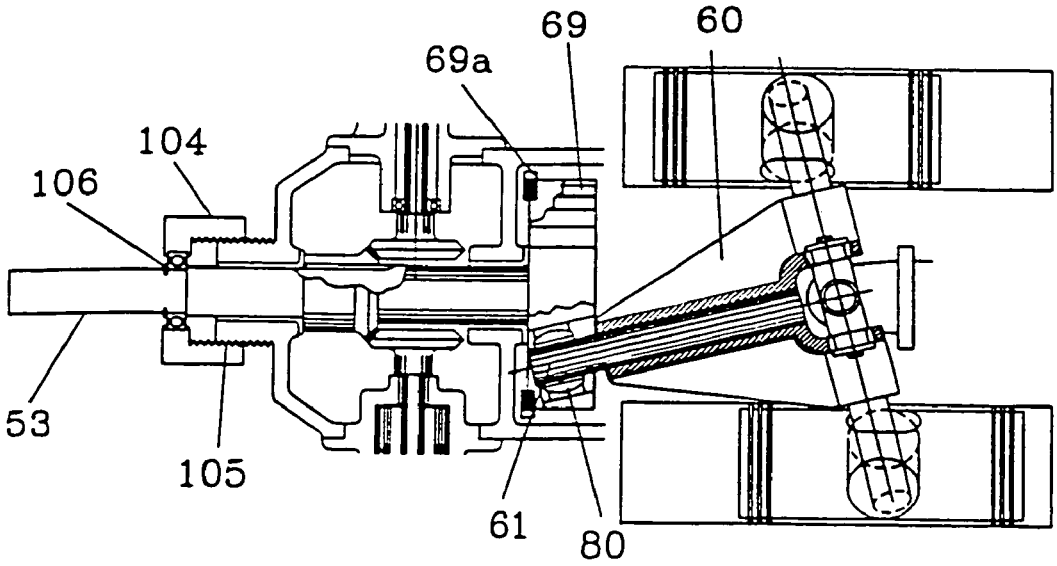
FIG. 13 is a partial top view of the engine in FIG. 7 showing the pistons, drive member and flywheel in a low compression position.

FIG. 13 shows flywheel moved to the left reducing the stroke of the pistons, providing a lower compression ratio. Nut 105 has been screwed to the left, moving shaft 53 and flywheel 69 to the left. Arm 61 extends less into bushing assembly 80.

Figure 14:
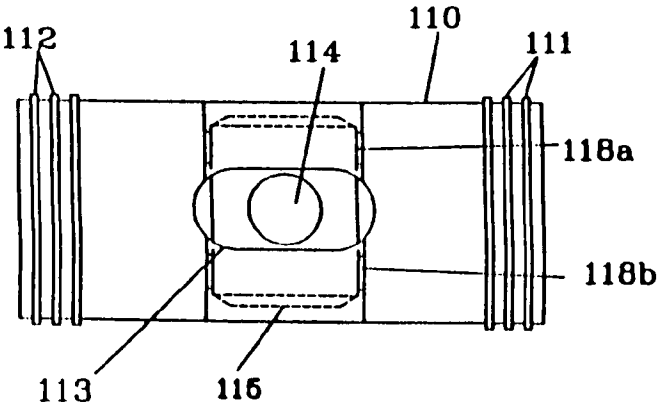
FIG. 14 is a top view of a piston.

The piston arms on the transition arm are inserted into sleeve bearings in a bushing in piston. FIG. 14 shows a double piston 110 having piston rings 111 on one end of the double piston and piston rings 112 on the other end of the double piston. A slot 113 is in the side of the piston. The location the sleeve bearing is shown at 114.

Figure 15:
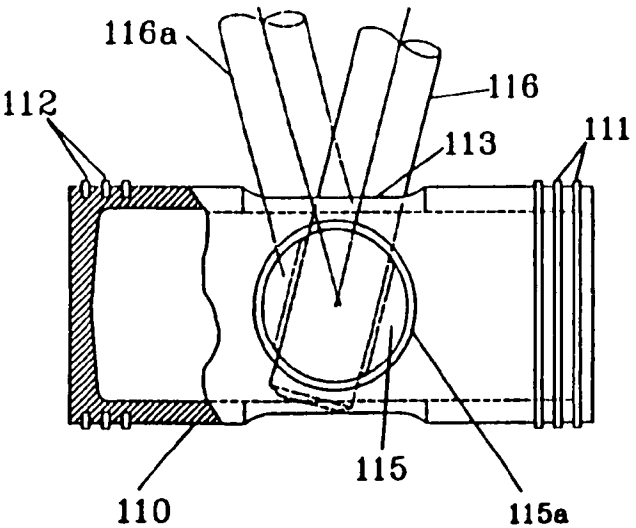
FIG. 15 is a side view of a piston showing the drive member in two positions.

FIG. 15 shows a piston arm 116 extending into piston 110 through slot 116 into sleeve bearing 117 in bushing 115. Piston arm 116 is shown in a second position at 116*a*. The two pistons arms 116 and 116*a* show the movement limits of piston arm 116 during operation of the engine.

Figure 16:
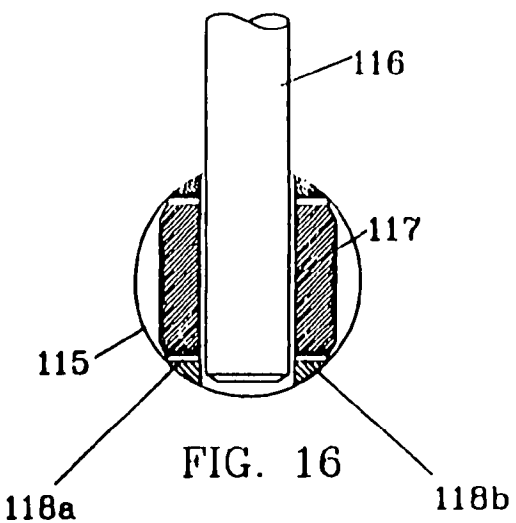
FIG. 16 shows the bearing interface of the drive member and the piston.

FIG. 16 shows piston arm 116 in sleeve bearing 117. Sleeve bearing 117 is in pivot pin 115. Piston arm 116 can freely rotate in sleeve bearing 117 and the assembly of piston arm 116. Sleeve bearing 117 and pivot pin 115 and sleeve bearings 118*a* and 118*b* rotate in piston 110, and piston arm 116 can be moved axially with the axis of sleeve bearing 117 to allow for the linear motion of double ended piston 110, and the motion of a transition arm to which piston arm 116 is attached.

Figure 17:
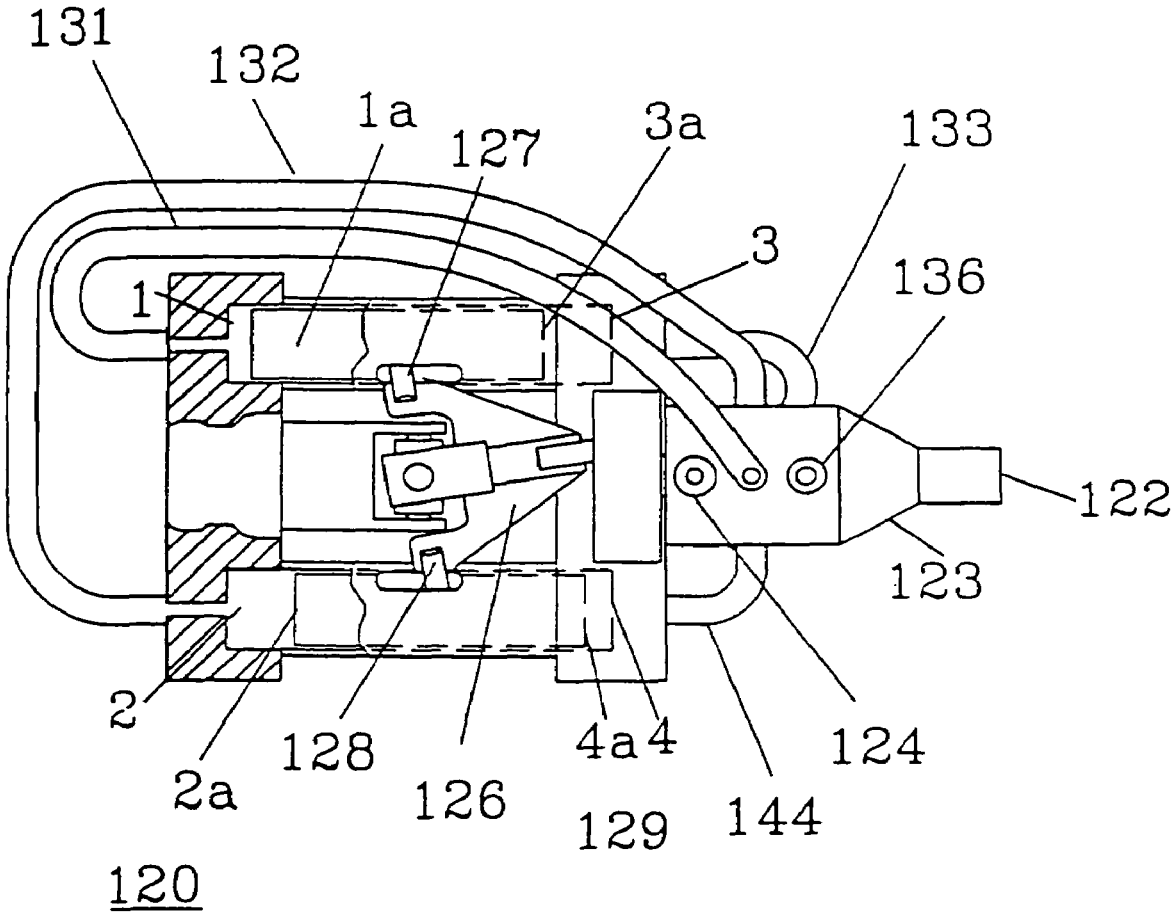
FIG. 17 is an air driven engine/pump embodiment.

FIG. 17 shows how the four cylinder engine 10 in FIG. 1 may be configured as an air motor using a four way rotary valve 123 on the output shaft 122. Each of cylinders 1, 2, 3 and 4 are connected by hoses 131, 132, 133, and 144, respectively, to rotary valve 123. Air inlet port 124 is used to supply air to run engine 120. Air is sequentially supplied to each of the pistons 1*a*, 2*a*, 3*a* and 4*a*, to move the pistons back and forth in the cylinders. Air is exhausted from the cylinders out exhaust port 136. Transition arm 126, attached to the pistons by connecting pins 127 and 128 are moved as described with references to FIGS. 1-6 to turn flywheel 129 and output shaft 22.

Figure 18:
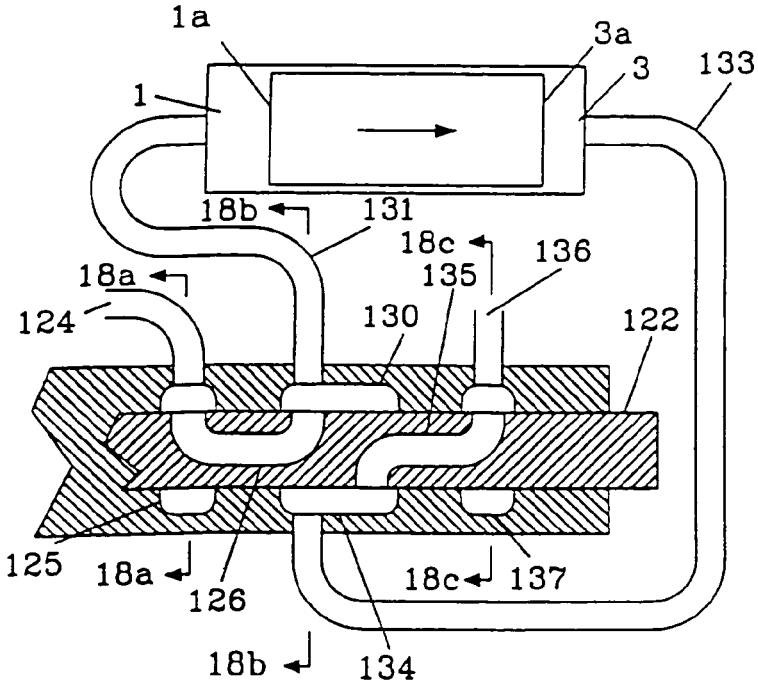
FIG. 18 illustrates the air valve in a first position.

FIG. 18 is a cross-sectional view of rotary valve 123 in the position when pressurized air or gas is being applied to cylinder 1 through inlet port 124, annular channel 125, channel 126, channel 130, and air hose 131. Rotary valve 123 is made up of a plurality of channels in housing 123 and output shaft 122. The pressurized air entering cylinder 1 causes piston 1*a*, 3*a* to move to the right (as viewed in FIG. 18). Exhaust air is forced out of cylinder 3 through line 133 into chamber 134, through passageway 135 and out exhaust outlet 136.

Figure 18A:
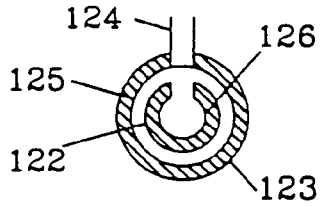
FIGS. 18*a*, 18*b* and 18*c* are cross-sectional view of three cross-sections of the air valve shown in FIG. 18.
Figure 18B:
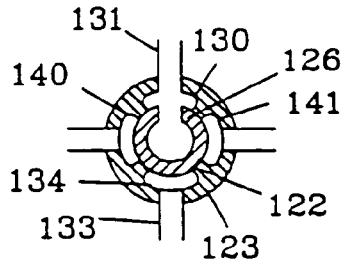
Figure 18C:
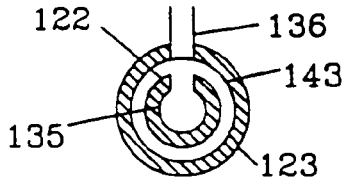

FIGS. 18*a*, 18*b* and 18*c* are cross-sectional view of valve 23 showing the air passages of the valves at three positions along valve 23 when positioned as shown in FIG. 18.

Figure 19:
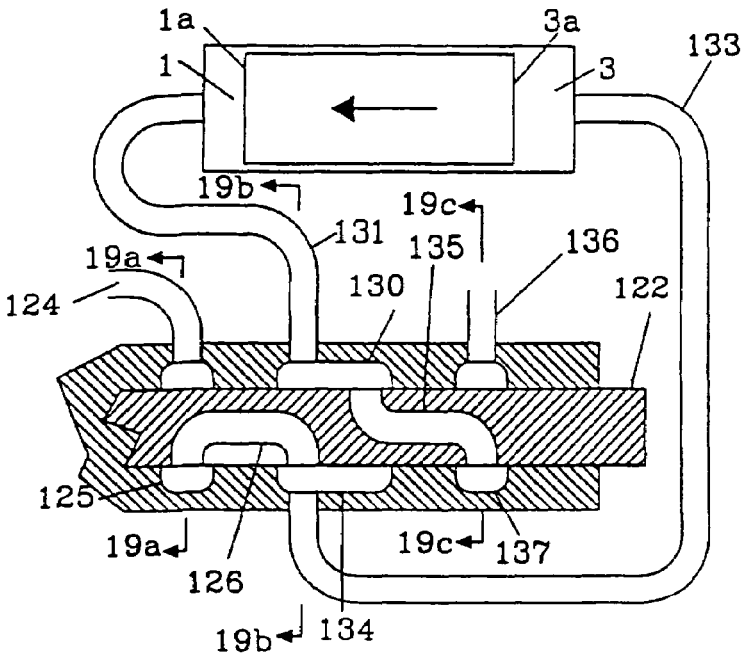
FIG. 19 illustrates the air valve in a second position.

FIG. 19 shows rotary valve 123 rotated 180° when pressurized air is applied to cylinder 3, reversing the direction of piston 1*a*, 3*a*. Pressurized air is applied to inlet port 124, through annular chamber 125, passage way 126, chamber 134 and air line 133 to cylinder 3. This in turn causes air in cylinder 1 to be exhausted through line 131, chamber 130, line 135, annular chamber 137 and out exhaust port 136. Shaft 122 will have rotated 360° turning counter clockwise when piston 1*a*, 3*a* complete it stroke to the left.

Only piston 1*a*,3*a* have been illustrated to show the operation of the air engine and valve 123 relative to the piston motion. The operation of piston 2*a*,4*a* is identical in function except that its 360° cycle starts at 90° shaft rotation and reverses at 270° and completes its cycle back at 90°. A power stroke occurs at every 90° of rotation.

Figure 19A:
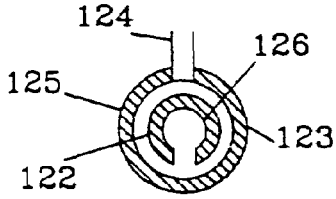
FIGS. 19*a*, 19*b* and 19*c* are cross-sectional view of three cross-sections for the air valve shown in FIG. 19.
Figure 19B:
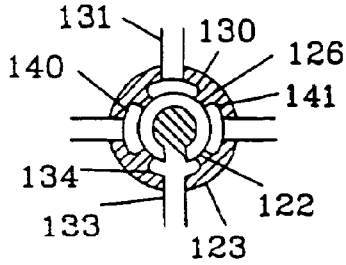
Figure 19C:
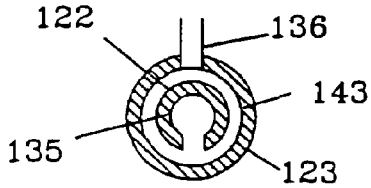

FIGS. 19*a*, 19*b* and 19*c* are cross-sectional views of valve 123 showing the air passages of the valves at three positions along valve 123 when positioned as shown in FIG. 19.

The principle of operation which operates the air engine of FIG. 17 can be reversed, and engine 120 of FIG. 17 can be used as an air or gas compressor or pump. By rotating engine 10 clockwise by applying rotary power to shaft 122, exhaust port 136 will draw in air into the cylinders and port 124 will supply air which may be used to drive, for example air tool, or be stored in an air tank.

Figure 20:
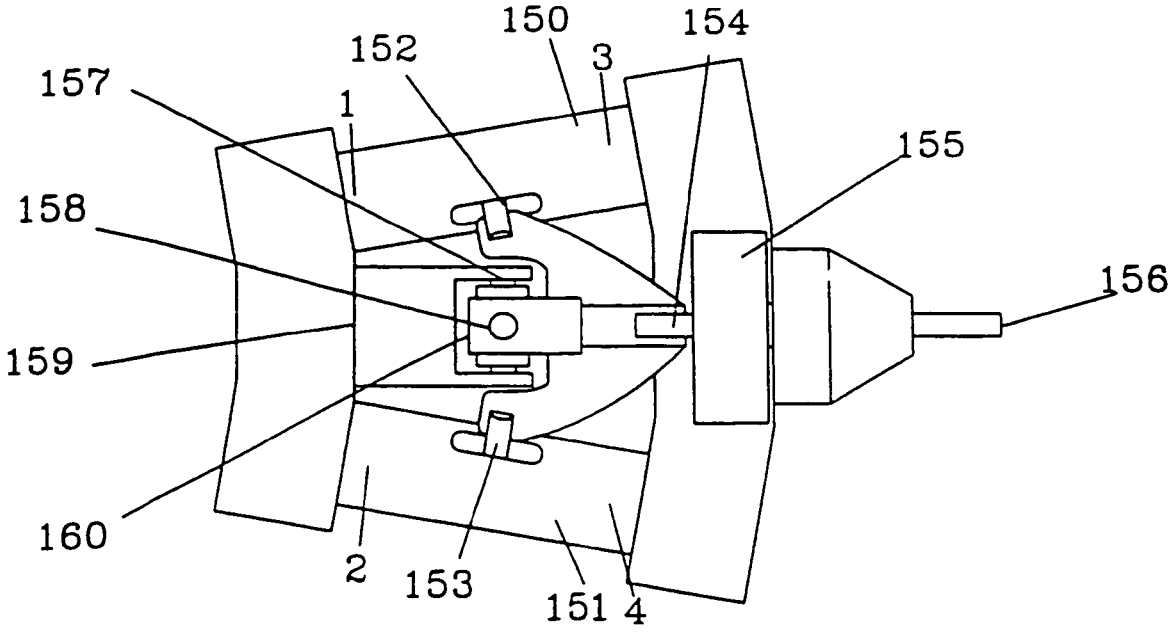
FIG. 20 shows an embodiment with slanted cylinders.

In the above embodiments, the cylinders have been illustrated as being parallel to each other. However, the cylinders need not be parallel. FIG. 20 shows an embodiment similar to the embodiment of FIG. 1-6, with cylinders 150 and 151 not parallel to each other. Universal joint 160 permits the piston arms 152 and 153 to be at an angle other than 90° to the drive arm 154. Even with the cylinders not parallel to each other the engines are functionally the same.

Figure 21:
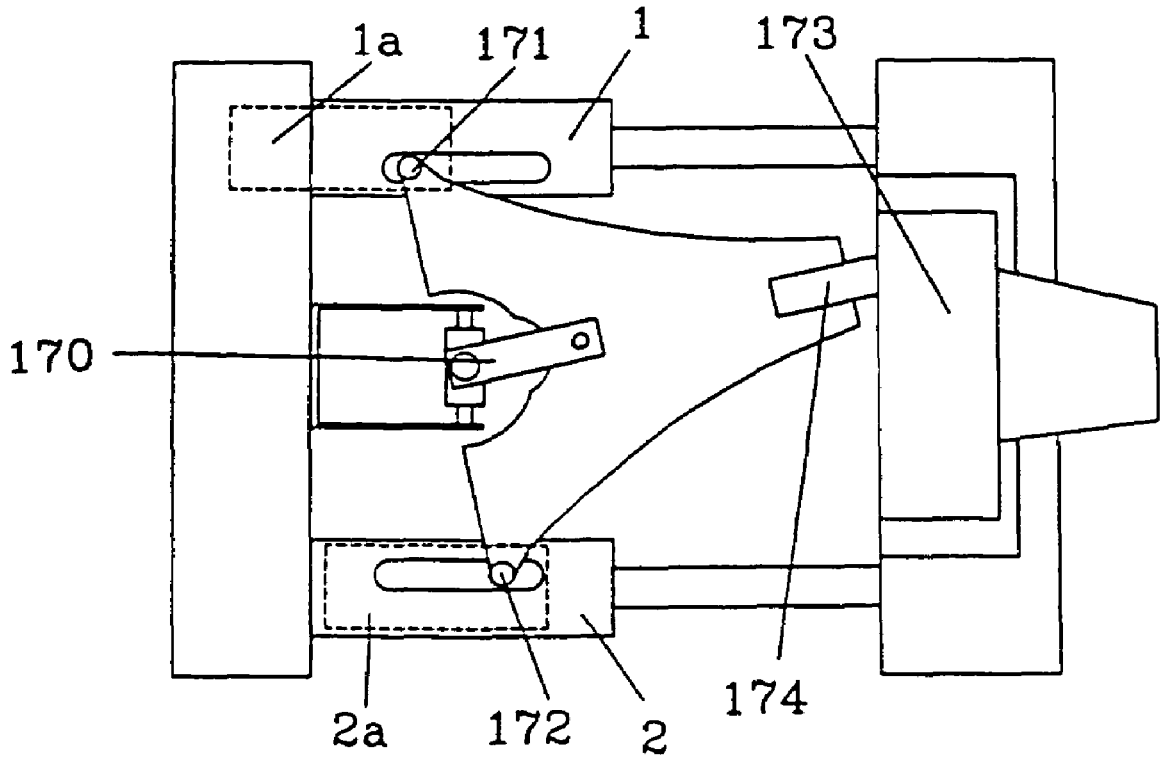
FIG. 21 shows an embodiment with single ended pistons.

Still another modification may be made to the engine 10 of FIGS. 1-6. This embodiment, pictorially shown in FIG. 21, may have single ended pistons. Piston 1*a* and 2*a* are connected to universal joint 170 by drive arms 171 and 172, and to flywheel 173 by drive arm 174. The basic difference is the number of strokes of pistons 1*a* and 2*a* to rotate flywheel 173 360°.

Figure 22:
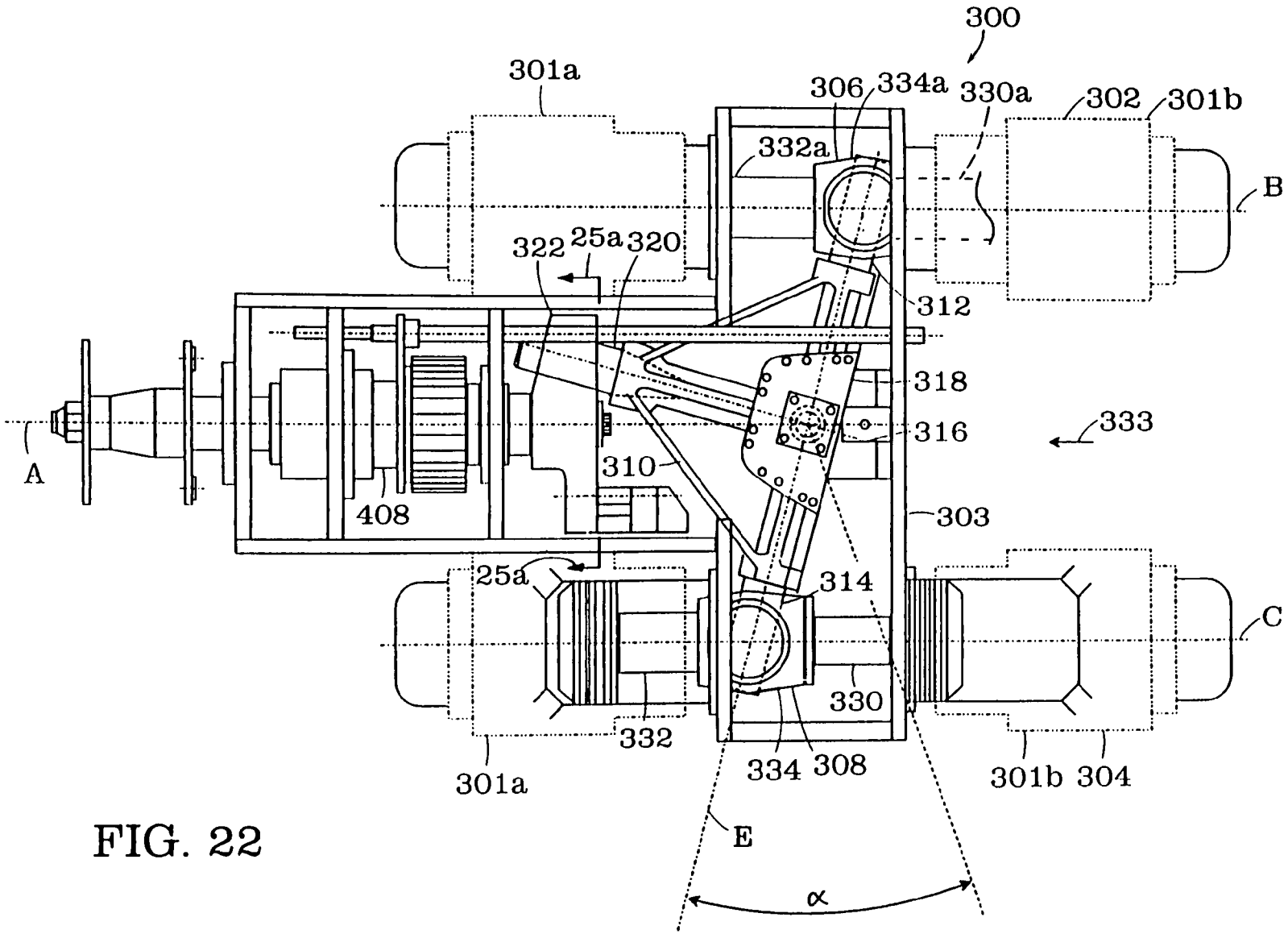
FIG. 22 is a top view of a two cylinder, double ended piston assembly.

Referring to FIG. 22, a two cylinder piston assembly 300 includes cylinders 302, 304, each housing a variable stroke, double ended piston 306, 308, respectively. Piston assembly 300 provides the same number of power strokes per revolution as a conventional four cylinder engine. Each double ended piston 306, 308 is connected to a transition arm 310 by a drive pin 312, 314, respectively. Transition arm 310 is mounted to a support 316 by, e.g., a universal joint 318 (U-joint), constant velocity joint, or spherical bearing. A drive arm 320 extending from transition arm 310 is connected to a rotatable member, e.g., flywheel 322.

Transition arm 310 transmits linear motion of pistons 306, 308 to rotary motion of flywheel 322. The axis, A, of flywheel 322 is parallel to the axes, B and C, of pistons 306, 308 (though axis, A, could be off-axis as shown in FIG. 20) to form an axial or barrel type engine, pump, or compressor. U-joint 318 is centered on axis, A. As shown in FIG. 28*a*, pistons 306, 308 are 180? apart with axes A, B and C lying along a common plane, D, to form a flat piston assembly.

Figures 23, 23A:
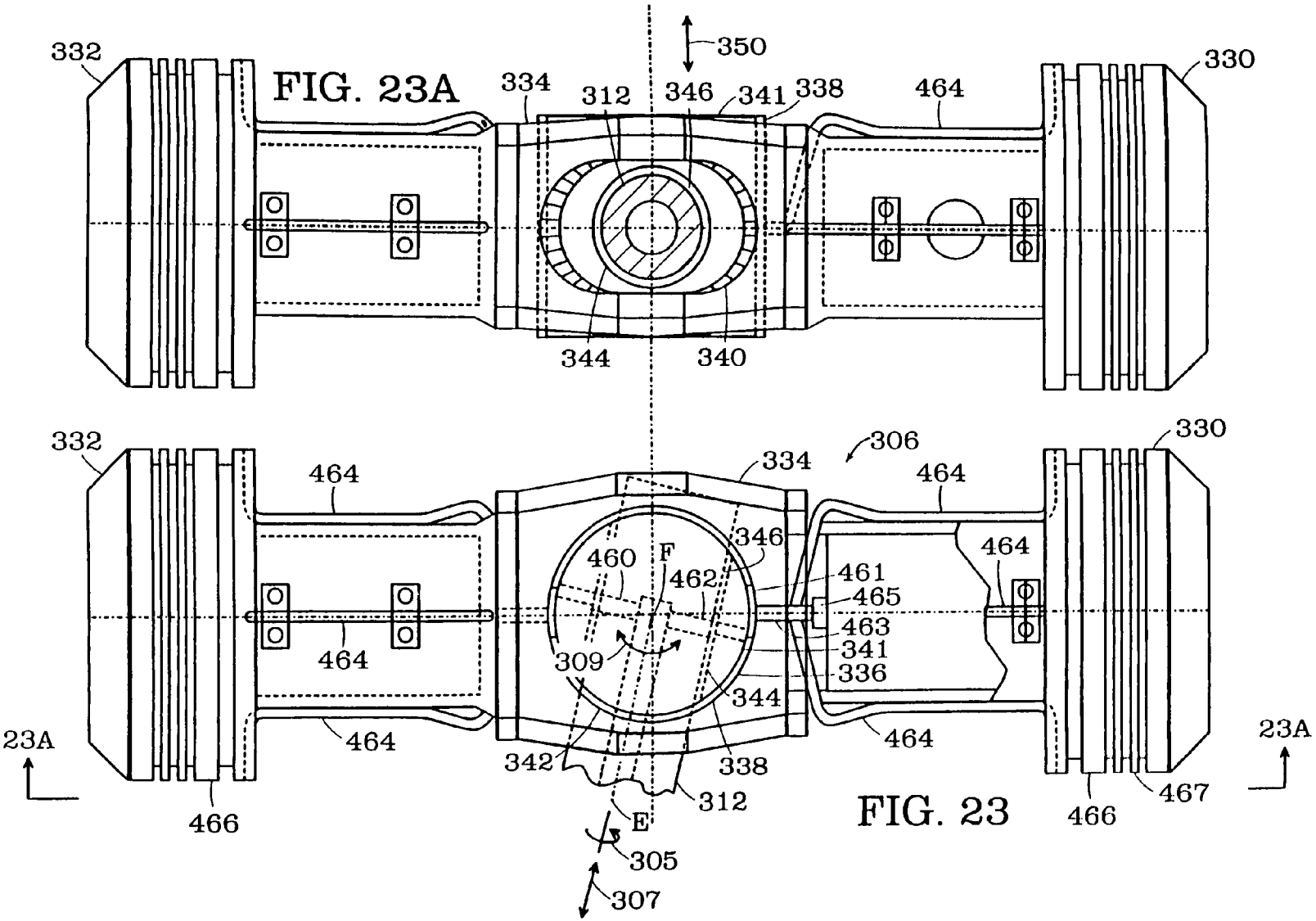
FIG. 23 is a top view of one of the double ended pistons of the assembly of FIG. 22.
FIG. 23*a* is a side view of the double ended piston of FIG. 23, taken along lines 23A, 23A.

Referring to FIGS. 22 and 23, cylinders 302, 304 each include left and right cylinder halves 301*a*, 301*b* mounted to the assembly case structure 303. Double ended pistons 306, 308 each include two pistons 330 and 332, 330*a* and 332*a*, respectively, joined by a central joint 334, 334*a*, respectively. The pistons are shown having equal length, though other lengths are contemplated. For example, joint 334 can be off-center such that piston 330 is longer than piston 332.

As the pistons are fired in sequence 330*a*, 332, 330, 332*a*, from the position shown in FIG. 22, flywheel 322 is rotated in a clockwise direction, as viewed in the direction of arrow 333. Piston assembly 300 is a four stroke cycle engine, i.e., each piston fires once in two revolutions of flywheel 322.

As the pistons move back and forth, drive pins 312, 314 must be free to rotate about their common axis, E, (arrow 305), slide along axis, E, (arrow 307) as the radial distance to the center line, B, of the piston changes with the angle of swing, α, of transition arm 310 (approximately ±15° swing), and pivot about centers, F, (arrow 309). Joint 334 is constructed to provide this freedom of motion.

Joint 334 defines a slot 340 (FIG. 23*a*) for receiving drive pin 312, and a hole 336 perpendicular to slot 340 housing a sleeve bearing 338. A cylinder 341 is positioned within sleeve bearing 338 for rotation within the sleeve bearing. Sleeve bearing 338 defines a side slot 342 shaped like slot 340 and aligned with slot 340. Cylinder 341 defines a through hole 344. Drive pin 312 is received within slot 342 and hole 344. An additional sleeve bearing 346 is located in through hole 344 of cylinder 341. The combination of slots 340 and 342 and sleeve bearing 338 permit drive pin 312 to move along arrow 309. Sleeve bearing 346 permits drive pin 312 to rotate about its axis, E, and slide along its axis, E.

If the two cylinders of the piston assembly are configured other than 180° apart, or more than two cylinders are employed, movement of cylinder 341 in sleeve bearing 338 along the direction of arrow 350 allows for the additional freedom of motion required to prevent binding of the pistons as they undergo a figure 8 motion, discussed below. Slot 340 must also be sized to provide enough clearance to allow the figure 8 motion of the pin.

Figure 35:
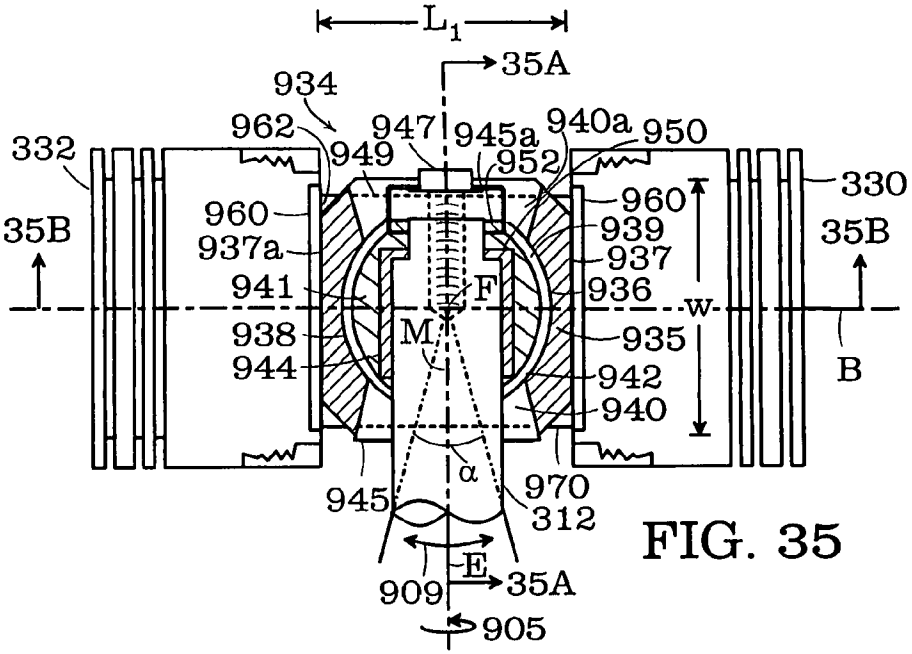
FIG. 35 is a partial, cross-sectional top view of an alternative embodiment of a double-ended piston joint.
Figure 35B:
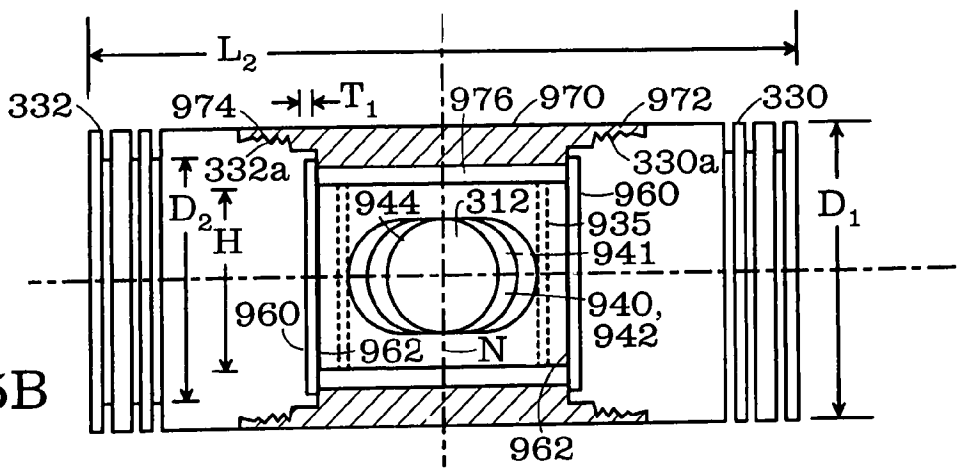
FIG. 35A is an end view and FIG. 35B is a side view of the double-ended piston joint, taken along lines 35A, 35A and 35B, 35B, respectively, of FIG. 35.
Figure 35A:
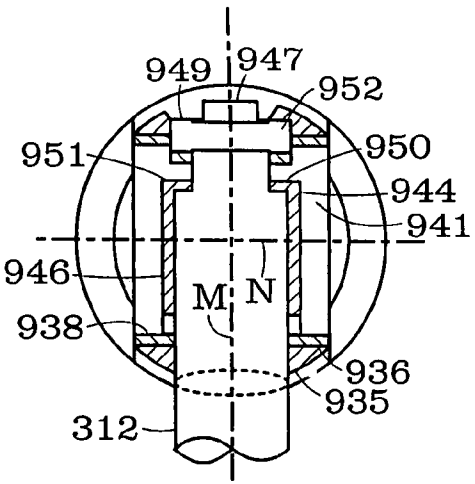

Referring to FIGS. 35-35B, an alternative embodiment of a central joint 934 for joining pistons 330 and 332 is configured to produce zero side load on pistons 330 and 332. Joint 934 permits the four degrees of freedom necessary to prevent binding of drive pin 312 as the pistons move back and forth, i.e., rotation about axis, E, (arrow 905), pivoting about center, F, (arrow 909), and sliding movement along orthogonal axes, M (up and down in the plane of the paper in FIG. 35) and N (in and out of the plane of the paper in FIG. 35), while the load transmitted between joint 934 and pistons 330, 332 only produces a force vector which is parallel to piston axis, B (which is orthogonal to axes M and N).

Sliding movement along axis, M, accommodates the change in the radial distance of transition arm 310 to the center line, B, of the piston with the angle of swing, α, of transition arm 310. Sliding movement along axis, N, allows for the additional freedom of motion required to prevent binding of the pistons as they undergo the figure eight motion, discussed below. Joint 934 defines two opposed flat faces 937, 937*a* which slide in the directions of axes M and N relative to pistons 330, 332. Faces 937, 937*a* define parallel planes which remain perpendicular to piston axis, B, during the back and forth movement of the pistons.

Joint 934 includes an outer slider member 935 which defines faces 937, 937*a* for receiving the driving force from pistons 330, 332. Slider member 935 defines a slot 940 in a third face 945 of the slider for receiving drive pin 312, and a slot 940*a* in a fourth face 945*a*. Slider member 935 has an inner wall 936 defining a hole 939 perpendicular to slot 940 and housing a slider sleeve bearing 938. A cross shaft 941 is positioned within sleeve bearing 938 for rotation within the sleeve bearing in the direction of arrow 909. Sleeve bearing 938 defines a side slot 942 shaped like slot 940 and aligned with slot 940. Cross shaft 941 defines a through hole 944. Drive pin 312 is received within slot 942 and hole 944. A sleeve bearing 946 is located in through hole 944 of cross shaft 941.

The combination of slots 940 and 942 and sleeve bearing 938 permit drive pin 312 to move in the direction of arrow 909. Positioned within slot 940*a* is a cap screw 947 and washer 949 which attach to drive pin 312 retaining drive pin 312 against a step 951 defined by cross shaft 941 while permitting drive pin 312 to rotate about its axis, E, and preventing drive pin 312 from sliding along axis, E. As discussed above, the two addition freedoms of motion are provided by sliding of slider faces 937, 937*a* relative to pistons 330, 332 along axis, M and N. A plate 960 is placed between each of face 937 and piston 330 and face 937*a* and piston 332. Each plate 960 is formed of a low friction bearing material with a bearing surface 962 in contact with faces 937, 937*a*, respectively. Faces 937, 937*a* are polished.

Figure 36:
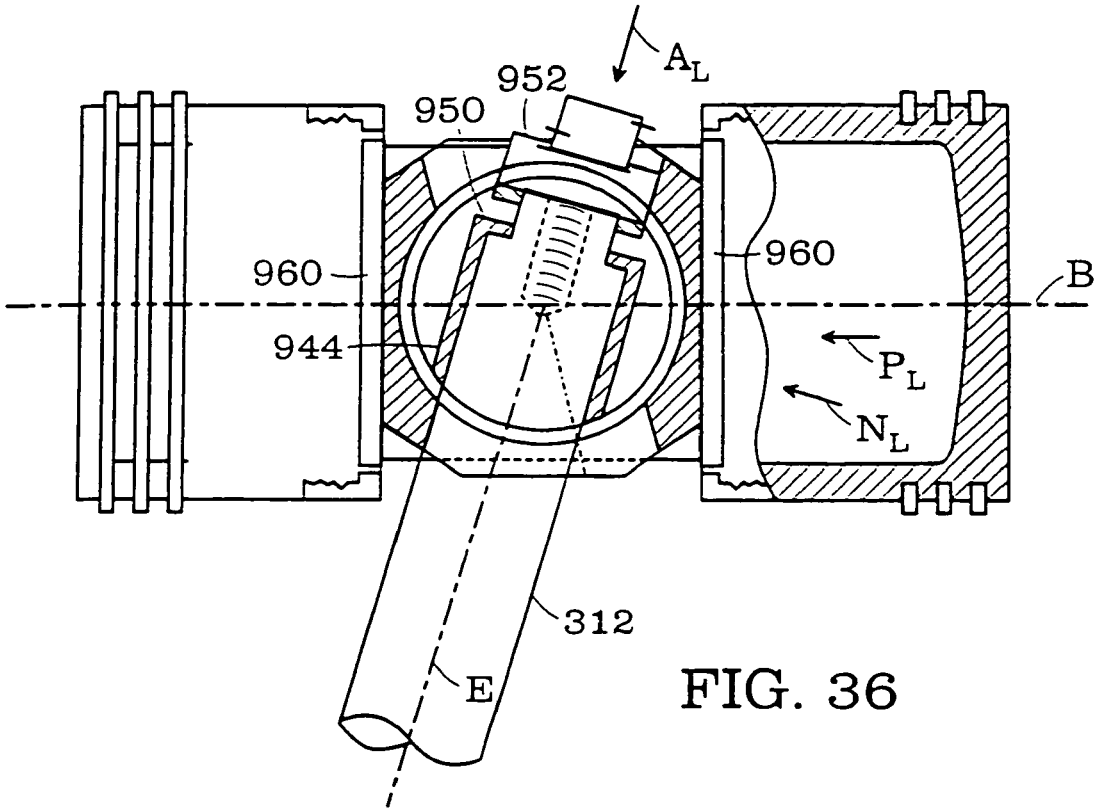
FIG. 36 is a partial, cross-sectional top view of the double-ended piston joint of FIG. 35 shown in a rotated position.

As shown in FIG. 36, the load, $P_L$, applied to joint 934 by piston 330 in the direction of piston axis, B, is resolved into two perpendicular loads acting on pin 312. axial load, $A_L$, along the axis, E, of drive pin 312, and normal load, $N_L$, perpendicular to drive pin axis, E. The axial load is applied to thrust bearings 950, 952, and the normal load is applied to sleeve bearing 946. The net direction of the forces transmitted between pistons 330, 332 and joint 934 remains along piston axis, B, preventing side loads being applied to pistons 330, 332. This is advantageous because side loads on pistons 330, 332 can cause the pistons to contact the cylinder wall creating frictional losses proportional to the side load values.

Pistons 330, 332 are mounted to joint 934 by a center piece connector 970. Center piece 970 includes threaded ends 972, 974 for receiving threaded ends 330*a* and 332*a* of the pistons, respectively. Center piece 970 defines a cavity 975 for receiving joint 934. A gap 976 is provided between joint 934 and center piece 970 to permit motion along axis, N.

For an engine capable of producing, e.g., about 100 horsepower, joint 934 has a width, W, of, e.g., about 3 5/16 inches, a length, $L_1$, of, e.g., 3 5/16 inches, and a height, H, of, e.g., about 3½ inches. The joint and piston ends together have an overall length, $L_2$, of, e.g., about 9 5/16 inches, and a diameter, $D_1$, of, e.g., about 4 inches. Plates 960 have a diameter, $D_2$, of, e.g., about 3¼ inch, and a thickness, T, of, e.g., about ⅛ inch. Plates 960 are press fit into the pistons. Plates 960 are preferably bronze, and slider 935 is preferably steel or aluminum with a steel surface defining faces 937, 937*a*.

Figure 37:
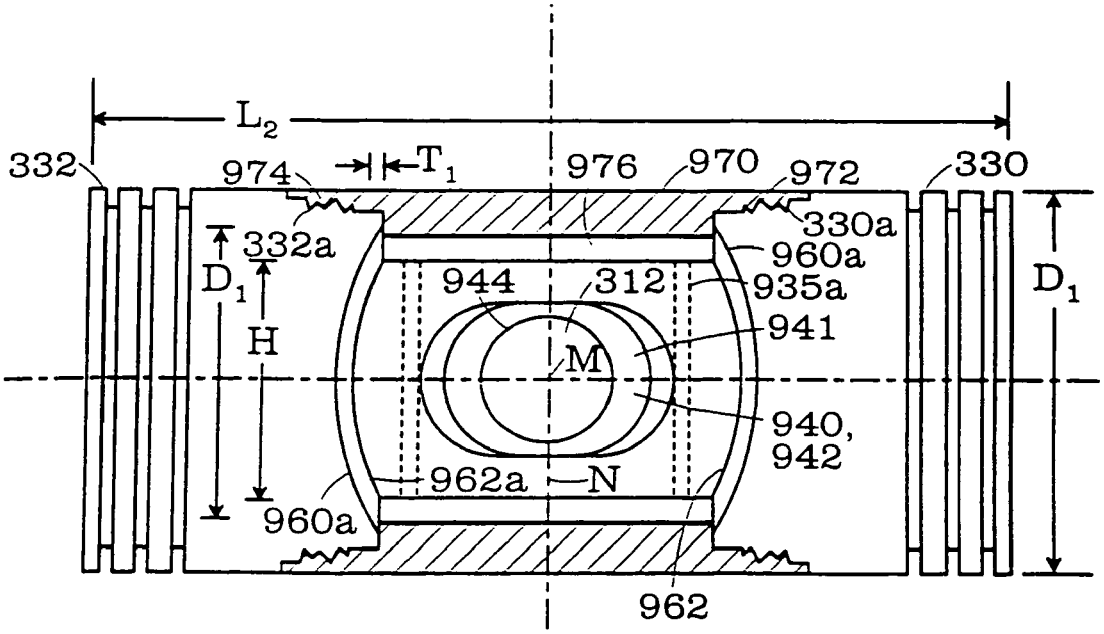
FIG. 37 is a side view of an alternative embodiment of the joint of FIG. 35.

Joint 934 need not be used to join two pistons. One of pistons 330, 332 can be replaced by a rod guided in a bushing.

Where figure eight motion is not required or is allowed by motion of drive pin 312 within cross shaft 941, joint 934 need not slide in the direction of axis, N. Referring to FIG. 37, slider member 935*a* and plates 960*a* have curved surfaces permitting slider member 935*a* to slide in the direction of axis, M, (in and out of the paper in FIG. 37) while preventing slider member 935*a* to move along axis, N.

Figure 56B:
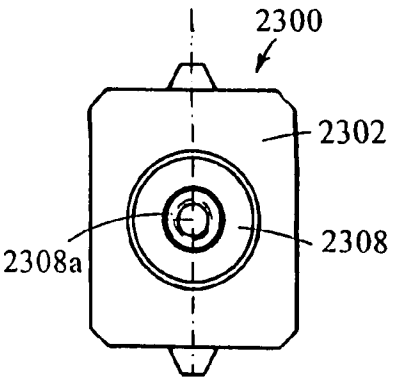
FIGS. 56A and 56B are top and end views, respectively, of the piston joint of FIG. 56.
Figure 56:
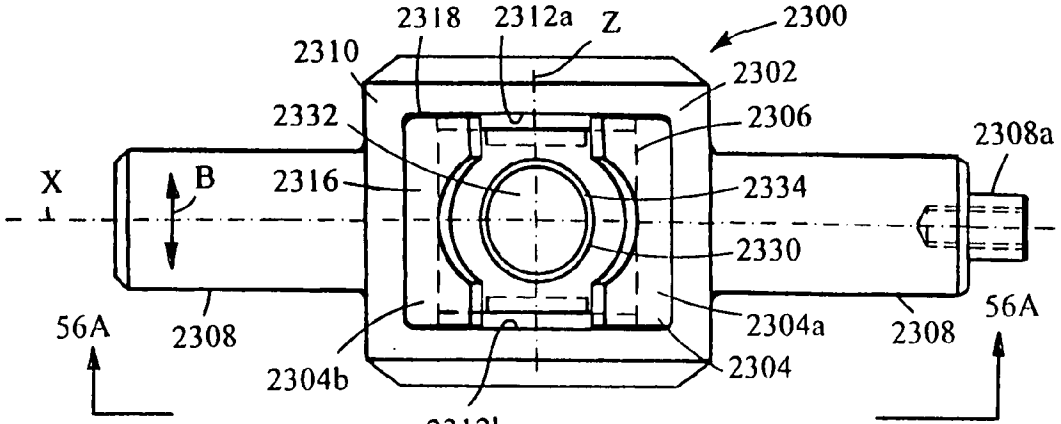
FIG. 56 is a side view of an alternative embodiment of a piston joint.
Figure 56A:
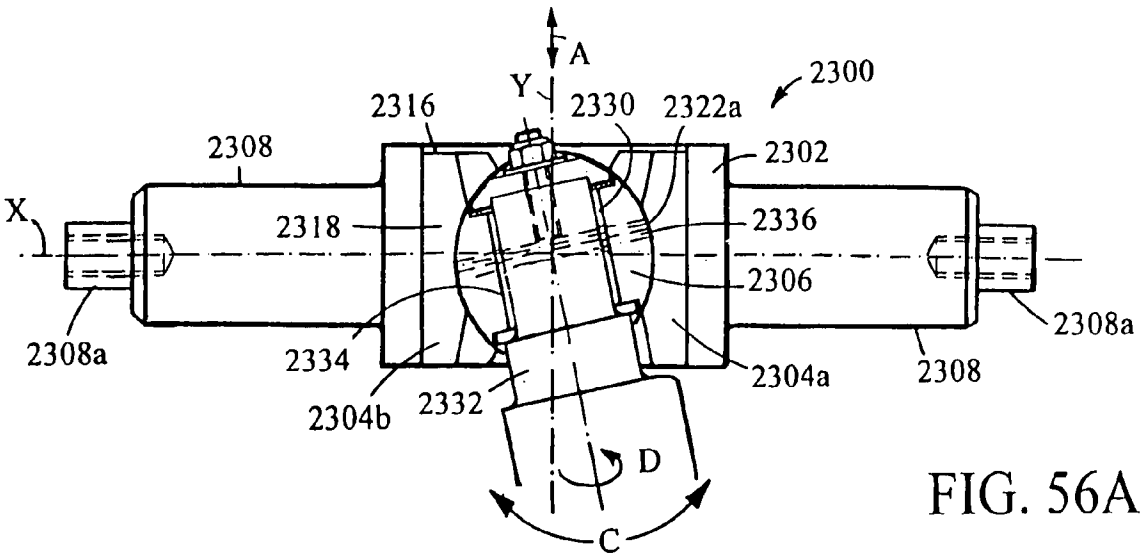
Figure 56C:
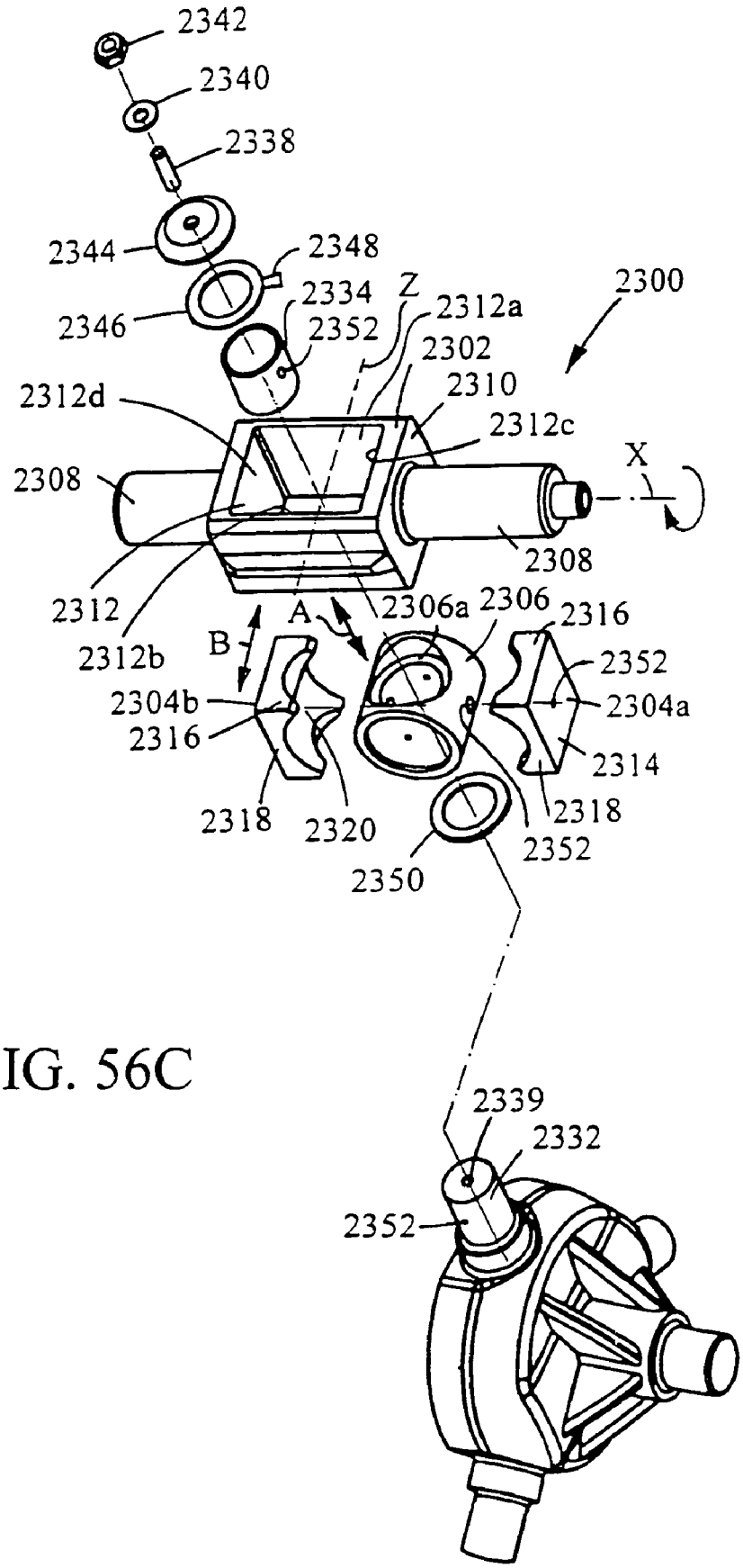
FIG. 56C is an exploded perspective view of the piston joint of FIG. 56.
Figure 56F:
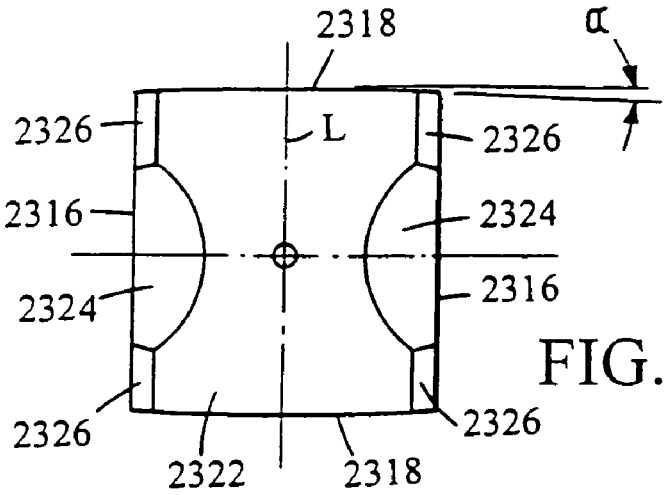
FIGS. 56E and 56F are side and inner face views, respectively, of an outer member of the piston joint of FIG. 56.

Referring to FIGS. 56-56F, a piston joint 2300 includes a housing 2302, an outer member 2304 having first and second parts 2304*a*, 2304*b*, and an inner cylindrical member 2306. Housing 2302 includes extensions 2308 and a rectangular shaped enclosure 2310. In FIG. 56, one extension 2308 includes a mount 2308*a* to which a piston or plunger (not shown) is coupled, with the opposite extension 2308 acting as guide rods. In FIG. 56A, both extensions 2308 are shown with mounts 2308*a* to which a double-ended piston or plunger is coupled. Enclosure 2310 defines a rectangular shaped opening 2312 (FIG. 56C) in which outer member 2304 and inner member 2306 are positioned. Opening 2312 is defined by four flat inner walls 2312*a*, 2312*b*, 2312*c*, 2312*d* of enclosure 2310.

Figure 56E:
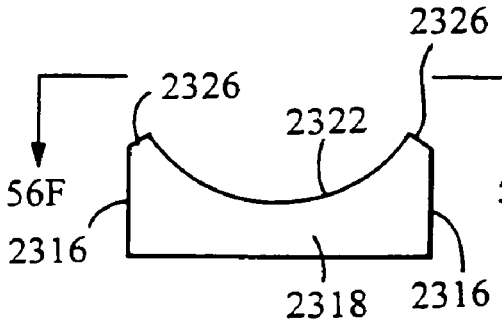
Figure 56D:
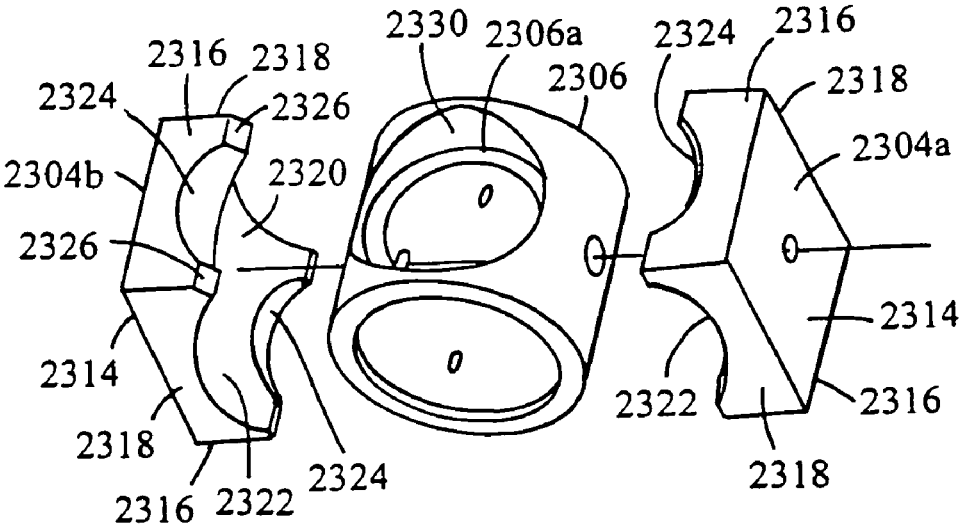
FIG. 56D is an exploded view of inner and outer members of the piston joint of FIG. 56.

Referring particularly to FIGS. 56C and 56D, parts 2304*a*, 2304*b* each have a flat outer, end wall 2314, defining a plane perpendicular to an axis, X, defined by mounts 2308, two parallel flat sides 2316, and two curved side walls 2318. Parts 2304*a*, 2304*b* also have an inner end wall 2320 with a concave cut-out 2322. When assembled, concave cut-outs 2322 define an opening 2322*a* (FIG. 56A) between parts 2304*a*, 2304*b* for receiving inner member 2306. Inner end wall 2320 also defines two, sloped concave cut-outs 2324 perpendicular to cut-outs 2322 and positioned between sloped edges 2326, for purposes described below. Parts 2304*a*, 2304*b* are sized relative to opening 2312 to be free to slide along an axis, Y, perpendicular to axis, X, (arrow A), but are restricted by walls 2312*a*, 2312*b* from sliding along an axis, Z, perpendicular to axes, X and Y (arrow B).

Inner member 2306 defines a through hole 2330 for receiving a transition arm drive arm 2332. Inner member 2306 is shorter in the Z direction than opening 2312 in housing 2302 such that inner member 2306 can slide within opening 2312 along axis, Z, (arrow B). Located between drive arm 2332 and inner member 2306 is a sleeve bearing 2334 which facilitates rotation of drive arm 2332 relative to inner member 2306 about axis, Y, arrow (D) (FIG. 56D). Drive arm 2332 is coupled to inner member 2306 by a threaded stud 2338, washer 2340, nut 2342, and thrust washers 2344 and 2346. Stud 2338 is received within a threaded hole 2339 in arm 2332. Inner member 2306 is countersunk at 2306*a* to receive washer 2346. Thrust washer 2346 includes a tab 2348 received in a notch (not shown) in inner member 2306 to prevent rotation of thrust washer 2346 relative to inner member 2306. Thrust washer 2344 is formed, e.g., of steel, with a polished surface facing thrust washer 2346. Thrust washer 2346 has, e.g., a Teflon surface facing thrust washer 2344 to provide low friction between washers 2344 and 2346, and a copper backing. An additional thrust washer 2350, formed, e.g., of bronze, is positioned between inner member 2306 and the transition arm.

Piston joint 2300 includes an oil path 2336 (FIG. 56A) for flow of lubrication. Arm 2332, inner member 2306, outer member parts 2304*a* and 2304*b*, and bearing 2334 include through holes 2352 that define oil path 2336. Alternatively, bearing 2334 can be formed from two rings with a gap between the rings for flow of oil.

In operation, outer member 2304 and inner member 2306 slide together relative to housing 2302 along axis, Y, (arrow A), inner member 2306 slides relative to outer member 2304 along axis, Z, (arrow B), inner member 2306 rotates relative to outer member 2304 about axis, Z, (arrow C), and drive arm 2332 rotates relative to inner member 2306 about axis, Y, (arrow D). Load is transferred between outer member 2304 and housing 2302 along vectors parallel to axis, X, by flat sides 2314 of outer member 2304 and flat walls 2312*c* and 2312*d* of housing 2302, thus limiting the transfer of any side loads to the pistons.

Depending on the layout and number of cylinders, motion of drive arm 2332 can also cause inner member 2306 to rotate about axis, X. For example, in a three cylinder pump, with the top cylinder in line with the U-joint fixed axis, and the second and third cylinders spaced 120 degrees, the drive arms for the second and third cylinders undergo a twisting motion which is part of the figure 8 motion describe above. This motion causes rotation of inner member 2306 of the respective joints about axis, X. This twisting motion is taking place at twice the rpm frequency. Unless further steps are taken, housing 2302 and the pistons would also twist about axis, X, at twice the rpm frequency. Inner member 2306 of the joint for the top piston does not undergo twist about axis, X, because its drive pin is confined to motion in a straight line by the U-joint.

In the piston joint of FIG. 35, outer member 935 is free to rotate about axis, B (corresponding to axis, X of FIG. 56), thus the twisting motion of the drive arm is not transferred to the pistons. In the piston joint of FIG. 56, since outer member 2304 is restrained from moving in the direction of axis, Z, curved side walls 2318 of parts 2304*a*, 2304*b* are provided for accommodating the motion about axis, X. Referring particularly to FIGS. 56E and 56F, walls 2318 are radiused over an angle, $\alpha$, of about $\pm 2°$, that blends into a tangent plane at the same 2° angle on both sides of a center is line, L. This provides another degree of freedom enabling parts 2304*a*, 2304*b* to rotate within opening 2312 about axis, X, in response to motion of inner member 2306 about axis, X, without transferring this motion to housing 2302. Since inner member 2306 of the joint for the top piston does not undergo this motion, side walls 2318 of outer member 2304 of this joint preferably have flat sides that allow no angular movement, which controls the angle of the pistons in the top cylinder.

To maintain control of the angular position of the remaining pistons, it is preferable that curved side walls 2318 have radiused sections which extend the minimum amount necessary to limit transfer of the motion about axis, X, to housing 2302. Outer member 2304 acts to nudge the piston to a set angle on the first revolution of the engine or pump. If the piston deviates from that angle, the piston is forced back by the action of outer member 2304 at the end of travel of the piston. The contact between curved walls 2318 and side walls 2312*a*, 2312*b* of housing 2302 is a line contact, but this contact has no work to do in normal use, and the contact line moves on both parts, distributing any wear taking place.

Figure 24:
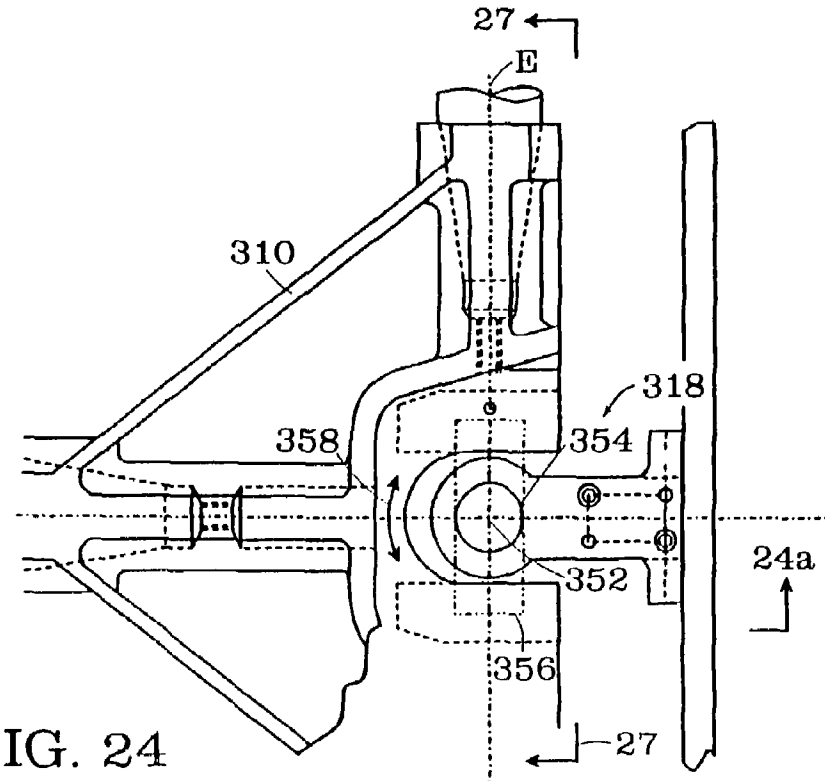
FIG. 24 is a top view of a transition arm and universal joint of the piston assembly of FIG. 22.
Figure 24A:
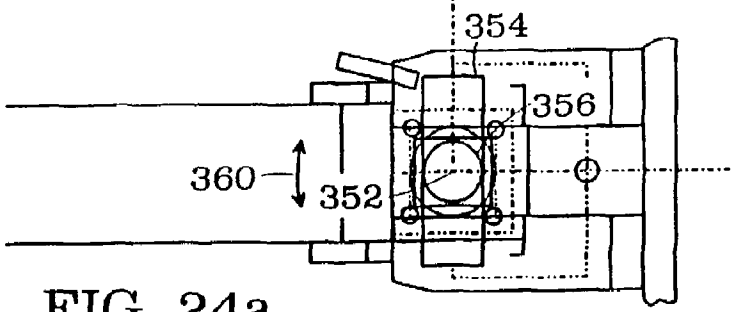
FIG. 24*a* is a side view of the transition arm and universal joint of FIG. 24, taken along lines 24*a*, 24*a;*

Referring to FIGS. 24 and 24*a*, U-joint 318 defines a central pivot 352 (drive pin axis, E, passes through center 352), and includes a vertical pin 354 and a horizontal pin 356. Transition arm 310 is capable of pivoting about pin 354 along arrow 358, and about pin 356 along arrow 360.

Figure 25:
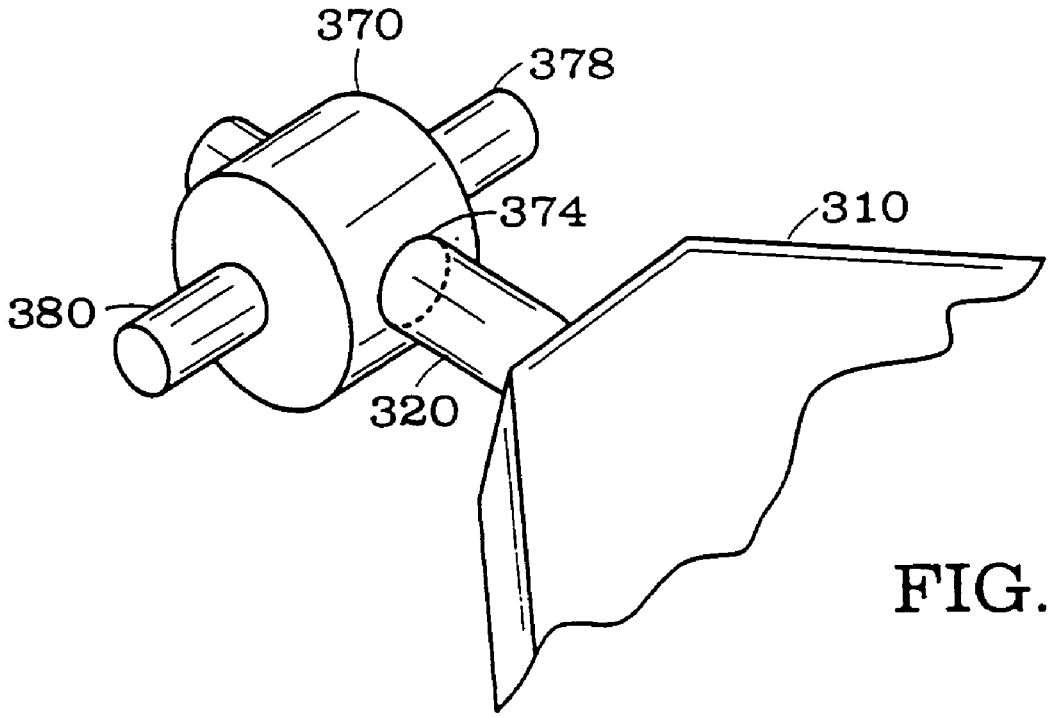
FIG. 25 is a perspective view of a drive arm connected to the transition arm of the piston assembly of FIG. 22.
Figure 25B:
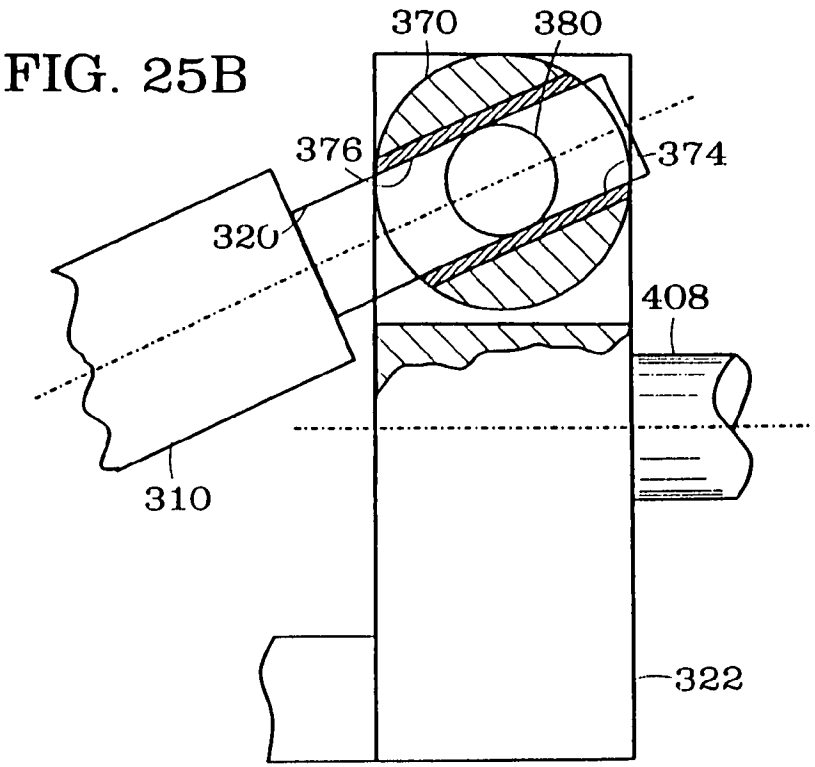
FIG. 25*b* is a side view of the rotatable member, taken along lines 25*b*, 25*b* of FIG. 25*a;*
Figure 25A:
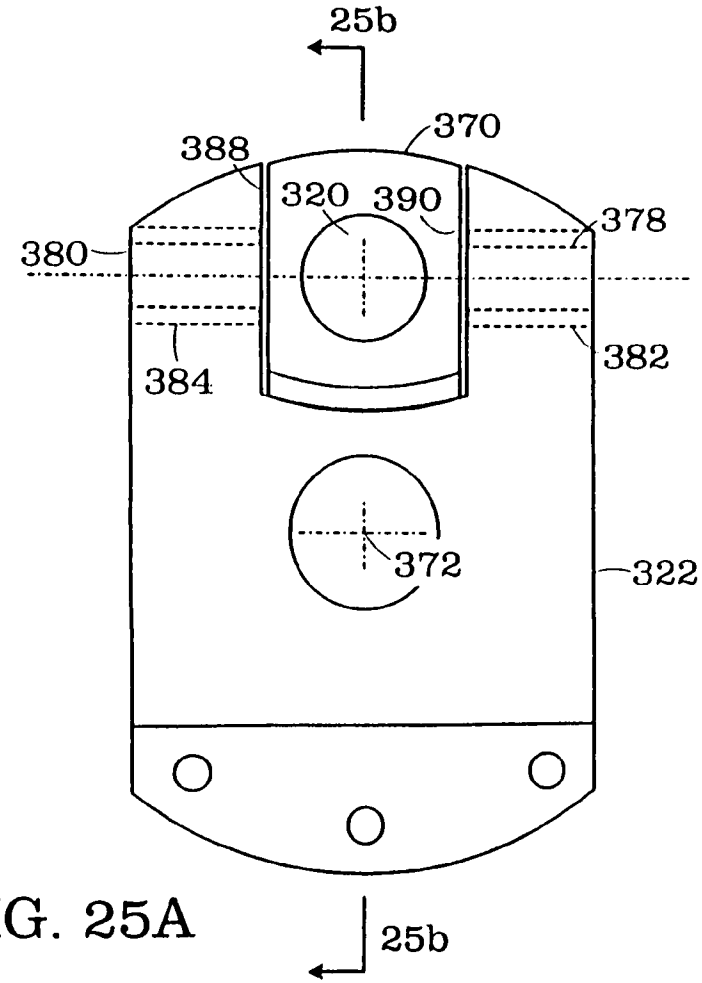
FIG. 25*a* is an end view of a rotatable member of the piston assembly of FIG. 22, taken along lines 25*a*, 25*a* of FIG. 22, and showing the connection of the drive arm to the rotatable member.

Referring to FIGS. 25, 25*a* and 25*b*, as an alternative to a spherical bearing, to couple transition arm 310 to flywheel 322, drive arm 320 is received within a cylindrical pivot pin 370 mounted to the flywheel offset radially from the center 372 of the flywheel by an amount, e.g., 2.125 inches, required to produce the desired swing angle, $\alpha$ (FIG. 22), in the transition arm.

Pivot pin 370 has a through hole 374 for receiving drive arm 320. There is a sleeve bearing 376 in hole 374 to provide a bearing surface for drive arm 320. Pivot pin 370 has cylindrical extensions 378, 380 positioned within sleeve bearings 382, 384, respectively. As the flywheel is moved axially along drive arm 320 to vary the swing angle, $\alpha$, and thus the compression ratio of the assembly, as described further below, pivot pin 370 rotates within sleeve bearings 382, 384 to remain aligned with drive arm 320. Torsional forces are transmitted through thrust bearings 388, 390, with one or the other of the thrust bearings carrying the load depending on the direction of the rotation of the flywheel along arrow 386.

Figure 26:
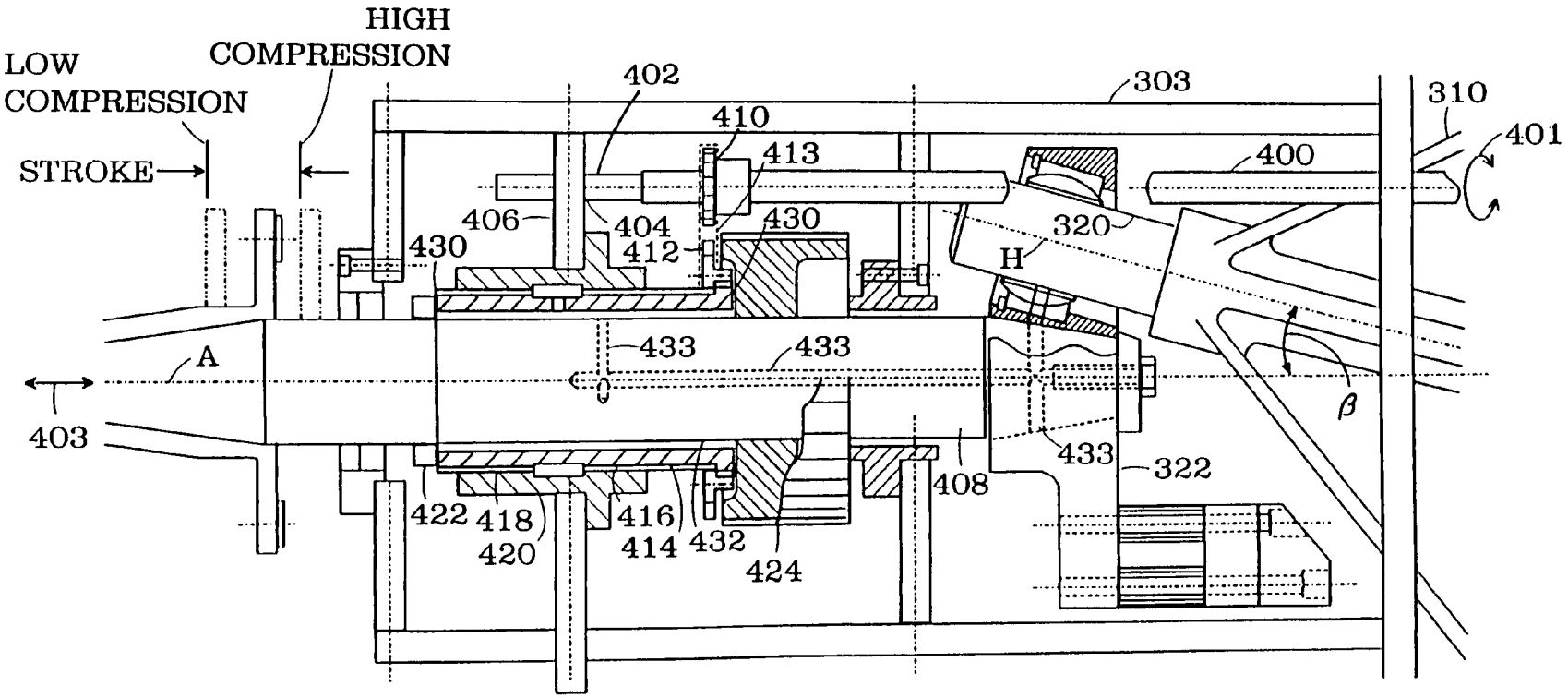
FIG. 26 is a cross-sectional, top view of the piston assembly of FIG. 22.

Referring to FIG. 26, to vary the compression and displacement of piston assembly 300, the axial position of flywheel 322 along axis, A, is varied by rotating a shaft 400.

A sprocket 410 is mounted to shaft 400 to rotate with shaft 400. A second sprocket 412 is connected to sprocket 410 by a roller chain 413. Sprocket 412 is mounted to a threaded rotating barrel 414. Threads 416 of barrel 414 contact threads 418 of a stationary outer barrel 420.

Rotation of shaft 400, arrow 401, and thus sprockets 410 and 412, causes rotation of barrel 414. Because outer barrel 420 is fixed, the rotation of barrel 414 causes barrel 414 to move linearly along axis, A, arrow 403. Barrel 414 is positioned between a collar 422 and a gear 424, both fixed to a main drive shaft 408. Drive shaft 408 is in turn fixed to flywheel 322. Thus, movement of barrel 414 along axis, A, is translated to linear movement of flywheel 322 along axis, A. This results in flywheel 322 sliding along axis, H, of drive arm 320 of transition arm 310, changing angle, β, and thus the stroke of the pistons. Thrust bearings 430 are located at both ends of barrel 414, and a sleeve bearing 432 is located between barrel 414 and shaft 408.

To maintain the alignment of sprockets 410 and 412, shaft 400 is threaded at region 402 and is received within a threaded hole 404 of a cross bar 406 of assembly case structure 303. The ratio of the number of teeth of sprocket 412 to sprocket 410 is, e.g., 4:1. Therefore, shaft 400 must turn four revolutions for a single revolution of barrel 414. To maintain alignment, threaded region 402 must have four times the threads per inch of barrel threads 416, e.g., threaded region 402 has thirty-two threads per inch, and barrel threads 416 have eight threads per inch.

As the flywheel moves to the right, as viewed in FIG. 26, the stroke of the pistons, and thus the compression ratio, is increased. Moving the flywheel to the left decreases the stroke and the compression ratio. A further benefit of the change in stroke is a change in the displacement of each piston and therefore the displacement of the engine. The horsepower of an internal combustion engine closely relates to the displacement of the engine. For example, in the two cylinder, flat engine, the displacement increases by about 20% when the compression ratio is raised from 6:1 to 12:1. This produces approximately 20% more horsepower due alone to the increase in displacement. The increase in compression ratio also increases the horsepower at the rate of about 5% per point or approximately 25% in horsepower. If the horsepower were maintained constant and the compression ratio increased from 6:1 to 12:1, there would be a reduction in fuel consumption of approximately 25%.

The flywheel has sufficient strength to withstand the large centrifugal forces seen when assembly 300 is functioning as an engine. The flywheel position, and thus the compression ratio of the piston assembly, can be varied while the piston assembly is running.

Piston assembly 300 includes a pressure lubrication system. The pressure is provided by an engine driven positive displacement pump (not shown) having a pressure relief valve to prevent overpressures. Bearings 430 and 432 of drive shaft 408 and the interface of drive arm 320 with flywheel 322 are lubricated via ports 433 (FIG. 26).

Figure 27:
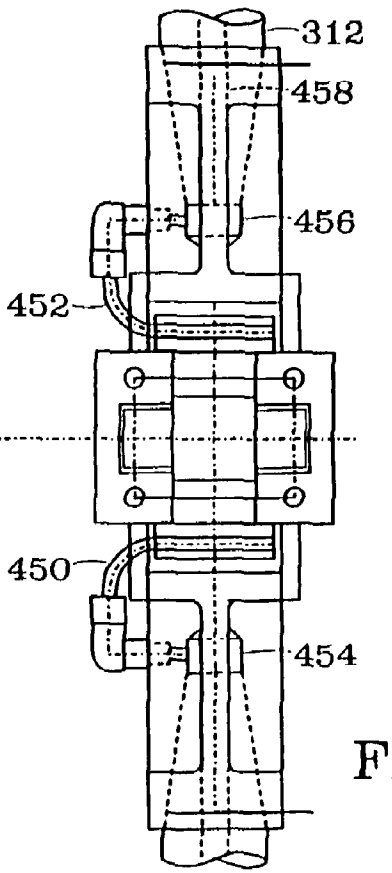
FIG. 27 is an end view of the transition arm, taken along lines 27, 27 of FIG. 24.
Figure 27A:
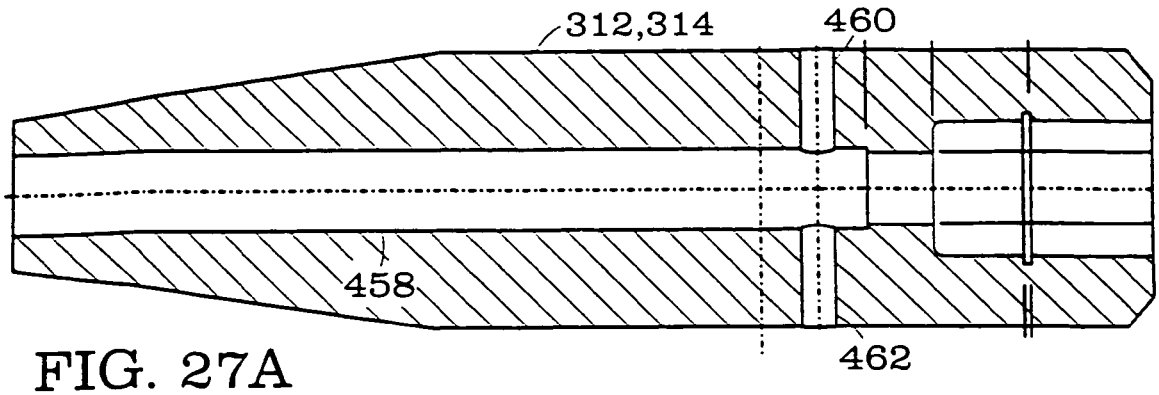
FIG. 27*a* is a cross-sectional view of a drive pin of the piston assembly of FIG. 22.

Referring to FIG. 27, to lubricate U-joint 318, piston pin joints 306, 308, and the cylinder walls, oil under pressure from the oil pump is ported through the fixed U-joint bracket to the top and bottom ends of the vertical pivot pin 354. Oil ports 450, 452 lead from the vertical pin to openings 454, 456, respectively, in the transition arm. As shown in FIG. 27A, pins 312, 314 each define a through bore 458. Each through bore 458 is in fluid communication with a respective one of openings 454, 456. As shown in FIG. 23, holes 460, 462 in each pin connect through slots 461 and ports 463 through sleeve bearing 338 to a chamber 465 in each piston. Several oil lines 464 feed out from these chambers and are connected to the skirt 466 of each piston to provide lubrication to the cylinders walls and the piston rings 467. Also leading from chamber 465 is an orifice to squirt oil directly onto the inside of the top of each piston for cooling.

Figure 28:
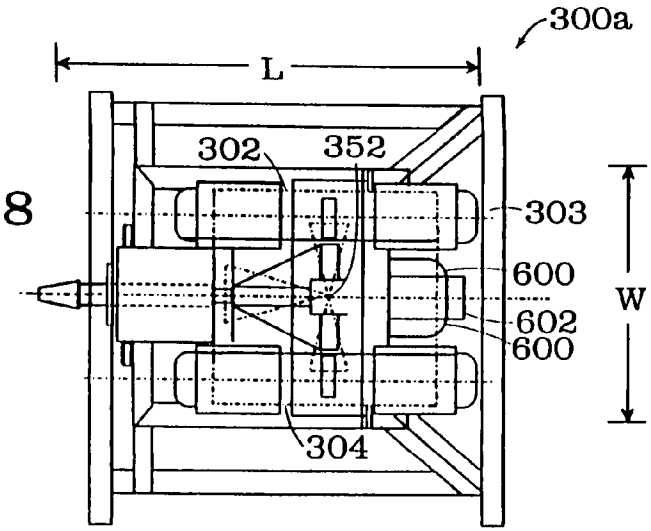
FIGS. 28-28*b* are top, rear, and side views, respectively, of the piston assembly of FIG. 22.
Figure 28A:
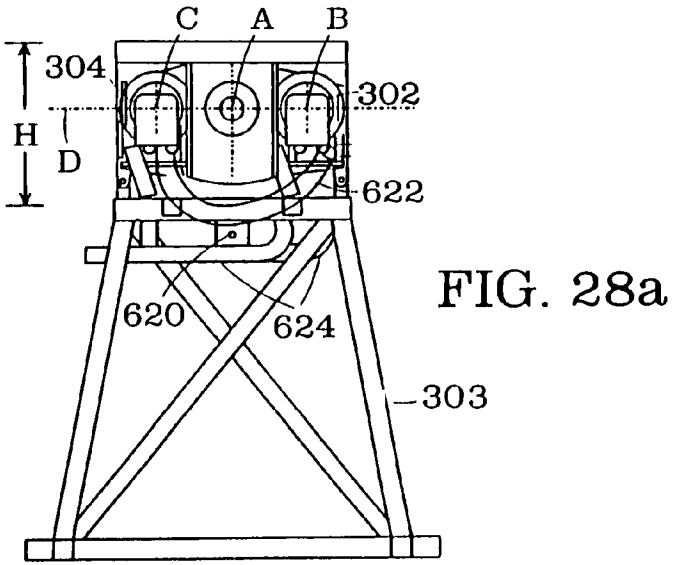
FIG. 28*c* is a top view of an auxiliary shaft of the piston assembly of FIG. 22.
Figure 28B:
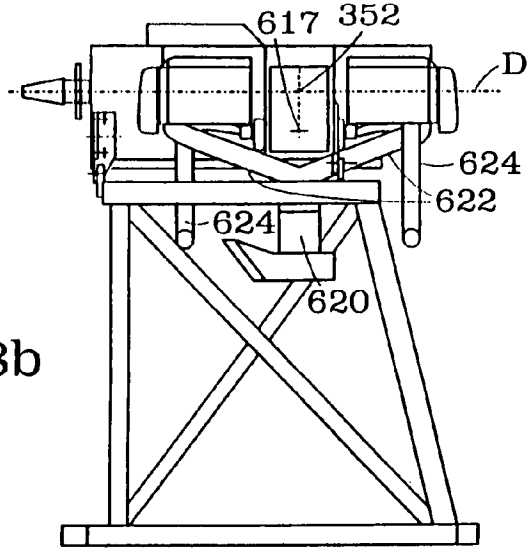
Figure 28C:
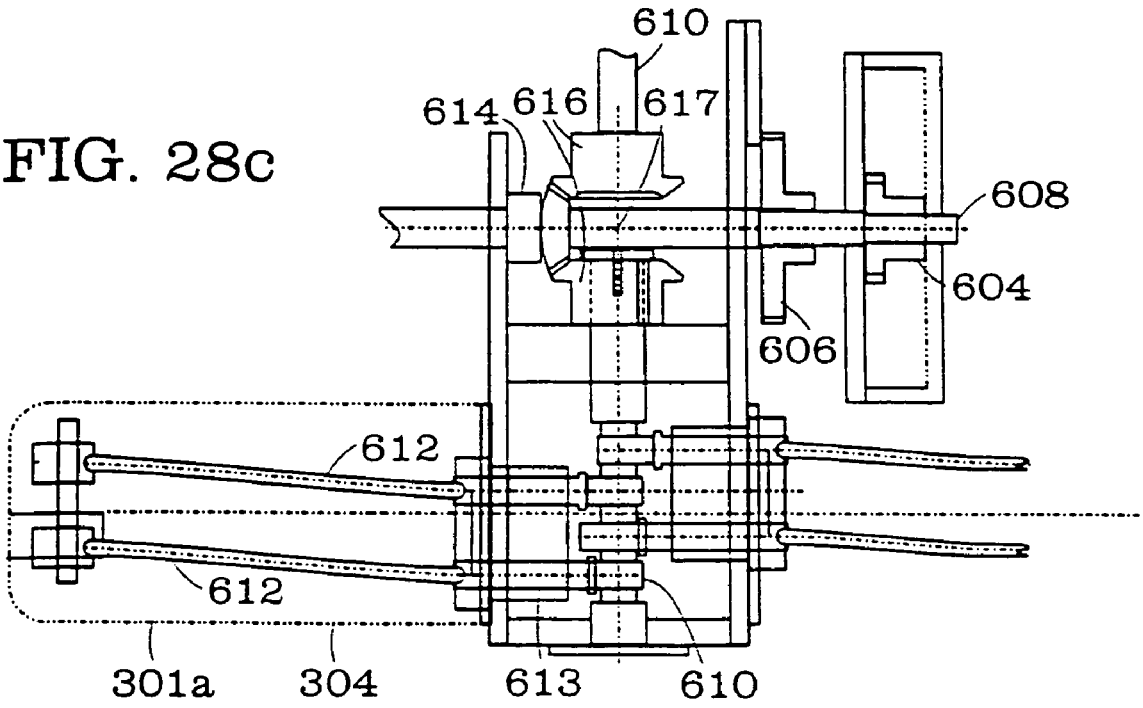

Referring to FIGS. 28-28*c*, in which assembly 300 is shown configured for use as an aircraft engine 300*a*, the engine ignition includes two magnetos 600 to fire the piston spark plugs (not shown). Magnetos 600 and a starter 602 are driven by drive gears 604 and 606 (FIG. 28*c*), respectively, located on a lower shaft 608 mounted parallel and below the main drive shaft 408. Shaft 608 extends the full length of the engine and is driven by gear 424 (FIG. 26) of drive shaft 408 and is geared with a one to one ratio to drive shaft 408. The gearing for the magnetos reduces their speed to half the speed of shaft 608. Starter 602 is geared to provide sufficient torque to start the engine.

Camshafts 610 operate piston push rods 612 through lifters 613. Camshafts 610 are geared down 2 to 1 through bevel gears 614, 616 also driven from shaft 608. Center 617 of gears 614, 616 is preferably aligned with U-joint center 352 such that the camshafts are centered in the piston cylinders, though other configurations are contemplated. A single carburetor 620 is located under the center of the engine with four induction pipes 622 routed to each of the four cylinder intake valves (not shown). The cylinder exhaust valves (not shown) exhaust into two manifolds 624.

Engine 300*a* has a length, L, e.g., of about forty inches, a width, W, e.g., of about twenty-one inches, and a height, H, e.g., of about twenty inches, (excluding support 303).

Figure 29:
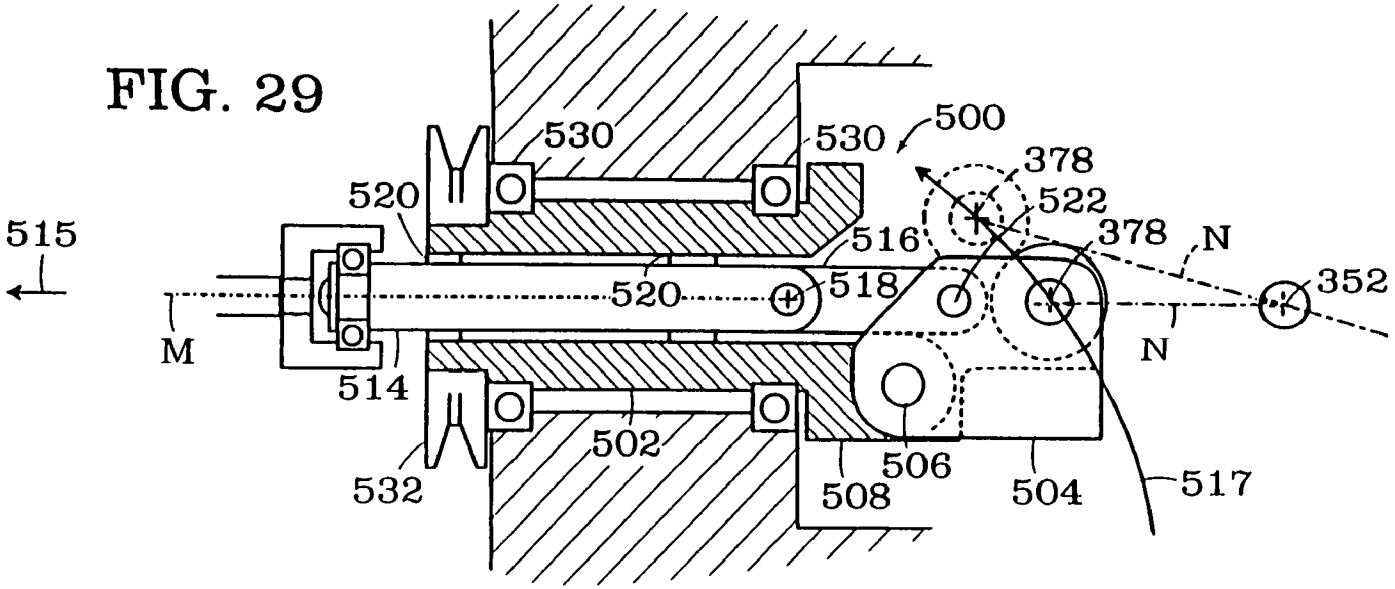
FIG. 29 is a cross-sectional side view of a zero-stroke coupling.
Figure 29A:
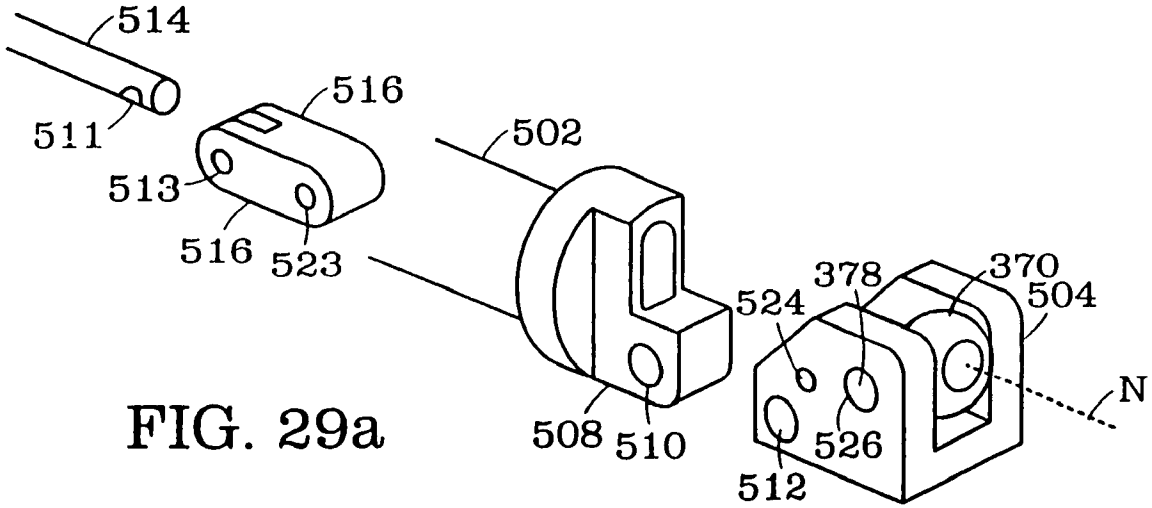
FIG. 29*a* is an exploded view of the zero-stroke coupling of FIG. 29.

Referring to FIGS. 29 and 29*a*, a variable compression compressor or pump having zero stroke capability is illustrated. Here, flywheel 322 is replaced by a rotating assembly 500. Assembly 500 includes a hollow shaft 502 and a pivot arm 504 pivotally connected by a pin 506 to a hub 508 of shaft 502. Hub 508 defines a hole 510 and pivot arm 504 defines a hole 512 for receiving pin 506. A control rod 514 is located within shaft 502. Control rod 514 includes a link 516 pivotally connected to the remainder of rod 514 by a pin 518. Rod 514 defines a hole 511 and link 516 defines a hole 513 for receiving pin 518. Control rod 514 is supported for movement along its axis, Z, by two sleeve bearings 520. Link 516 and pivot arm 514 are connected by a pin 522. Link 516 defines a hole 523 and pivot arm 514 defines a hole 524 for receiving pin 522.

Cylindrical pivot pin 370 of FIG. 25 which receives drive arm 320 is positioned within pivot arm 504. Pivot arm 504 defines holes 526 for receiving cylindrical extensions 378, 380. Shaft 502 is supported for rotation by bearings 530, e.g., ball, sleeve, or roller bearings. A drive, e.g., pulley 532 or gears, mounted to shaft 502 drives the compressor or pump.

In operation, to set the desired stroke of the pistons, control rod 514 is moved along its axis, M, in the direction of arrow 515, causing pivot arm 504 to pivot about pin 506, along arrow 517, such that pivot pin 370 axis, N, is moved out of alignment with axis, M, (as shown in dashed lines) as pivot arm 504 slides along the axis, H, (FIG. 26) of the transition arm drive arm 320. When zero stroke of the pistons is desired, axes M and N are aligned such that rotation of shaft 514 does not cause movement of the pistons. This configuration works for both double ended and single sided pistons.

The ability to vary the piston stroke permits shaft 514 to be run at a single speed by drive 532 while the output of the pump or compressor can be continually varied as needed. When no output is needed, pivot arm 504 simply spins around drive arm 320 of transition arm 310 with zero swing of the drive arm. When output is needed, shaft 514 is already running at full speed so that when pivot arm 504 is pulled off-axis by control rod 514, an immediate stroke is produced with no lag coming up to speed. There are therefore much lower stress loads on the drive system as there are no start/stop actions. The ability to quickly reduce the stroke to zero provides protection from damage especially in liquid pumping when a downstream blockage occurs.

Figure 33:
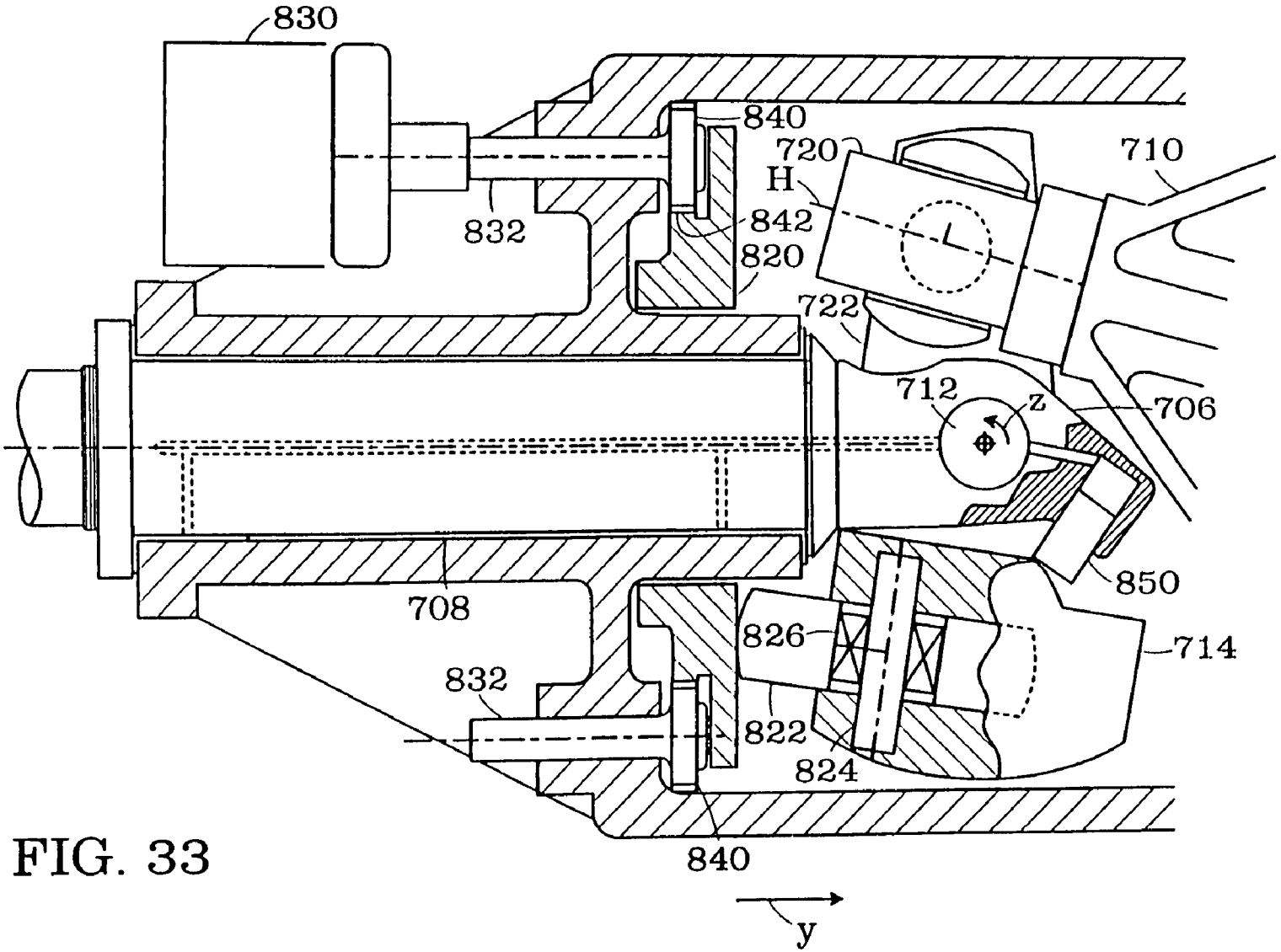
FIG. 33 is a cross-sectional top view of an alternative embodiment of a variable stroke assembly shown in a maximum stroke position.

An alternative method of varying the compression and displacement of the pistons is shown in FIG. 33. The mechanism provides for varying of the position of a counterweight attached to the flywheel to maintain system balance as the stroke of the pistons is varied.

A flywheel 722 is pivotally mounted to an extension 706 of a main drive shaft 708 by a pin 712. By pivoting flywheel 722 in the direction of arrow, Z, flywheel 722 slides along axis, H, of a drive arm 720 of transition arm 710, changing angle, β (FIG. 26), and thus the stroke of the pistons. Pivoting flywheel 722 also causes a counterweight 714 to move closer to or further from axis, A, thus maintaining near rotational balance.

Figure 34:
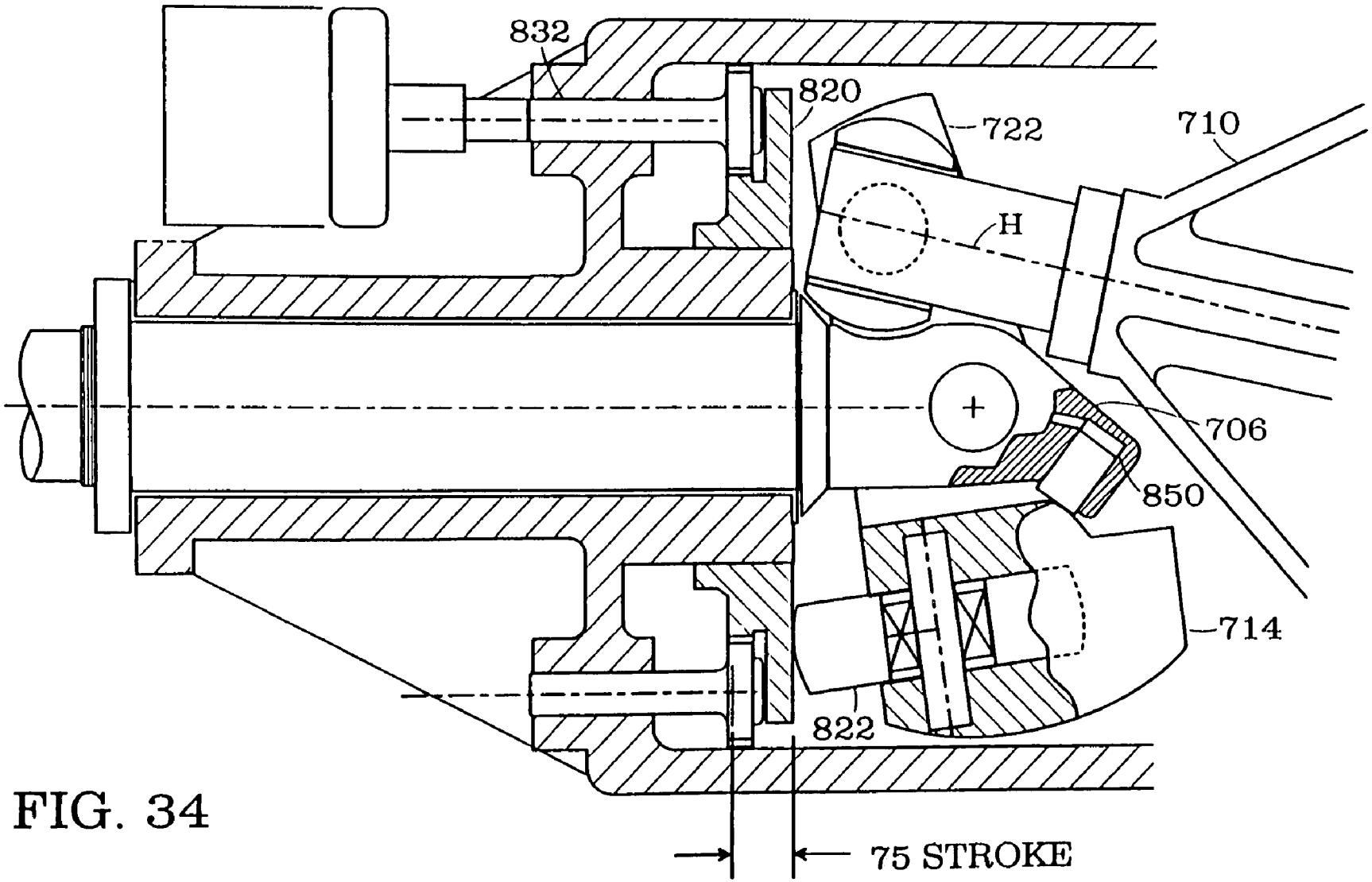
FIG. 34 is a cross-sectional top view of the embodiment of FIG. 33 shown in a minimum stroke position.

To pivot flywheel 722, an axially and rotationally movable pressure plate 820 is provided. Pressure plate 820 is in contact with a roller 822 rotationally mounted to counterweight 714 through a pin 824 and bearing 826. From the position shown in FIG. 33, a servo motor or hand knob 830 turns a screw 832 which advances to move pressure plate 820 in the direction of arrow, Y. This motion of pressure plate 820 causes flywheel 722 to pivot in the direction of arrow, Z, as shown in the FIG. 34, to decrease the stroke of the pistons. Moving pressure plate 820 by 0.75" decreases the compression ratio from about 12:1 to about 6:1.

Pressure plate 820 is supported by three or more screws 832. Each screw has a gear head 840 which interfaces with a gear 842 on pressure plate 820 such that rotation of screw 832 causes rotation of pressure plate 820 and thus rotation of the remaining screws to insure that the pressure plate is adequately supported. To ensure contact between roller 822 and pressure plate 820, a piston 850 is provided which biases flywheel 722 in the direction opposite to arrow, Z.

Figure 30:
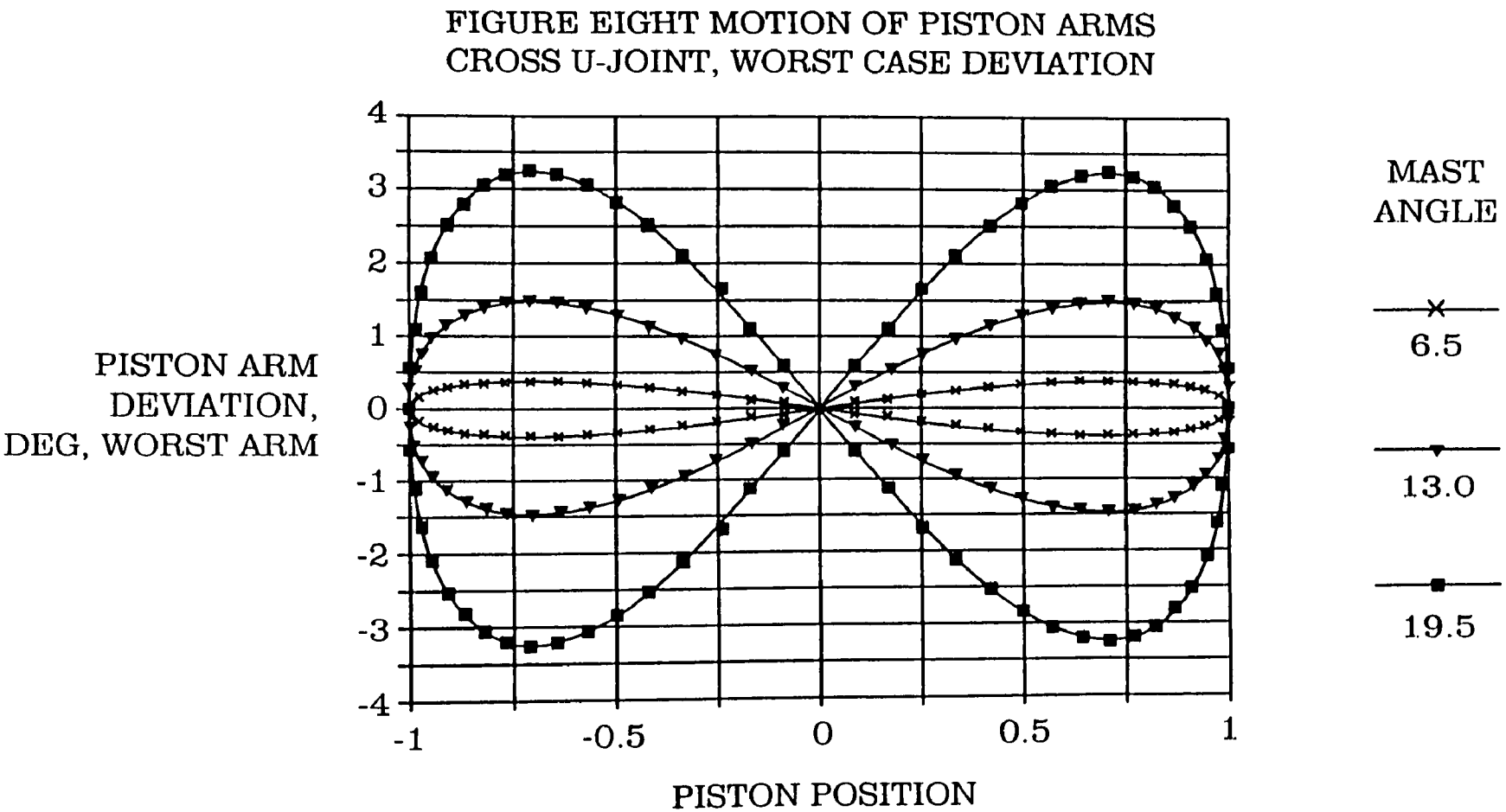
FIG. 30 is a graph showing the figure 8 motion of a non-flat piston assembly.

Referring to FIG. 30, if two cylinders not spaced 180° apart (as viewed from the end) or more than two cylinders are employed in piston assembly 300, the ends of pins 312, 314 coupled to joints 306, 308 will undergo a figure 8 motion. FIG. 30 shows the figure 8 motion of a piston assembly having four double ended pistons. Two of the pistons are arranged flat as shown in FIG. 22 (and do not undergo the figure 8 motion), and the other two pistons are arranged equally spaced between the flat pistons (and are thus positioned to undergo the largest figure 8 deviation possible). The amount that the pins connected to the second set of pistons deviate from a straight line (y axis of FIG. 30) is determined by the swing angle (mast angle) of the drive arm and the distance the pin is from the central pivot point 352 (x axis of FIG. 30).

In a four cylinder version where the pins through the piston pivot assembly of each of the four double ended pistons are set at 45° from the axis of the central pivot, the figure eight motion is equal at each piston pin. Movement in the piston pivot bushing is provided where the figure eight motion occurs to prevent binding.

Figure 31:
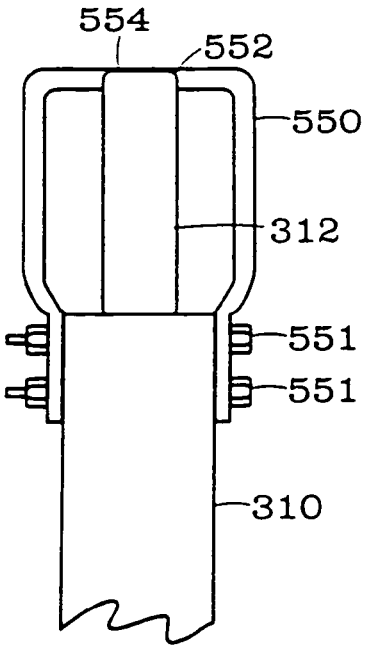
FIG. 31 shows a reinforced drive pin.

When piston assembly 300 is configured for use, e.g., as a diesel engines, extra support can be provided at the attachment of pins 312, 314 to transition arm 310 to account for the higher compression of diesel engines as compared to spark ignition engines. Referring to FIG. 31, support 550 is bolted to transition arm 310 with bolts 551 and includes an opening 552 for receiving end 554 of the pin.

Figure 32A:
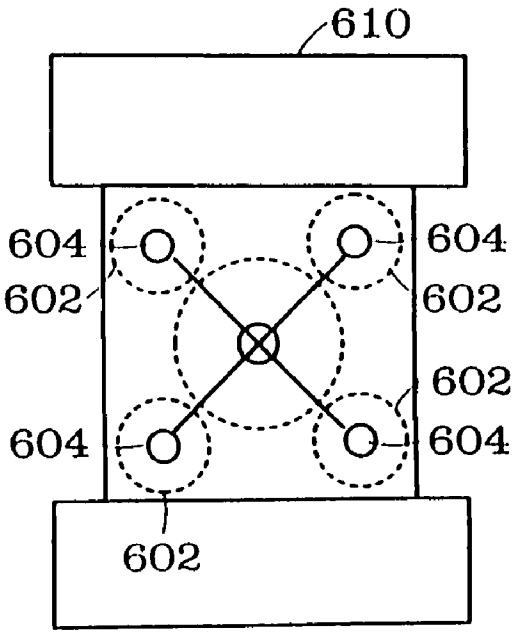
FIG. 32*a* is an end view of the four cylinder engine, taken along lines 32*a*, 32*a* of FIG. 32.
Figure 32:
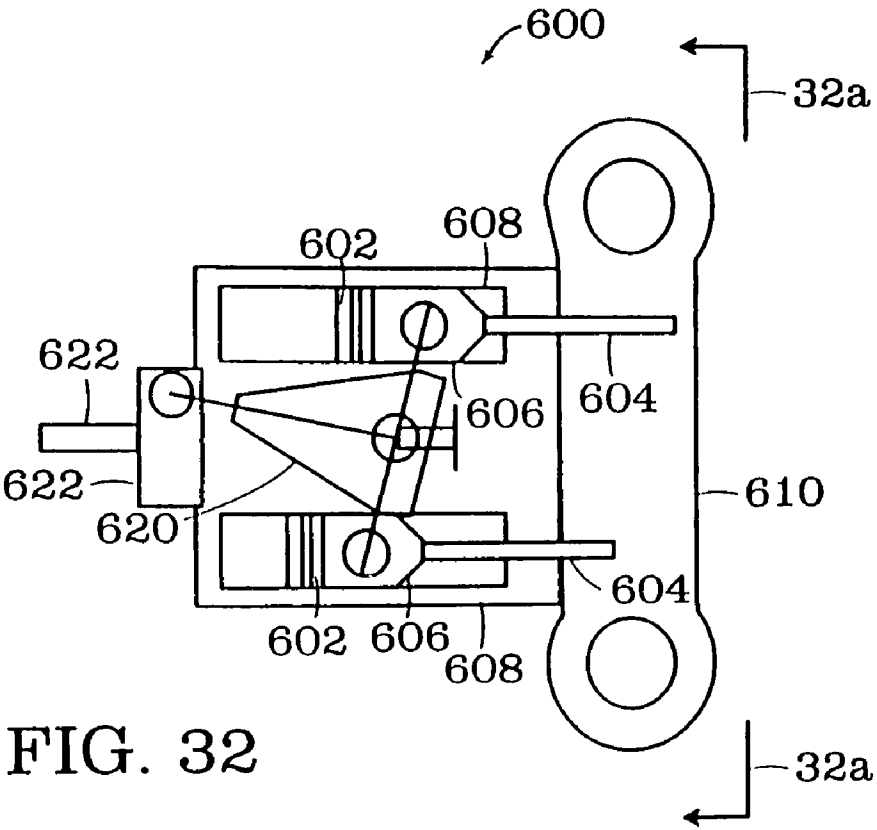
FIG. 32 is a top view of a four cylinder engine for directly applying combustion pressures to pump pistons.

Engines according to the invention can be used to directly apply combustion pressures to pump pistons. Referring to FIGS. 32 and 32*a*, a four cylinder, two stroke cycle engine 600 (each of the four pistons 602 fires once in one revolution) applies combustion pressure to each of four pump pistons 604. Each pump piston 604 is attached to the output side 606 of a corresponding piston cylinder 608. Pump pistons 604 extend into a pump head 610.

A transition arm 620 is connected to each cylinder 608 and to a flywheel 622, as described above. An auxiliary output shaft 624 is connected to flywheel 622 to rotate with the flywheel, also as described above.

The engine is a two stroke cycle engine because every stroke of a piston 602 (as piston 602 travels to the right as viewed in FIG. 32) must be a power stroke. The number of engine cylinders is selected as required by the pump. The pump can be a fluid or gas pump. In use as a multi-stage air compressor, each pump piston 606 can be a different diameter. No bearing loads are generated by the pumping function (for single acting pump compressor cylinders), and therefore, no friction is introduced other than that generated by the pump pistons themselves.

Figure 38A:
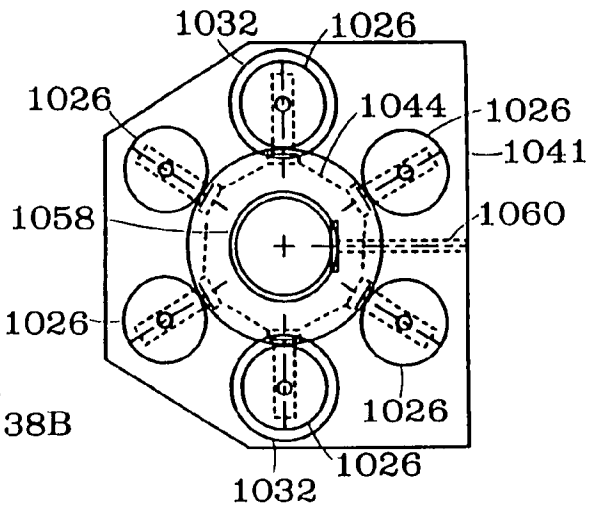
FIG. 38A is an end view and FIG. 38B is a side view of the engine/compressor assembly, taken along lines 38A, 38A and 38B, 38B, respectively, of FIG. 38.
Figure 38:
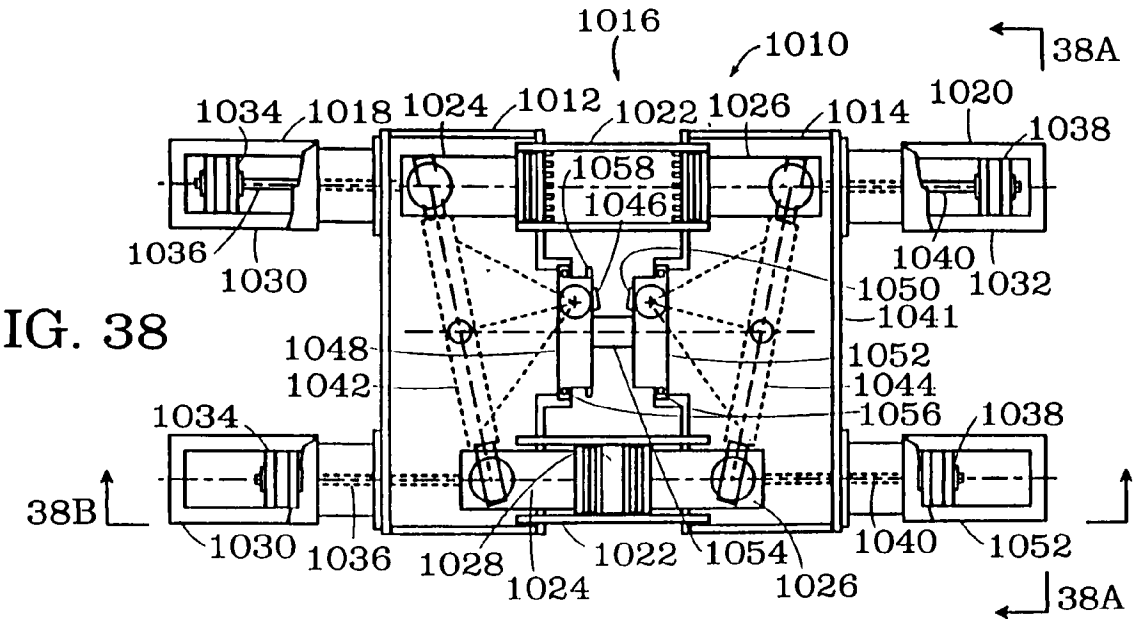
FIG. 38 is a top view of an engine/compressor assembly.
Figure 38B:
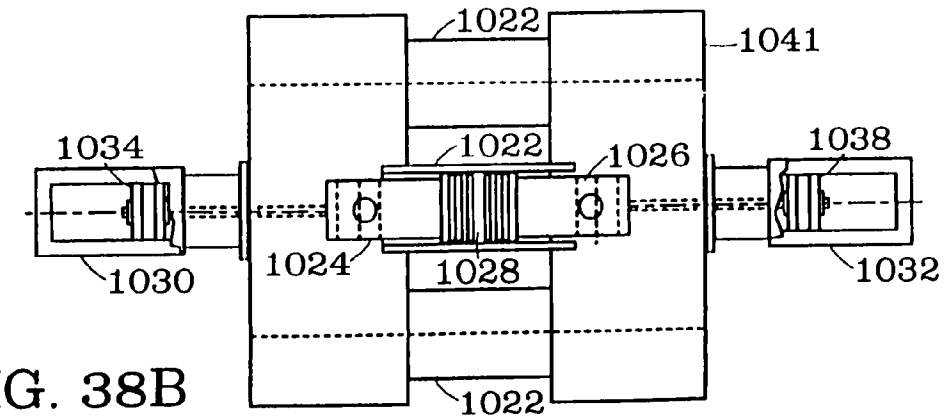

Referring to FIGS. 38-38B, an engine 1010 having vibration canceling characteristics and being particularly suited for use in gas compression includes two assemblies 1012, 1014 mounted back-to-back and 180° out of phase. Engine 1010 includes a central engine section 1016 and outer compressor sections 1018, 1020. Engine section 1016 includes, e.g., six double acting cylinders 1022, each housing a pair of piston 1024, 1026. A power stroke occurs when a center section 1028 of cylinder 1022 is fired, moving pistons 1024, 1026 away from each other. The opposed movement of the pistons results in vibration canceling.

Outer compression section 1018 includes two compressor cylinders 1030 and outer compression section 1020 includes two compressor cylinders 1032, though there could be up to six compressor cylinders in each compression section. Compression cylinders 1030 each house a compression piston 1034 mounted to one of pistons 1024 by a rod 1036, and compression cylinders 1032 each house a compression piston 1038 mounted to one of pistons 1026 by a rod 1040. Compression cylinders 1030, 1032 are mounted to opposite piston pairs such that the forces cancel minimizing vibration forces which would otherwise be transmitted into mounting 1041.

Pistons 1024 are coupled by a transition arm 1042, and pistons 1026 are coupled by a transition arm 1044, as described above. Transition arm 1042 includes a drive arm 1046 extending into a flywheel 1048, and transition arm 1044 includes a drive arm 1050 extending into a flywheel 1052, as described above. Flywheel 1048 is joined to flywheel 1052 by a coupling arm 1054 to rotate in synchronization therewith. Flywheels 1048, 1052 are mounted on bearings 1056. Flywheel 1048 includes a bevel gear 1058 which drives a shaft 1060 for the engine starter, oil pump and distributor for ignition, not shown.

Engine 1010 is, e.g., a two stroke natural gas engine having ports (not shown) in central section 1028 of cylinders 1022 and a turbocharger (not shown) which provides intake air under pressure for purging cylinders 1022. Alternatively, engine 1010 is gasoline or diesel powered.

The stroke of pistons 1024, 1026 can be varied by moving both flywheels 1048, 1052 such that the stroke of the engine pistons and the compressor pistons are adjusted equally reducing or increasing the engine power as the pumping power requirement reduces or increases, respectively.

The vibration canceling characteristics of the back-to-back relationship of assemblies 1012, 1014 can be advantageously employed in a compressor only system and an engine only system.

Figure 39:
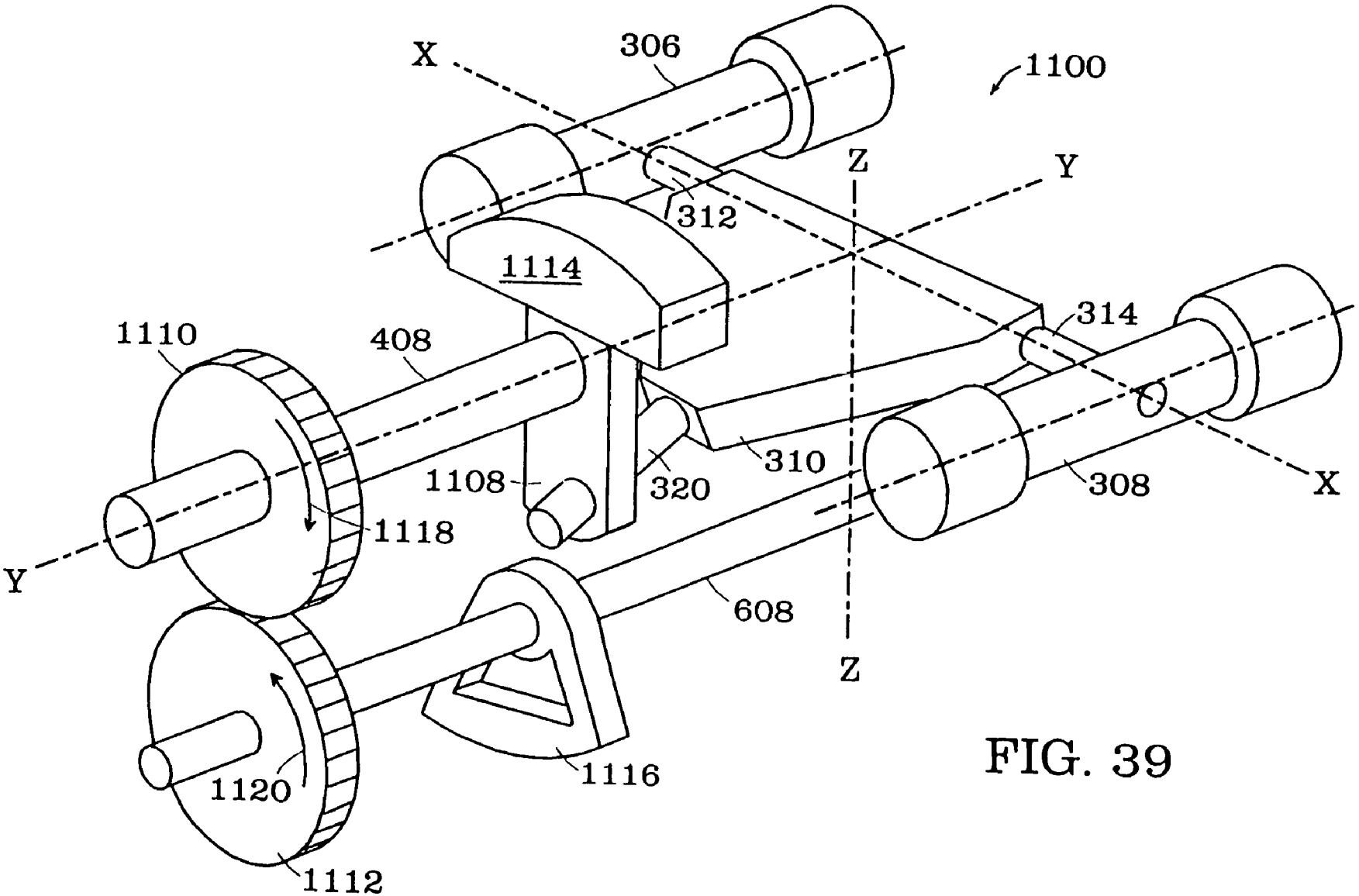
FIG. 39 is a perspective view of a piston engine assembly including counterbalancing.

Counterweights can be employed to limit vibration of the piston assembly. Referring to FIG. 39, an engine 1100 includes counterweights 1114 and 1116. Counterweight 1114 is mounted to rotate with a rotatable member 1108, e.g., a flywheel, connected to drive arm 320 extending from transition arm 310. Counterweight 1116 is mounted to lower shaft 608 to rotate with shaft 608.

Movement of the double ended pistons 306, 308 is translated by transition arm 310 into rotary motion of member 1108 and counterweight 1114. The rotation of member 1108 causes main drive shaft 408 to rotate. Mounted to shaft 408 is a first gear 1110 which rotates with shaft 408. Mounted to lower shaft 608 is a second gear 1112 driven by gear 1110 to rotate at the same speed as gear 1110 and in the opposite direction to the direction of rotation of gear 1110. The rotation of gear 1112 causes rotation of shaft 608 and thus rotation of counterweight 1116.

As viewed from the left in FIG. 39, counterweight 1114 rotates clockwise (arrow 1118) and counterweight 1116 rotates counterclockwise (arrow 1120). Counterweights 1114 and 1116 are mounted 180 degrees out of phase such that when counterweight 1114 is above shaft 408, counterweight 1116 is below shaft 608. A quarter turn results in both counterweights 1114, 1116 being to the right of their respective shafts (see FIG. 40). After another quarter turn, counterweight 1114 is below shaft 408 and counterweight 1116 is above shaft 608. Another quarter turn and both counterweights are to the left of their respective shafts.

Figure 40:
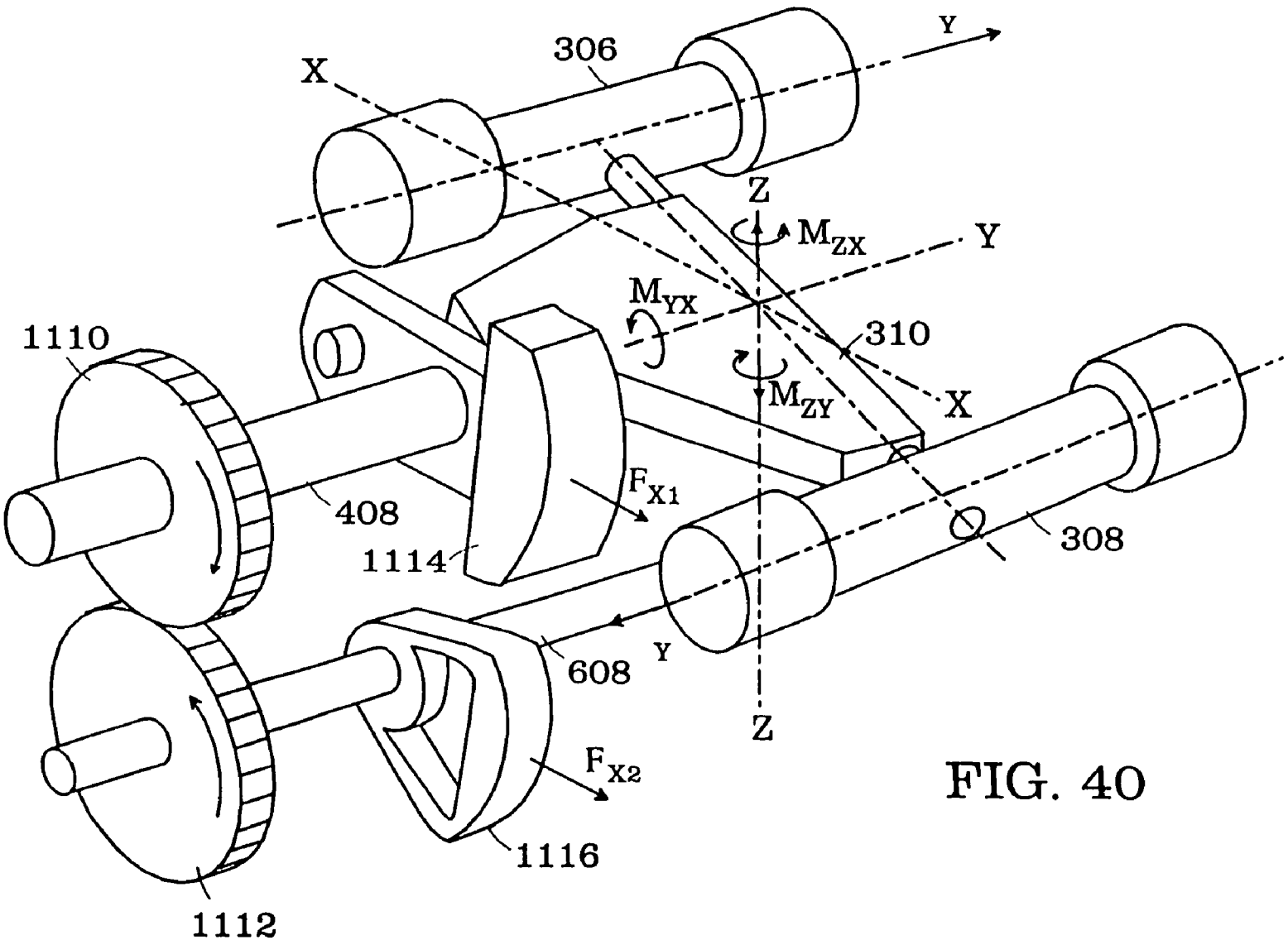
FIG. 40 is a perspective view of the piston engine assembly of FIG. 39 in a second position.

Referring to FIG. 40, movement of pistons 306, 308 along the Y axis, in the plane of the XY axes, creates a moment about the Z axis, $M_{zy}$. When counterweights 1114, 1116 are positioned as shown in FIG. 40, the centrifugal forces due to their rotation creates forces, $F_{x1}$ and $F_{x2}$, respectively, parallel to the X axis. These forces act together to create a moment about the Z axis, $M_{zx}$. The weight of counterweights 1114, 1116 is selected such that $M_{zx}$ substantially cancels $M_{zy}$.

When pistons 306, 308 are centered on the X axis (FIG. 39) there are no forces acting on pistons 306, 308, and thus no moment about the Z axis. In this position, counterweights 1114, 1116 are in opposite positions as shown in FIG. 39 and the moments created about the X axis by the centrifugal forces on the counterweights cancel. The same is true after 180 degrees of rotation of shafts 408 and 608, when the pistons are again centered on the X axis and the counterweight 1114 is below shaft 408 and counterweight 1116 is above shaft 608.

Between the quarter positions, the moments about the X axis due to rotation of counterweights 1114 and 1116 cancel, and the moments about the Z axis due to rotation of counterweights 1114 and 1116 add.

Counterweight 1114 also accounts for moments produced by drive arm 320.

In other piston configurations, for example where pistons 306, 308 do not lie on a common plane or where there are more than two pistons, counterweight 1116 is not necessary because at no time is there no moment about the Z axis requiring the moment created by counterweight 1114 to be cancelled.

Figure 41:
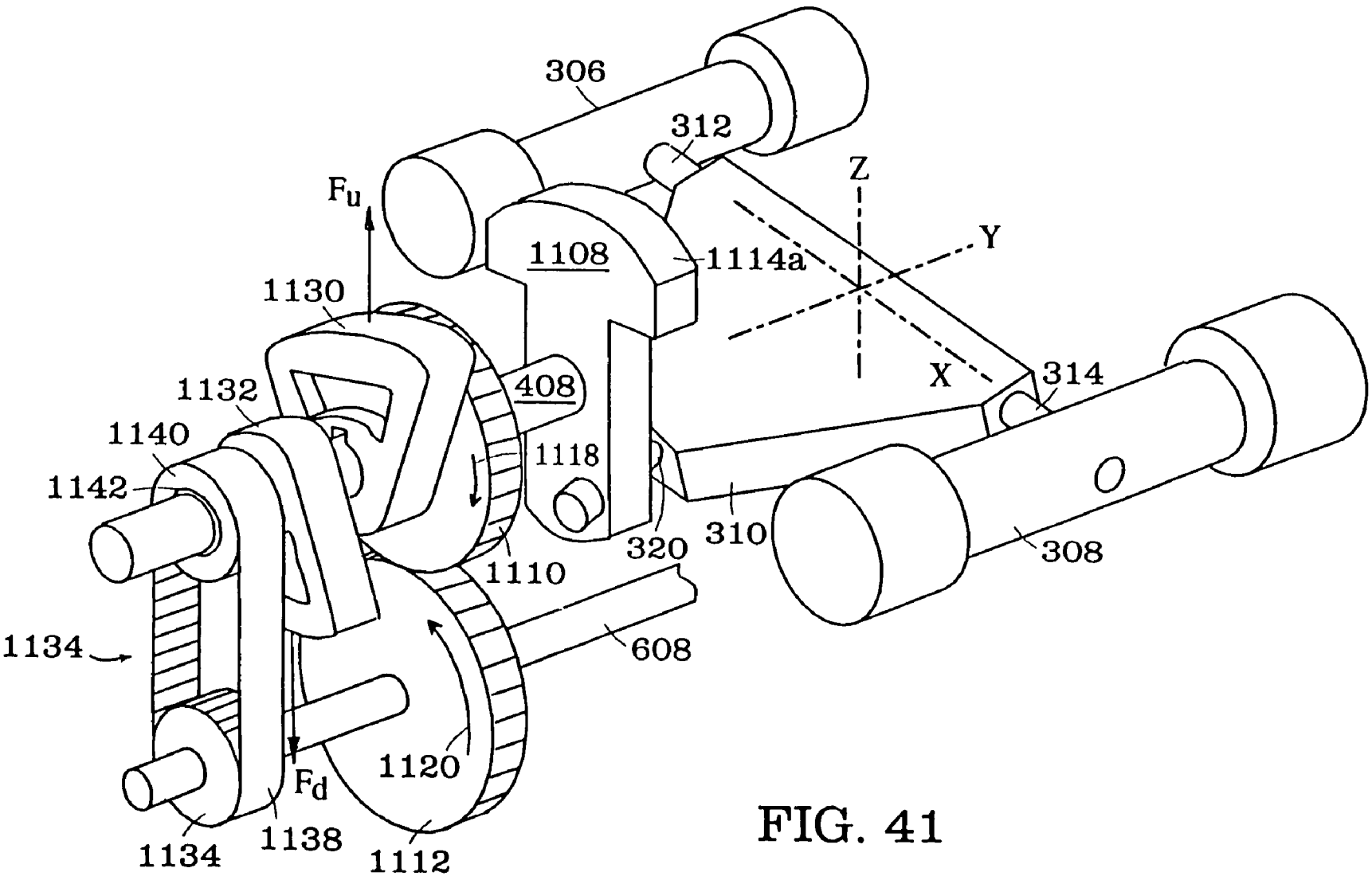
FIG. 41 is a perspective view of an alternative embodiment of a piston engine assembly including counterbalancing.

One moment not accounted for in the counterbalancing technique of FIGS. 39 and 40 a moment about axis Y, $M_{yx}$, produced by rotation of counterweight 1116. Another embodiment of a counterbalancing technique which accounts for all moments is shown in FIG. 41. Here, a counterweight 1114*a* mounted to rotating member 1108 is sized to only balance transition arm 310. Counterweights 1130, 1132 are provided to counterbalance the inertial forces of double-ended pistons 306, 308.

Counterweight 1130 is mounted to gear 1110 to rotate clockwise with gear 1110. Counterweight 1132 is driven through a pulley system 1134 to rotate counterclockwise. Pulley system 1134 includes a pulley 1136 mounted to rotate with shaft 608, and a chain or timing belt 1138. Counterweight 1132 is mounted to shaft 408 by a pulley 1140 and bearing 1142. Counterclockwise rotation of pulley 1136 causes counterclockwise rotation of chain or belt 1138 and counterclockwise rotation of counterweight 1132.

Figure 42:
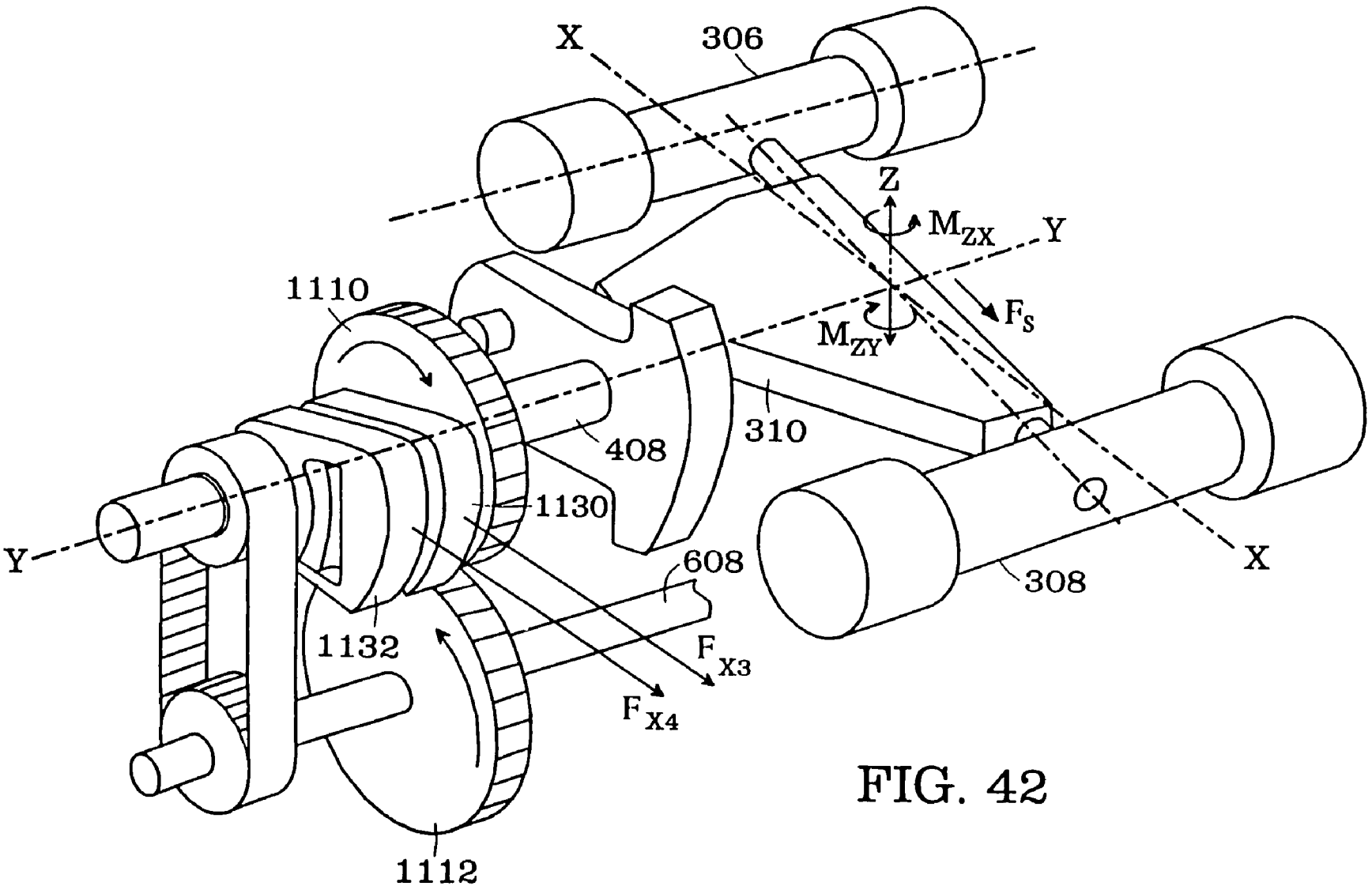
FIG. 42 is a perspective view of the piston engine assembly of FIG. 41 in a second position.

Referring to FIG. 42, as discussed above, movement of pistons 306, 308 along the Y axis, in the plane of the XY axes, creates a moment about the Z axis, $M_{zy}$. When counterweights 1130, 1132 are positioned as shown in FIG. 42, the centrifugal forces due to their rotation creates forces, $F_{x3}$ and $F_{x4}$, respectively, in the same direction along the X axis. These forces act together to create a moment about the Z axis, $M_{zx}$. The weight of counterweights 1130, 1132 is selected such that $M_{zx}$ substantially cancels $M_{zy}$.

When pistons 306, 308 are centered on the X axis (FIG. 41) there are no forces acting on pistons 306, 308, and thus no moment about the Z axis. In this position, counterweights 1130, 1132 are in opposite positions as shown in FIG. 41 and the moments created about the X axis by the centrifugal forces on the counterweights cancel. The same is true after 180 degrees of rotation of shafts 408 and 608, when the pistons are again centered on the X axis and the counterweight 1130 is below shaft 408 and counterweight 1132 is above shaft 408.

Between the quarter positions, the moments about the X axis due to rotation of counterweights 1130 and 1132 cancel, and the moments about the Z axis due to rotation of counterweights 1130 and 1132 add. Since counterweights 1130 and 1132 both rotate about the Y axis, there is no moment $M_{yx}$ created about axis Y.

Counterweights 1130, 1132 are positioned close together along the Y axis to provide near equal moments about the Z axis. The weights of counterweights 1130, 1132 can be slightly different to account for their varying location along the Y axis so that each counterweight generates the same moment about the center of gravity of the engine.

Counterweights 1130, 1132, in addition to providing the desired moments about the Z axis, create undesirable lateral forces directed perpendicular to the Y-axis (in the direction of the X axis), which act on the U-joint or other mount supporting transition arm 310. When counterweights 1130, 1132 are positioned as shown in FIG. 41, this does not occur because the upward force, $F_u$, and the downward force, $F_d$, cancel. But, when counterweights 1130, 1132 are positioned other than as shown in FIG. 41 or 180° from that position, this force is applied to the mount. For example, as shown in FIG. 42, forces $F_{x3}$ and $F_{x4}$ create a side force, $F_s$, along the X axis. One technique of incorporating counterbalances which provide the desired moments about the Z axis without creating the undesirable forces on the mount is shown in FIG. 43.

Figure 43:
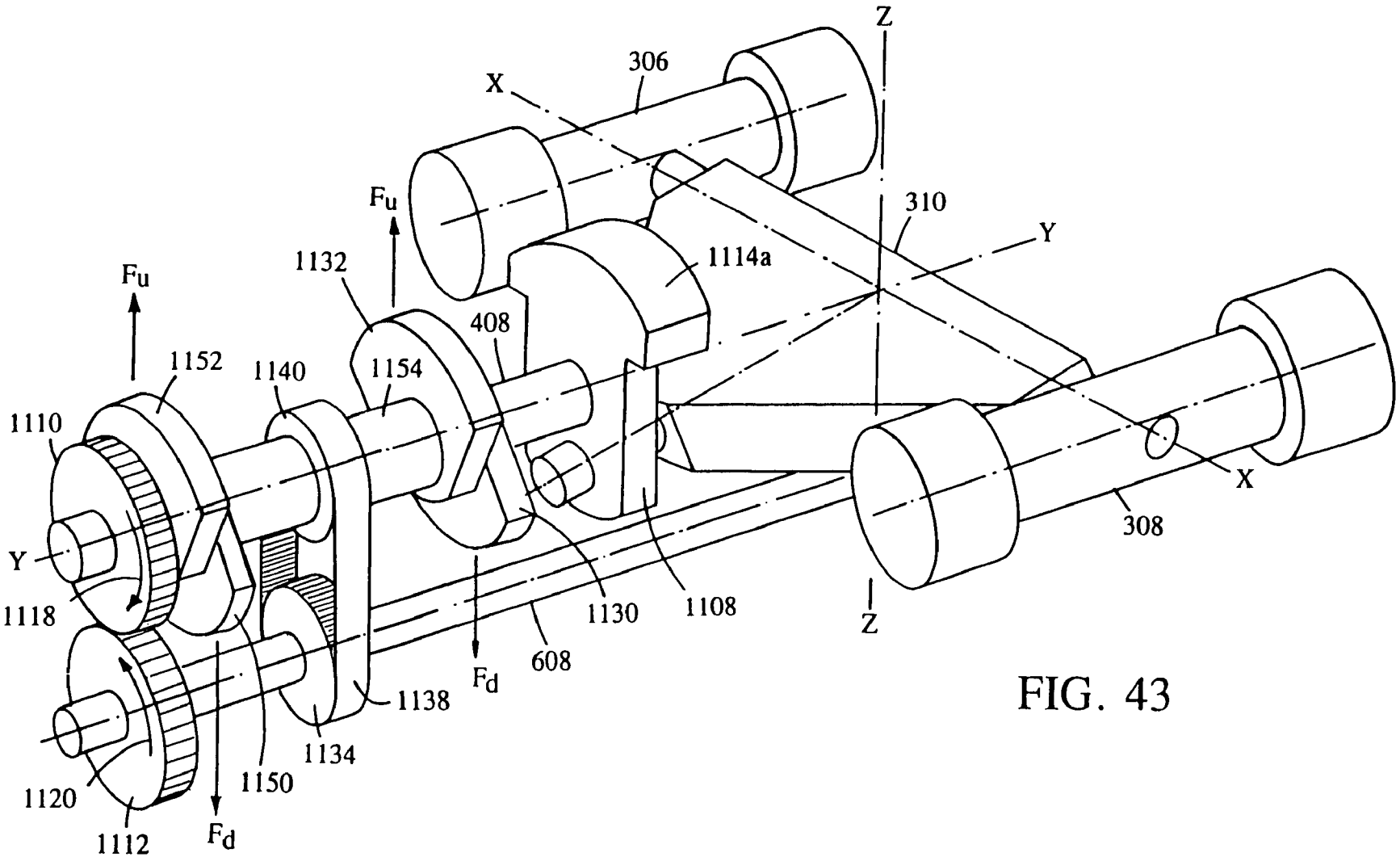
FIG. 43 is a perspective view of an additional alternative embodiment of a piston engine assembly including counterbalancing.

Referring to FIG. 43, a second pair of counterweights 1150, 1152 are provided. Counterweights 1130 and 1152 are mounted to shaft 408 to rotate clockwise with shaft 408. Counterweights 1132 and 1150 are mounted to a cylinder 1154 surrounding shaft 408 which is driven through pulley system 1134 to rotate counterclockwise. Counterweights 1130, 1152 extend from opposite sides of shaft 408 (counterweight 1130 being directed downward in FIG. 43, and counterweight 1152 being directed upward), and counterweights 1132, 1150 extend from opposite sides of cylinder 1154 (counterweight 1132 being directed upward, and counterweight 1150 being directed downward). Counterweights 1130, 1150 are aligned on the same side of shaft 408, and counterweights 1132, 1152 are aligned on the opposite side of shaft 408.

Figure 44:
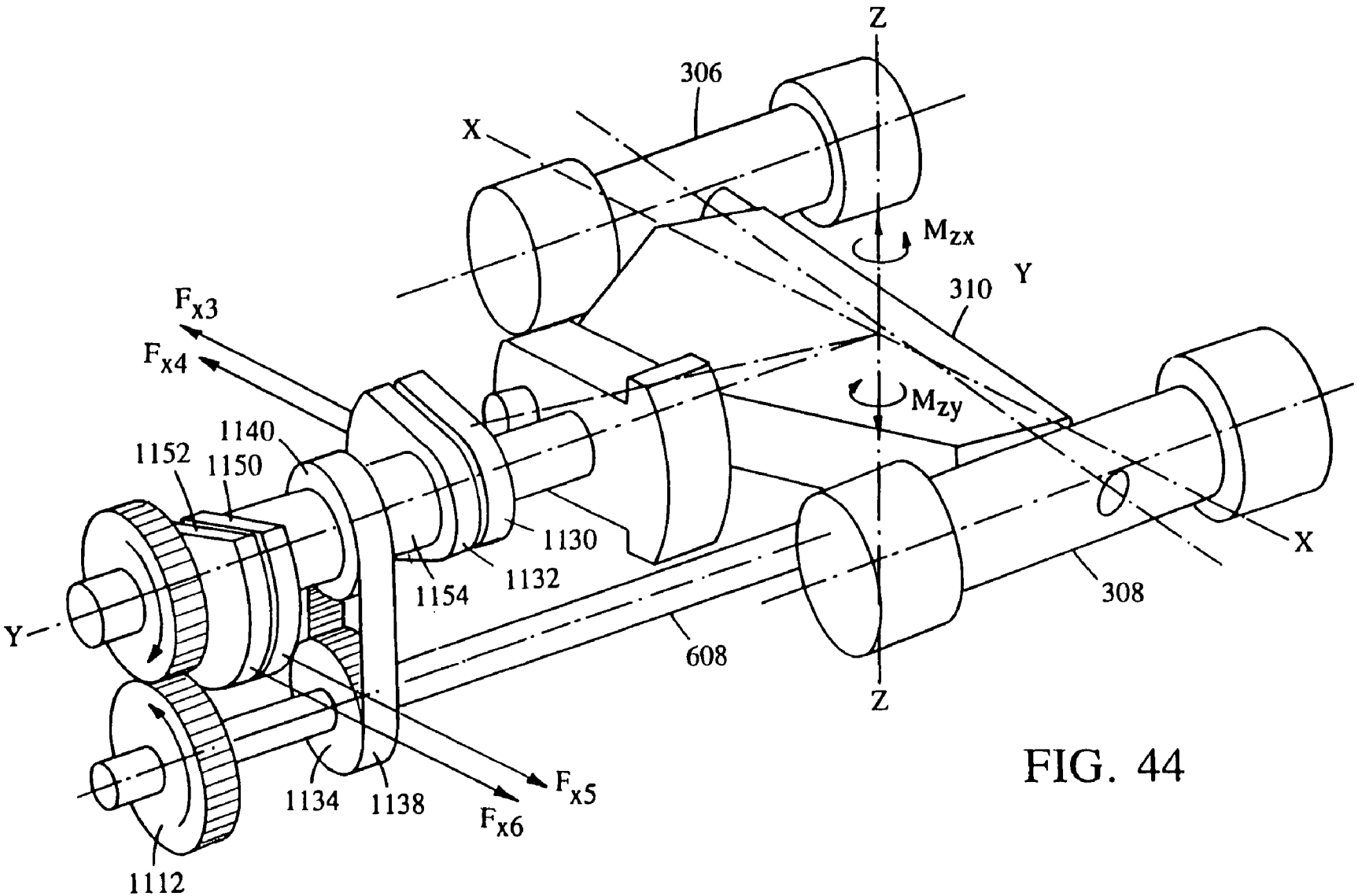
FIG. 44 is a perspective view of the piston engine assembly of FIG. 43 in a second position.

Referring to FIG. 44, with counterweights 1130, 1132, 1150, 1152 positioned as shown, the centrifugal forces due to the rotation of counterweights 1130, 1132 creates forces, $F_{x3}$ and $F_{x4}$, respectively, in the same direction in the X axis, and the centrifugal forces due to the rotation of counterweights 1150, 1152 creates forces, $F_{x5}$ and $F_{x6}$, respectively, in the opposite direction in the X axis. Since $F_{x3}$ and $F_{x4}$ are equal and opposite to $F_{x5}$ and $F_{x6}$, these forces cancel such that no undesirable lateral forces are applied to the transition arm mount.

In addition, as discussed above, movement of pistons 306, 308 in the direction of the Y axis, in the plane of the XY axes, creates a moment about the Z axis, $M_{zy}$. Since counterweights 1130, 1132, 1150, 1152 are substantially the same weight, and counterweights 1150, 1152 are located further from the Z axis than counterweights 1130, 1132, the moment created by counterweights 1150, 1152 is larger than the moment created by counterweights 1130, 1132 such that these forces act together to create a moment about the Z axis, $M_{zx}$, which acts in the opposite direction to $M_{zy}$. The weight of counterweights 1130, 1132, 1150, 1152 is selected such that $M_{zx}$ substantially cancels $M_{zy}$.

When pistons 306, 308 are centered on the X axis (FIG. 43), there is no moment about the Z axis. In this position, counterweights 1130, 1132 are oppositely directed and counterweights 1150, 1152 are oppositely directed such that the moments created about the X axis by the centrifugal forces on the counterweights cancel. Likewise, the forces created perpendicular to the Y axis, $F_u$ and $F_d$, cancel. The same is true after 180 degrees of rotation of shafts 408 and 608, when the pistons are again centered on the X axis.

Counterweight 1130 can be incorporated into flywheel 1108, thus eliminating one of the counterweights.

Figure 45:
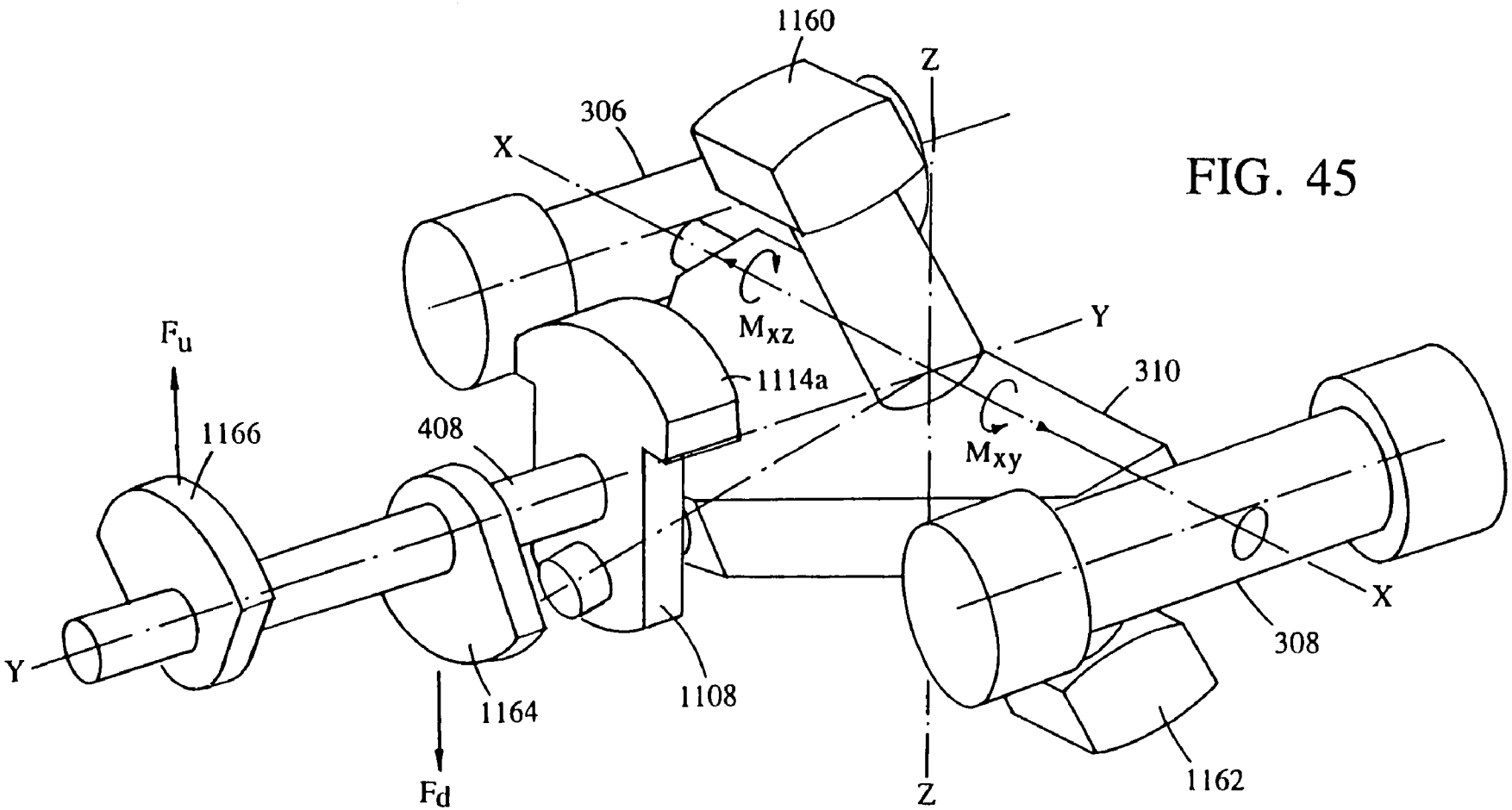
FIG. 45 is a perspective view of an additional alternative embodiment of a piston engine assembly including counterbalancing.

Referring to FIG. 45, another configuration for balancing a piston engine having two double ended pistons 306, 308 180° apart around the Y axis includes two members 1160, 1162, which each simulate a double ended piston, and two counterweights 1164, 1166. Members 1160, 1162 are 180° apart and equally spaced between pistons 306, 308. Counterweights 1164, 1166 extend from opposite sides of shaft 408, with counterweight 1166 being spaced further from the Z axis than counterweight 1164. Here again, counterweight 1114*a* mounted to rotating member 1108 is sized to only balance transition arm 310.

Movement of members 1160, 1162 along the Y axis, in the plane of the YZ axis, creates a moment about the X axis, $M_{xy}$. When counterweights 1164, 1166 are positioned as shown in FIG. 45, the centrifugal forces due to the rotation of counterweights 1164, 1166 creates forces, $F_u$ and $F_d$, respectively, in opposite directions along the Z axis. Since counterweight 1166 is located further from the Z axis than counterweight 1164, the moment created by counterweight 1166 is larger than the moment created by counterweight 1164 such that these forces act together to create a moment about the X axis, $M_{xz}$, which acts in the opposite direction to $M_{xy}$. The weight of counterweights 1164, 1166 is selected such that $M_{xz}$ substantially cancels $M_{xy}$.

In addition, since the forces, $F_u$ and $F_d$, are oppositely directed, these forces cancel such that no undesirable lateral forces are applied to the transition arm mount.

Figure 46:
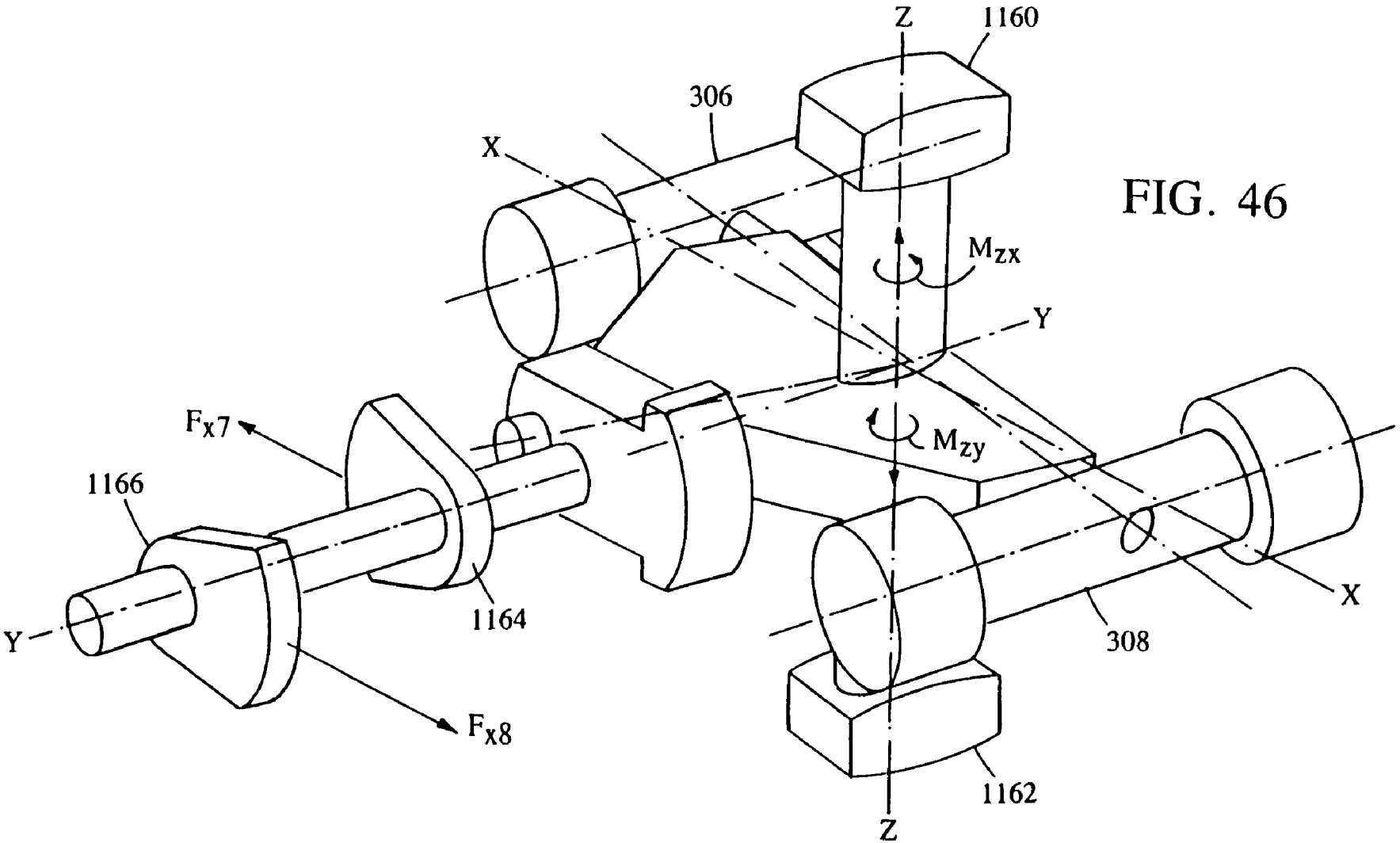
FIG. 46 is a perspective view of the piston engine assembly of FIG. 43 in a second position.

Referring to FIG. 46, movement of pistons 306, 308 along the Y axis, in the plane of the XY axes, creates a moment about the Z axis, $M_{zy}$. When counterweights 1164, 1166 are positioned as shown in FIG. 45, the centrifugal forces due to the rotation of counterweights 1164, 1166 creates forces, $F_{x7}$ and $F_{x8}$, respectively, in opposite directions along the X axis. These forces act together to create a moment about the Z axis, $M_{zx}$, which acts in the opposite direction to $M_{zy}$. The weight of counterweights 1164, 1166 is selected such that $M_{zx}$ substantially cancels $M_{zy}$.

In addition, since the forces perpendicular to Y axis, $F_{x7}$ and $F_{x8}$, are oppositely directed, these forces cancel such that no undesirable lateral forces are applied to the transition arm mount.

Counterweight 1164 can be incorporated into flywheel 1108 thus eliminating one of the counterweights.

The piston engine can include any number of pistons and simulated piston counterweights to provide the desired balancing, e.g., a three piston engine can be formed by replacing one of the simulated piston counterweights in FIG. 43 with a piston, and a two piston engine can be formed with two pistons and one simulated piston counterweight equally spaced about the transition arm.

If the compression ratio of the pistons is changed, the position of the counterweights along shaft 408 is adjusted to compensate for the resulting change in moments.

Figure 47:
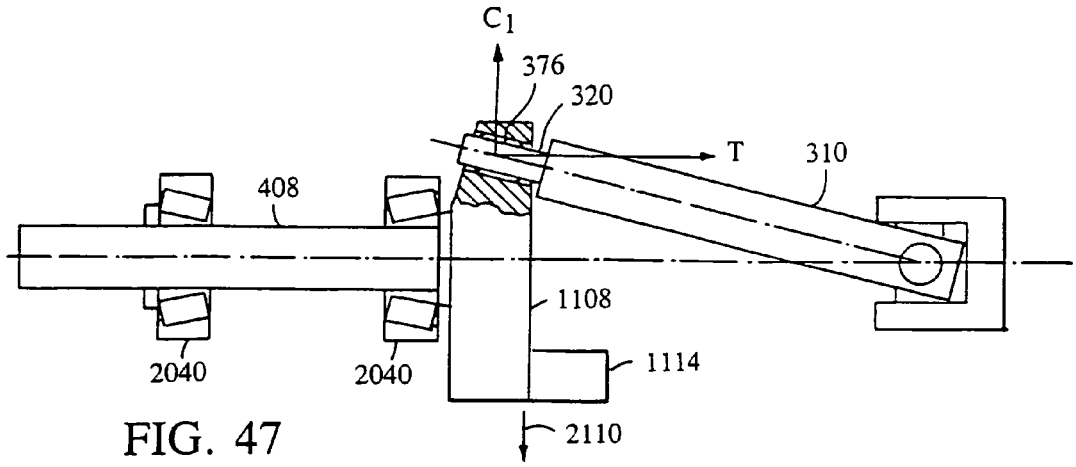
FIG. 47 is a side view showing the coupling of a transition arm to a flywheel.

Another undesirable force that can be advantageously reduced or eliminated is a thrust load applied by transition arm 310 to flywheel 1108 that is generated by the circular travel of transition arm 310. Referring to FIG. 47, the circular travel of transition arm 310 generates a centrifugal force, $C_1$, which is transmitted through nose pin 320 and sleeve bearing 376 to flywheel 108. Although counterweight 1114 produces a centrifugal force in the direction of arrow 2010 which balances force $C_1$, at the 15° angle of nose pin 320, a lateral thrust, T, of 26% of the centrifugal force, $C_1$, is also produced. The thrust can be controlled by placing thrust bearings or tapered roller bearings 2040 on shaft 408.

Figure 48:
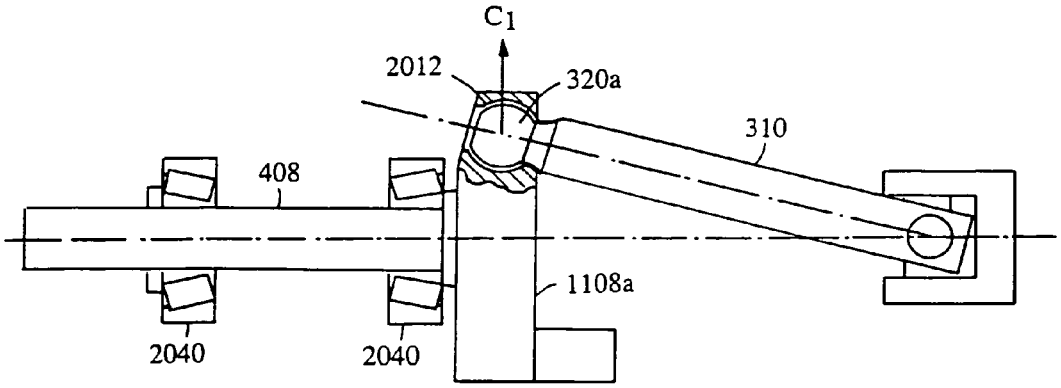
FIG. 48 is a side view of an alternative coupling of the transition arm to the flywheel.

To reduce the load on bearings 2040, and thus increase the life of the bearings, as shown in FIG. 48, nose pin 320*a* is spherically shaped with flywheel 1108*a* defining a spherical opening 2012 for receiving the spherical nose pin 320*a*. Because of the spherical shapes, no lateral thrust is produced by the centrifugal force, $C_1$.

Figure 49:
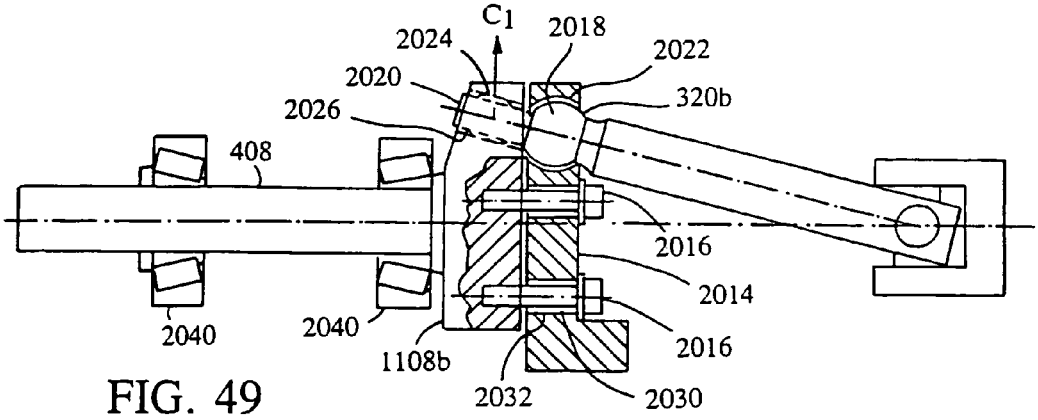
FIG. 49 is a side view of an additional alternative coupling of the transition arm to the flywheel.

FIG. 49 shows another method of preventing the application of a thrust load to the transition arm. Here, a counterbalance element 2014, rather than being an integral component of the flywheel 1108*b*, is attached to the flywheel by bolts 2016. The nose pin 320*b* includes a spherical portion 2018 and a cylindrical portion 2020. Counterbalance element 2014 defines a spherical opening 2022 for receiving spherical portion 2018 of nose pin 320*b*. Cylindrical portion 2020 of nose pin 320*b* is received within a sleeve bearing 2024 in a cylindrical opening 2026 defined by flywheel 1108*b*. Because of the spherical shapes, no lateral thrust is produced by the centrifugal force, $C_1$.

Counterbalance element 2014 is not rigidly held to flywheel 1108*b* so that there is no restraint to the full force of the counterweight being applied to the spherical joint to cancel the centrifugal force created by the circular travel of transition arm 310. For example, a clearance space 2030 is provided in the screw holes 2032 defined in counterbalance element 2014 for receiving bolts 2016.

One advantage of this embodiment over that of FIG. 48 is that the life expectancy of a cylindrical joint with a sleeve bearing coupling the transition arm to the flywheel is longer than that of the spherical joint of FIG. 48 coupling the transition arm to the flywheel.

Figure 50:
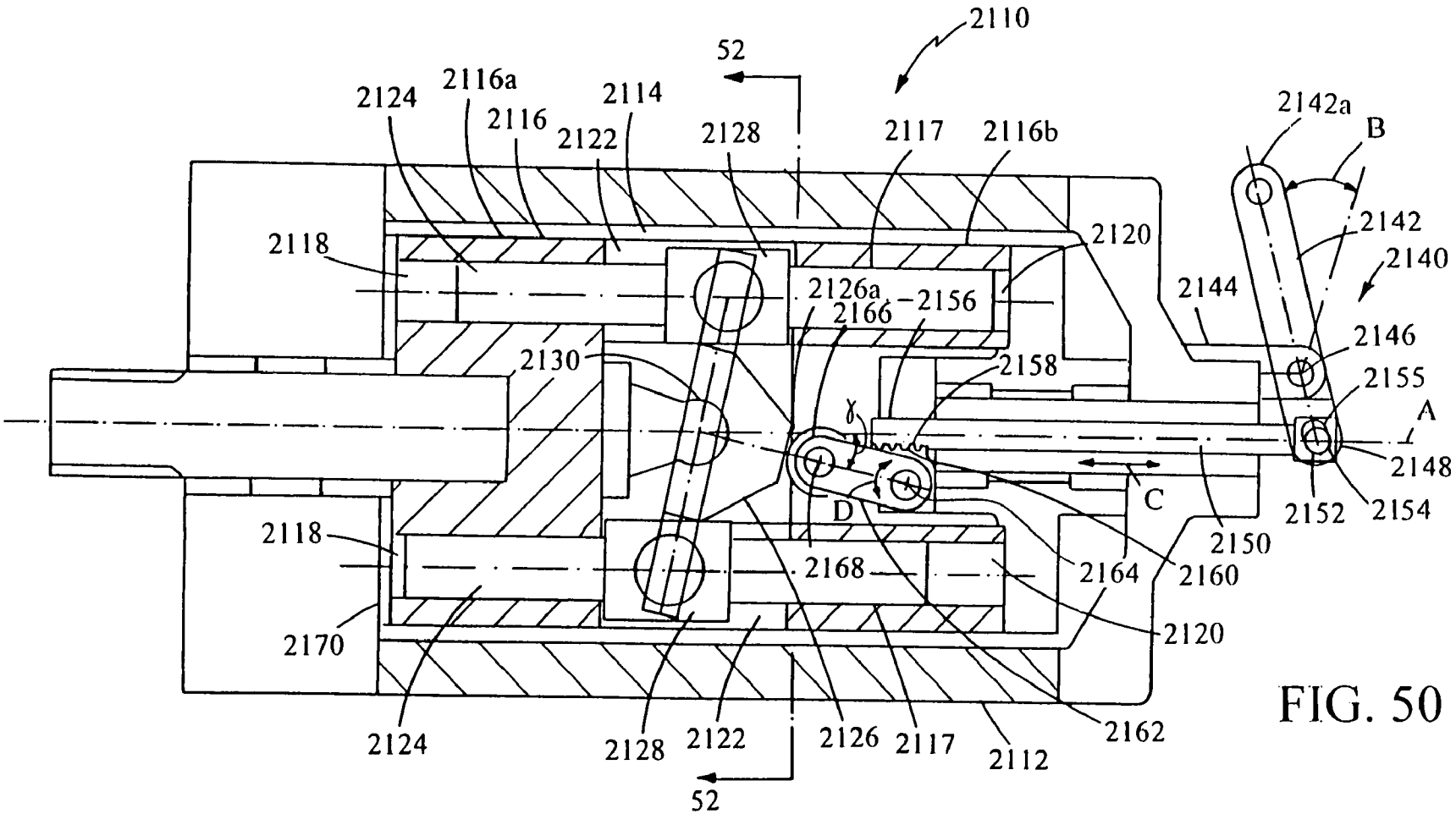
FIG. 50 is a cross-sectional side view of a hydraulic pump.

Referring to FIG. 50, a hydraulic pump 2110 includes a stationary housing 2112 defining a chamber 2114, and a rotating drum or cylinder 2116 located within chamber 2114. Cylinder 2116 includes first and second halves 2116*a*, 2116*b* defining a plurality of piston cavities 2117. Each cavity 2117 is formed by a pair of aligned channels 2118, 2120 joined by an enlarged region 2122 defined between cylinder halves 2116*a*, 2116*b*. Located within each cavity 2117 is a double ended piston 2124, here six pistons being shown, though fewer or more pistons can be employed depending upon the application. Each double ended piston is mounted to a transition arm 2126 by a joint 2128, as described above. Transition arm 2126 is supported on a universal joint 2130 mounted to cylinder 2116 such that pistons 2124 and transition arm 2126 rotate with cylinder 2116.

The angle, γ, of transition arm 2126 relative to longitudinal axis, A, of pump 2110 is adjustable to reduce or increase the output from pump 2110. Pump 2110 includes an adjustment mechanism 2140 for adjusting and setting angle, γ. Adjustment mechanism 2140 includes an arm 2142 mounted to a stationary support 2144 to pivot about a point 2146. An end 2148 of arm 2142 is coupled to a first end 2152 of a control rod 2150 by a pin 2154. Arm 2142 defines an elongated hole 2155 which receives pin 2154 and allows for radial movement of arm 2142 relative to control rod 2150 when arm 2142 is rotated about pivot point 2146. A second end 2156 of rod 2150 has laterally facing gear teeth 2158. Gear teeth 2158 mate with gear teeth 2160 on a link 2162 mounted to pivot about a point 2164. An end 2166 of link 2162 is coupled to transition arm 2126 at a pivot joint 2168. Transition arm nose pin 2126*a* is supported by a cylindrical pivot pin 370 (not shown) and sleeve bearing 376 (not shown), as described above with reference to FIGS. 25-25*b*, such that transition arm 2126 is free to rotate relative to adjustment mechanism 2140.

Angle, γ, is adjusted as follows. Arm 2142 is rotated about pivot point 2146 (arrow, B). This results in linear movement of rod 2150 (arrow, C). Because of the mating of gear teeth 2158 and 2160, the linear movement of rod 2150 causes link 2162 to rotate about pivot point 2164 (arrow, D), thus changing angle, γ. After the desired angle has been obtained, the angle is set by fixing arm 2142 using an actuator (not shown) connected to end 2142*a* of arm 2142.

Due to the fixed angle of transition arm 2126 (after adjustment to the desired angle), and the coupling of transition arm 2126 to pistons 2124, as the transition arm rotates, pistons 2124 reciprocate within cavities 2117. One rotation of cylinder 2116 causes each piston 2124 to complete one pump and one intake stroke.

Figure 51:
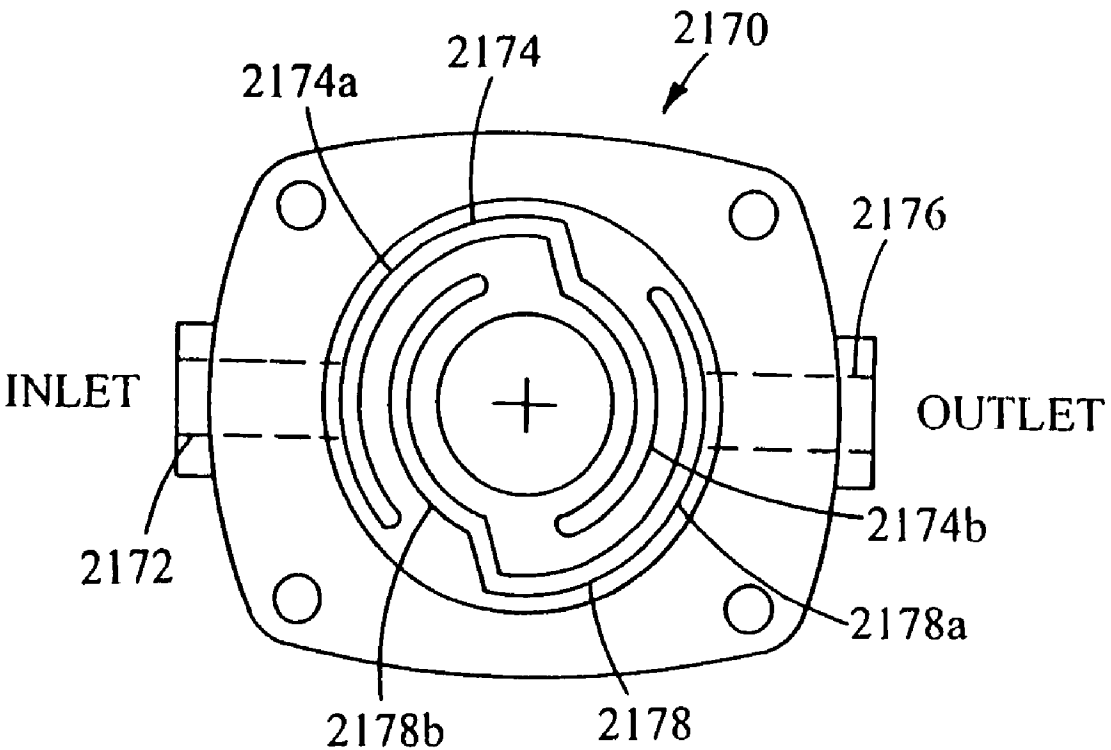
FIG. 51 is an end view of a face valve of the hydraulic pump of FIG. 50.

Referring also to FIG. 51, pump 2110 includes a face valve 2170 which controls the flow of fluid, e.g., pressurized hydraulic oil, in pump 2110. On the intake strokes, fluid is delivered to channels 2118 and 2120 through an inlet 2172 in face valve 2170. Inlet 2172 is in fluid communication with an inlet port 2174. Inlet port 2174 includes a first section 2174*a* that delivers fluid to channels 2120, and a second section 2174*b* that delivers fluid to channels 2118. First section 2174*a* is located radially outward of second section 2174*b*. On the pump strokes, fluid is expelled from channels 2118 and 2120 through an outlet 2176 in face valve 2170. Outlet 2176 is in fluid communication with an outlet port 2178. Outlet port 2178 includes a first section 2178*a* via which fluid expelled from channels 2120 is delivered to outlet 2176, and a second section 2178*b* via which fluid expelled from channels 2118 is delivered to outlet 2176. First section 2178*a* is located radially outward of second section 2178*b*.

Figure 52:
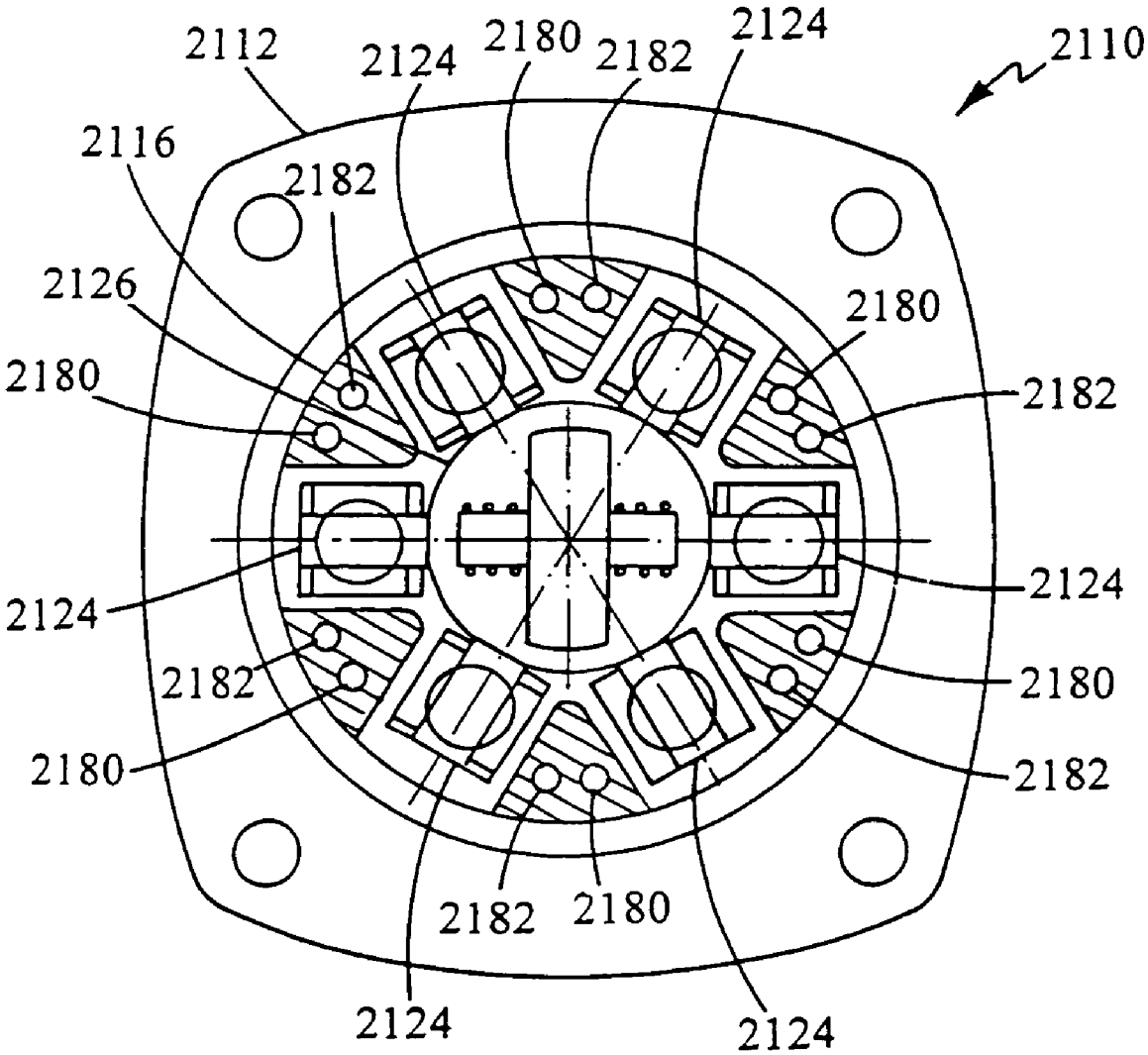
FIG. 52 is a cross-sectional view of the hydraulic pump of FIG. 30, taken along lines 52-52.

Referring also to FIG. 52, cylinder 2116 defines six flow channels 2180 through which fluid travels to and from channels 2120. Flow channels 2180 are radially aligned with port sections 2174*a* and 2178*b*; and channels 2118 are radially aligned with port sections 2174*b* and 2178*b*. When a first end 2124*a* of piston 2124 is on the intake stroke and a second end 2124*b* of piston 2124 is on the pump stroke, cylinder 2116 is rotationally aligned relative to stationary face valve 2170 such that the respective channel 2118 at first end 2124*a* of piston 2124 is aligned with inlet port section 2174*b*, and the respective flow channel 2180 leading to a respective channel 2120 at second end 2124*b* of piston 2124 is aligned with outlet port section 2178*a*.

Figure 53:
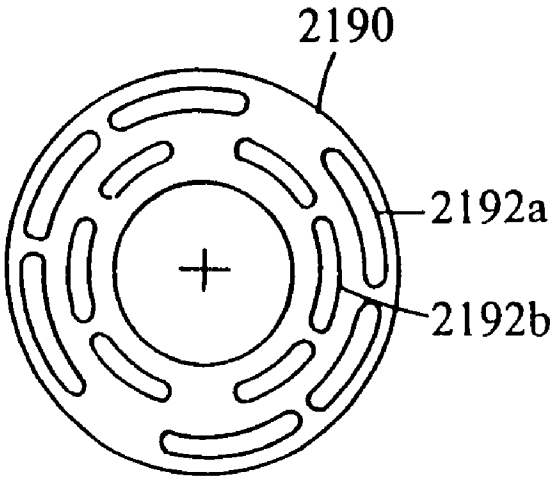
FIG. 53 is an end view of a face plate of the hydraulic pump of FIG. 50.

Cylinder 2116 further defines six holes 2182 for receiving connecting bolts (not shown) that hold the two halves 2116*a*, 2116*b* of cylinder 2116 together. Cylinder 2116 is biased toward face valve 2170 to maintain a valve seal by spring loading. Referring to FIG. 53, a face plate 2190 defining outer slots 2192*a* and inner slots 2192*b* is positioned between stationary face valve 2170 and rotating cylinder 2116 to act as a bearing surface. Outer slots 2192*a* are radially aligned with port sections 2174*a* and 2178*a*, and inner slots 21992*b* are radially aligned with port sections 2174*b* and 2178*b*.

Figure 54:
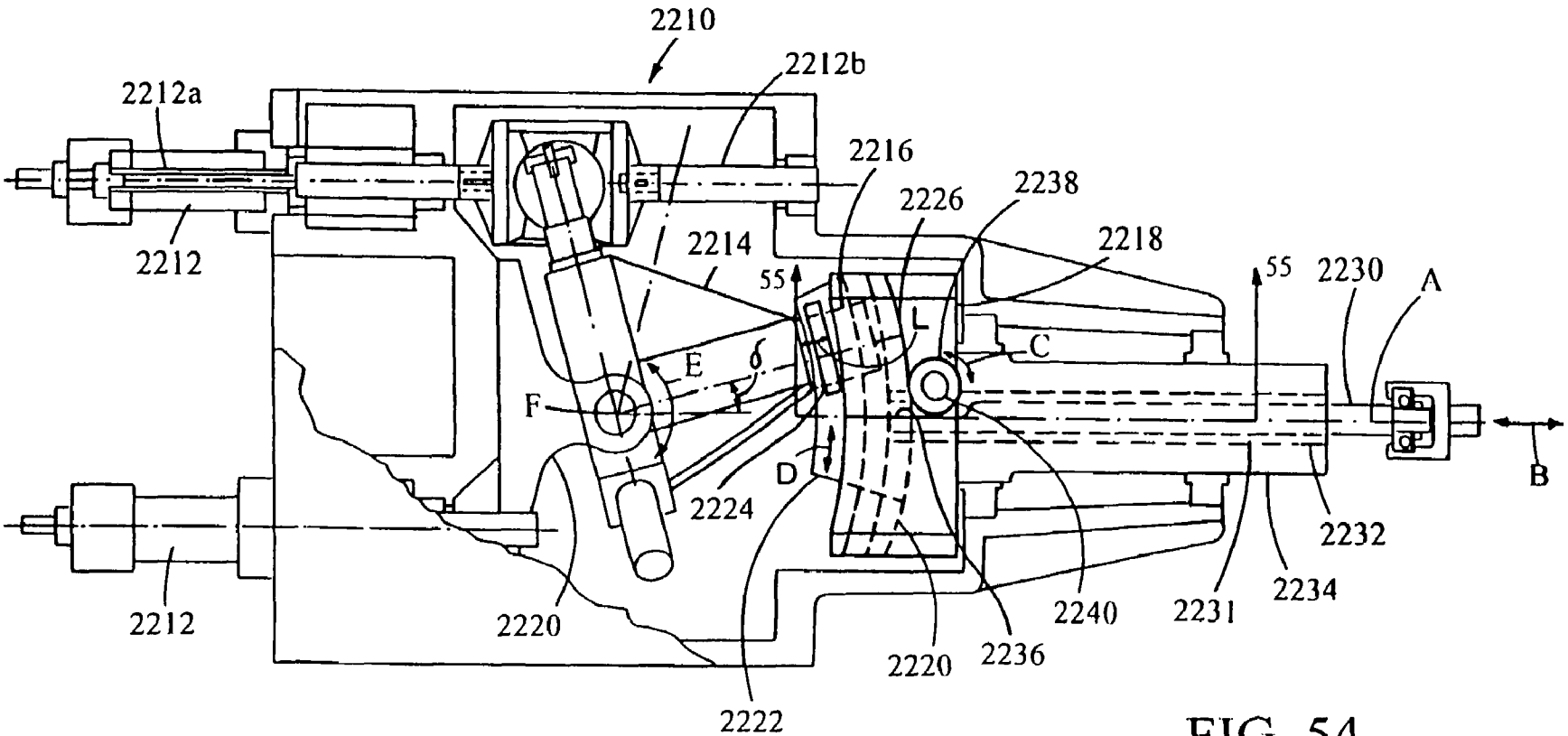
FIG. 54 is a partially cut-away side view of a variable compression piston assembly.

Referring to FIG. 54, a pump or compressor assembly 2210 for varying the stroke of pistons 2212, e.g., a pump with single ended pistons having a piston 2212*a* at one end and a guide rod 2212*b* at the opposite end, has the ability to vary the stroke of pistons 2212 down to zero stroke and the capability of handling torque loads as high as a fixed stroke mechanism. Assembly 2210 is shown with three pistons, though two or more pistons can be employed. Assembly 2210 includes a transition arm 2214 coupled to pistons 2212 by any of the methods described above. Transition arm 2214 includes a nose pin 2216 coupled to a rotatable flywheel 2218. The rotation of flywheel 2218 and the linear movement of pistons 2212 are coupled by transition arm 2214 as described above.

The stroke of pistons 2212, and thus the output volume of assembly 2210, is adjusted by changing the angle, δ, of nose pin 2216 relative to assembly axis, A. Angle, δ, is changed by rotating transition arm 2214, arrow, E, about axis, F, of support 2220, e.g., a universal joint. Flywheel 2218 defines an arced channel 2220 housing a bearing block 2222. Bearing block 2222 is slidable within channel 2220 to change the angle, δ, while the cantilever length, L, remains constant and preferably as short as possible for carrying high loads. Within bearing block 2222 is mounted a bearing 2224, e.g., a sleeve or rolling bearing, which receives nose pin 2216. Bearing block 2222 has a gear toothed surface 2226, for reasons described below.

Figure 55:
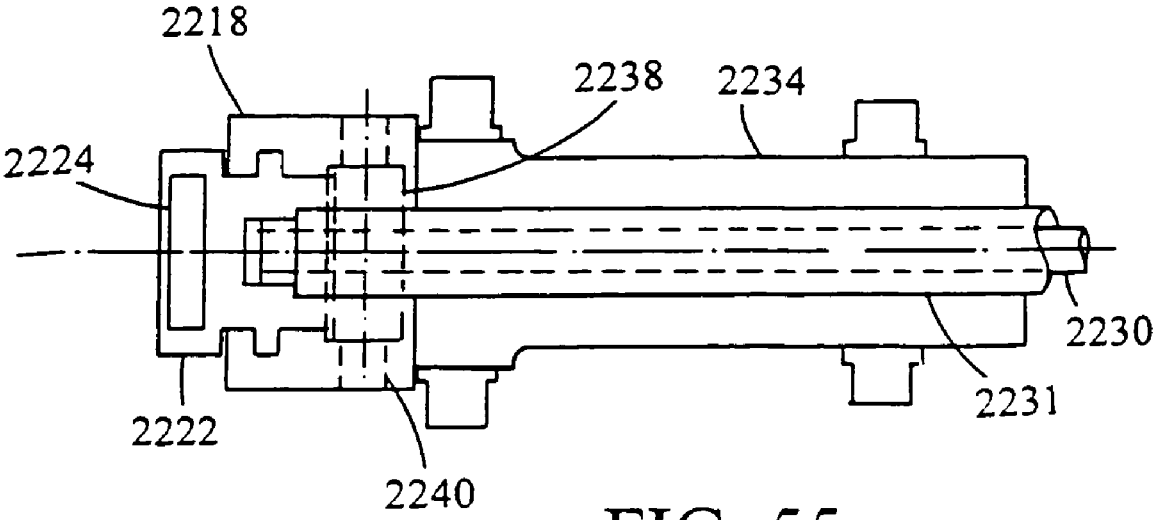
FIG. 55 is a cross-sectional side view of the piston assembly of FIG. 54, taken along lines 55-55.

Referring also to FIG. 55, to slide bearing block 2222 within channel 2220, a control rod 2230, which passes through and is guided by a guide bushing 2231 within cylindrical opening 2232 in main drive shaft 2234 and rotates with drive shaft 2234, includes a toothed surface 2236 which engages a pinion gear 2238. Pinion gear 2238 is coupled to gear toothed surface 2226 of bearing block 2222, and is mounted in bushings 2240. Axial movement of control rod 2230, in the direction of arrow, B, causes pinion gear 2238 to rotate, arrow, C. Rotation of pinion gear 2238 causes bearing block 2222 to slide in channel 2220, arrow D, circumferentially about a circle centered on U-joint axis, F, thus changing angle, δ. The stroke of pistons 2212 is thus adjusted while flywheel 2218 remains axially stationary (along the direction of arrow, B).

Figure 57:
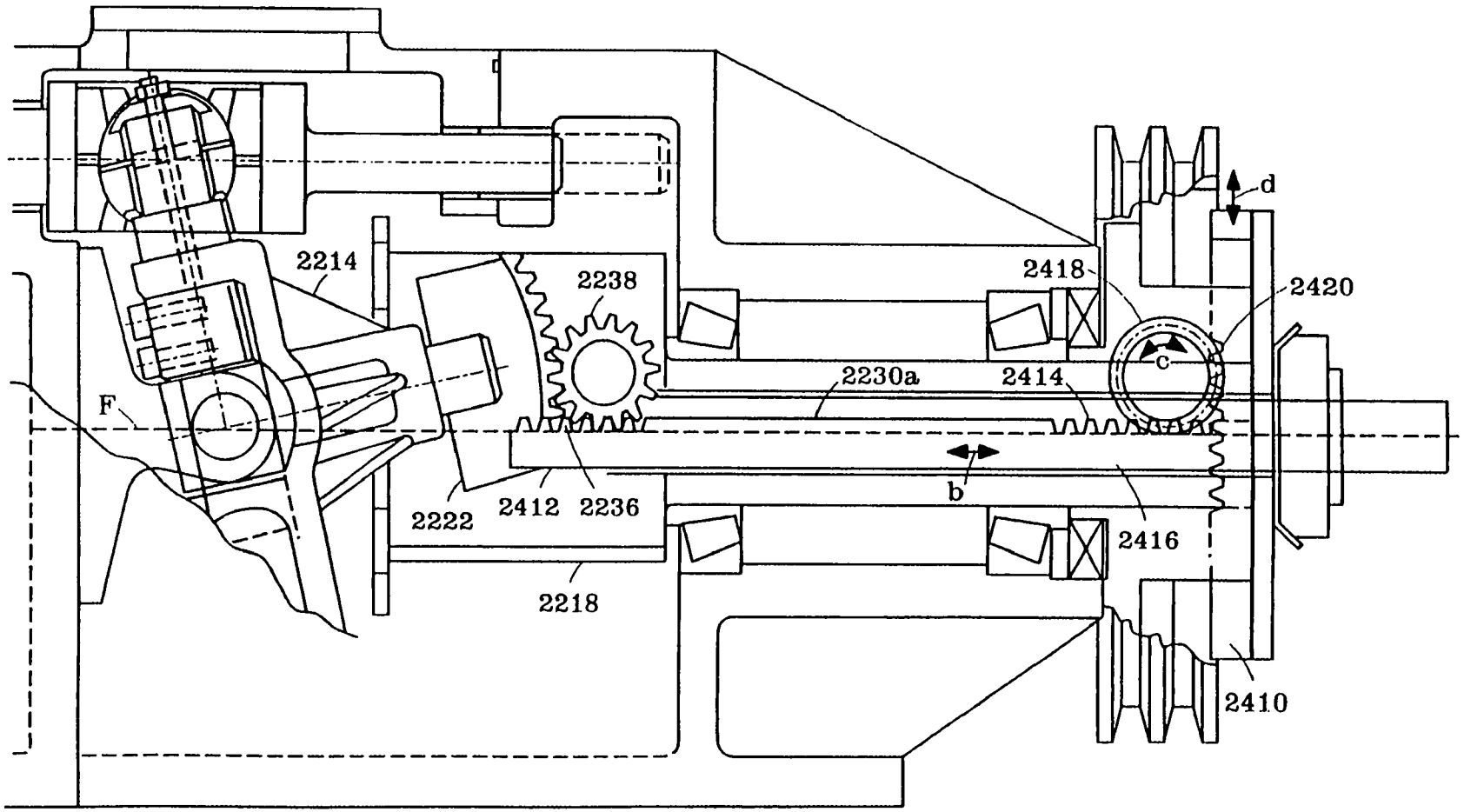
FIG. 57 illustrates the piston assembly of FIG. 54 with a balance member.

Referring to FIG. 57, to counterbalance the movement of transition arm 2214 and bearing block 2222, a movable balance member 2410 is coupled to a control rod 2230*a*. Control rod 2230*a* includes linear toothed surface 2236 in a first end region 2412 of the control rod (as in control rod 2230 of FIGS. 54 and 55), as well as a second linear toothed surface 2414 at an opposite end region 2416 of control rod 2230*a*. Toothed surface 2236 mates with bearing block 2222, as described above. Toothed surface 2414 mates with a gear 2418, and gear 2418 mates with a toothed surface 2420 of balance member 2410. Linear movement of control rod 2230*a*, arrow, b, thus causes gear 2418 to rotate, arrow, c, and balance member 2410 to translate, arrow, d. Flywheel 2218 and gears 2238 and 2418 are balanced as a unit about axis, F. Transition arm 2214 and balance member 2410 are both balanced about axis, F, when the pistons are at zero-stroke.

When control rod 2230*a* is moved to the right, as viewed in FIG. 57, gear 2238 rotates counter-clockwise, and bearing block 2222 moves downward along a slight arc, shortening the stroke of the pistons. Simultaneously, gear 2418 rotates counter-clockwise, and balance member 2410 moves upward in a substantially opposite direction to the direction of movement of bearing block 2222. While there is a slight variation in the movement of bearing block 2222 and balance member 2410 (bearing block 2222 undergoes radial motion while balance member 2410 undergoes linear motion), the balancing obtained significantly reduces potential vibration of the assembly.

Figure 58:
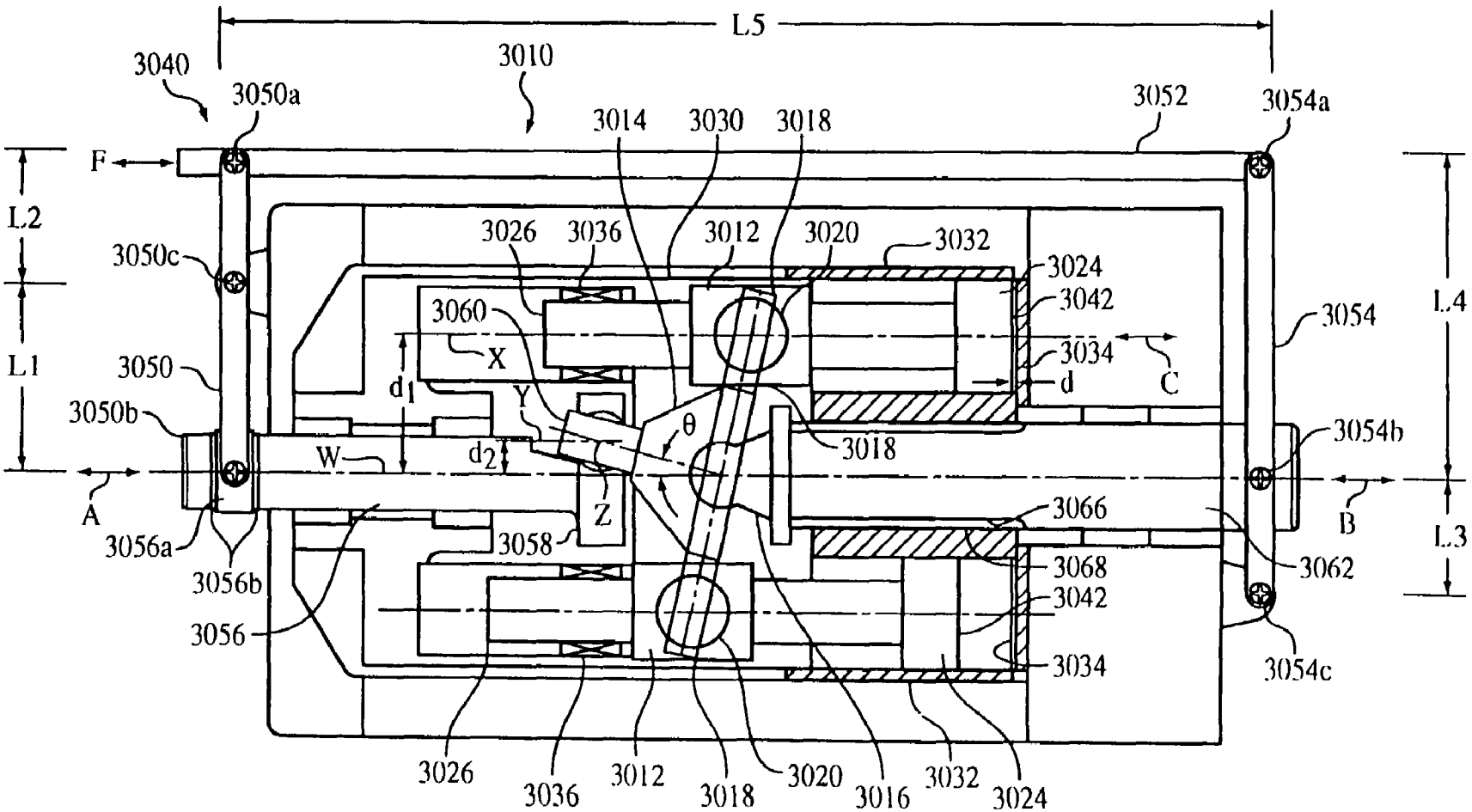
FIG. 58 is a partial cross-sectional view of a compressor with a linear stroke/clearance control mechanism.

Referring to FIG. 58, a dual capacity compressor 3010, for example, a gas refrigerant compressor, is shown that is particularly useful in applications in which compressor capacity is preferably varied to conserve energy, such as in home refrigerators. Compressor 3010 includes first and second piston assemblies 3012 mounted circumferentially about a transition arm 3014. Transition arm 3014 is mounted to a universal joint 3016, and drive pins 3018 couple transition arm 3014 to piston assemblies 3012 via piston joint assemblies 3020. The motion of transition arm 3014 causes linear motion of piston assemblies 3012, as described above.

Each piston assembly 3012 includes a piston 3024 and an opposed guide rod 3026. Compressor 3010 includes a case 3030 defining cylinders 3032 within which piston assemblies 3012 are mounted. Each cylinders 3032 has an end wall 3034. Guide rods 3026 each ride within a bearing 3036 positioned in a respective cylinder 3032.

Compressor 3010 includes a linear, stroke/clearance control mechanism 3040 that maintains the clearance distance, d, between an end face 3042 of piston 3024 and end wall 3034 at the top of the piston stroke substantially constant as the stroke of piston 3024 is changed. Mechanism 3040 includes a stroke control lever 3050, a link rod 3052, and a U-joint control lever 3054. Lever 3050 is connected to rod 3052 at a pivot joint 3050*a*, and lever 3054 is connected to rod 3052 at pivot joint 3054*a*. Stroke control lever 3050 is connected to a rotating stroke control arm 3056 by a bearing 3056*a* mounted between thrust washers 3056*b*, and a pivot joint 3050*b*. Lever 3050 is grounded to case 3030 by a pivot joint 3050*c*. U-joint control lever 3054 is connected to an arm 3062 to which U-joint 3016 is mounted by a pivot joint 3054*b*. Lever 3054 is grounded to case 3030 by a pivot joint 3054*c*. The length, L1, of lever 3050 between joints 3050*b* and 3050*c* is, for example, 2.5 inches; the length, L2, of lever 3050 between joints 3050*c* and 3050*a* is, for example, 2.5 inches; the length, L3, of lever 3054 between joints 3054*b* and 3054*c* is, for example, 1.5 inches; the length, L4, of lever 3054 between joints 3054*b* and 3054*a* is, for example, 3.5 inches; and the length, L5, of link rod 3052 between joints 3050*a* and 3054*a* is, for example, 16 inches.

Stroke control arm 3056 has a flywheel 3058 that slides relative to a nose pin 3060 of transition arm 3014. Arm 3062 includes a spline 3066 received within a slot 3068 in case 3030 to prevent rotation of arm 3062 and U-joint 3016 relative to case 3030. Moving the axial position of flywheel 3058, arrow, A, relative to nose pin 3060, changes the cone angle, θ, of transition arm 3014, and thus the stroke of piston assemblies 3012. Moving U-joint 3016, arrow, B, moves the axial position of piston assemblies 3012 within cylinders 3032, arrow, C, thus adjusting the top clearance volume, i.e., the distance, d, between piston end face 3042 and end wall 3034.

Mechanism 3040 thus couples the motion of the U-joint and the stroke control. The relationship between the two motions is linear or nearly so, since it is maintained by two levers 3050, 3054 and one pushrod 3052. The relationship is inverse and roughly four to one, so that four units of movement of the stroke arm 3056 correspond to one unit of movement of the U-joint arm 3062. The motion of U-joint 3016 equals the distance, $d_1$, between the central axis, W, and the piston axis, X, times the tangent of cone angle, θ. The motion of stroke arm 3056 is the distance, $d_2$, between central axis, W, and an axis, Y, parallel to axis, W, (defined by a center, Z, of nose pin 3060) divided by the tangent of cone angle, θ, plus the motion of U-joint 3016. In the example of FIG. 1, $d_1$ is 2 inches, and $d_2$ is 0.5 inches.

The piston stroke and top clearance are simultaneously adjusted by applying a force, F, to link rod 3052. When link rod 3052 is moved to the right, as viewed in FIG. 58, flywheel 3058 moves to the left by the action of stroke control lever 3050, decreasing angle, θ, and thus decreasing the piston stroke. If the position of U-joint 3016 were not also adjusted, the decrease in piston stroke would cause an increase in top clearance distance, d. However, when link rod 3052 is moved to the right, U-joint 3016 moves to the right by the action of U-joint control lever 3054, which moves piston end face 3042 closer to end wall 3034, thus maintaining top clearance distance, d, substantially constant.

Figure 59:
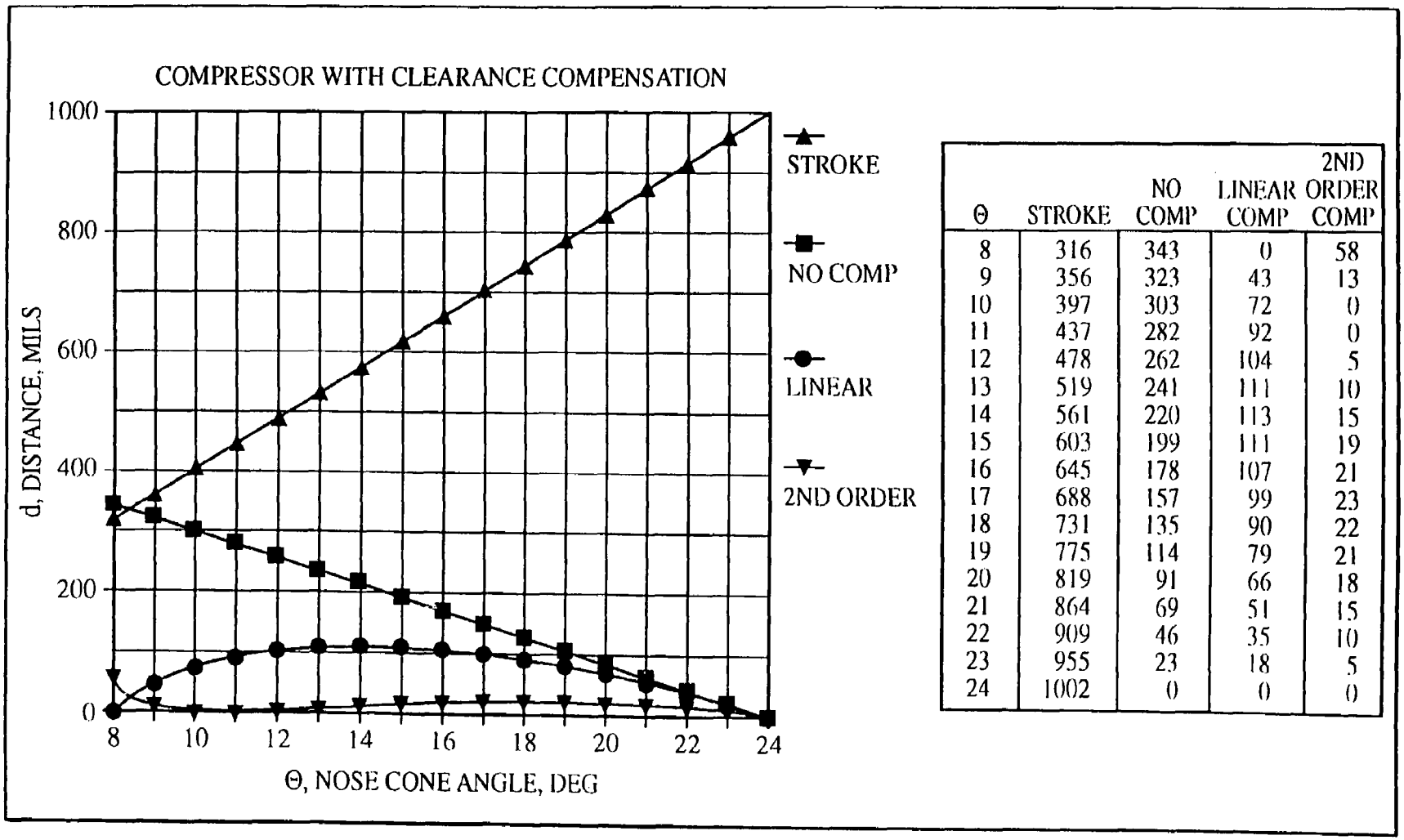
FIG. 59 is a graph showing the top dead center clearance as stroke is varied in the compressor of FIG. 58.

To obtain a pumping efficiency of close to 100%, it is desirable to have top clearance distance, d, as close to zero as possible without contacting piston end face 3042 against end wall 3034. For example, as shown in FIG. 59, for the linear compensation provided by mechanism 3040 of FIG. 58, as the cone angle, θ, increases from 8 to 24 degrees, the stroke increases, and the clearance distance, d, ranges between zero mils and 113 mils. The highest efficiency is seen at cone angles of 8 and 24 degrees where the clearance distance is essentially zero.

The ratio, K, of the axial motion of flywheel arm 3056 to the axial motion of U-joint 3016 can be adjusted to change the cone angle, and thus the stroke, at which the clearance distance is essentially zero. For example, in FIG. 58; the ratio, K, is −0.22. By changing the length of stroke control lever 3050, link rod 3052, or U-joint control lever 3054 the ratio, K, can be changed.

Figure 60:
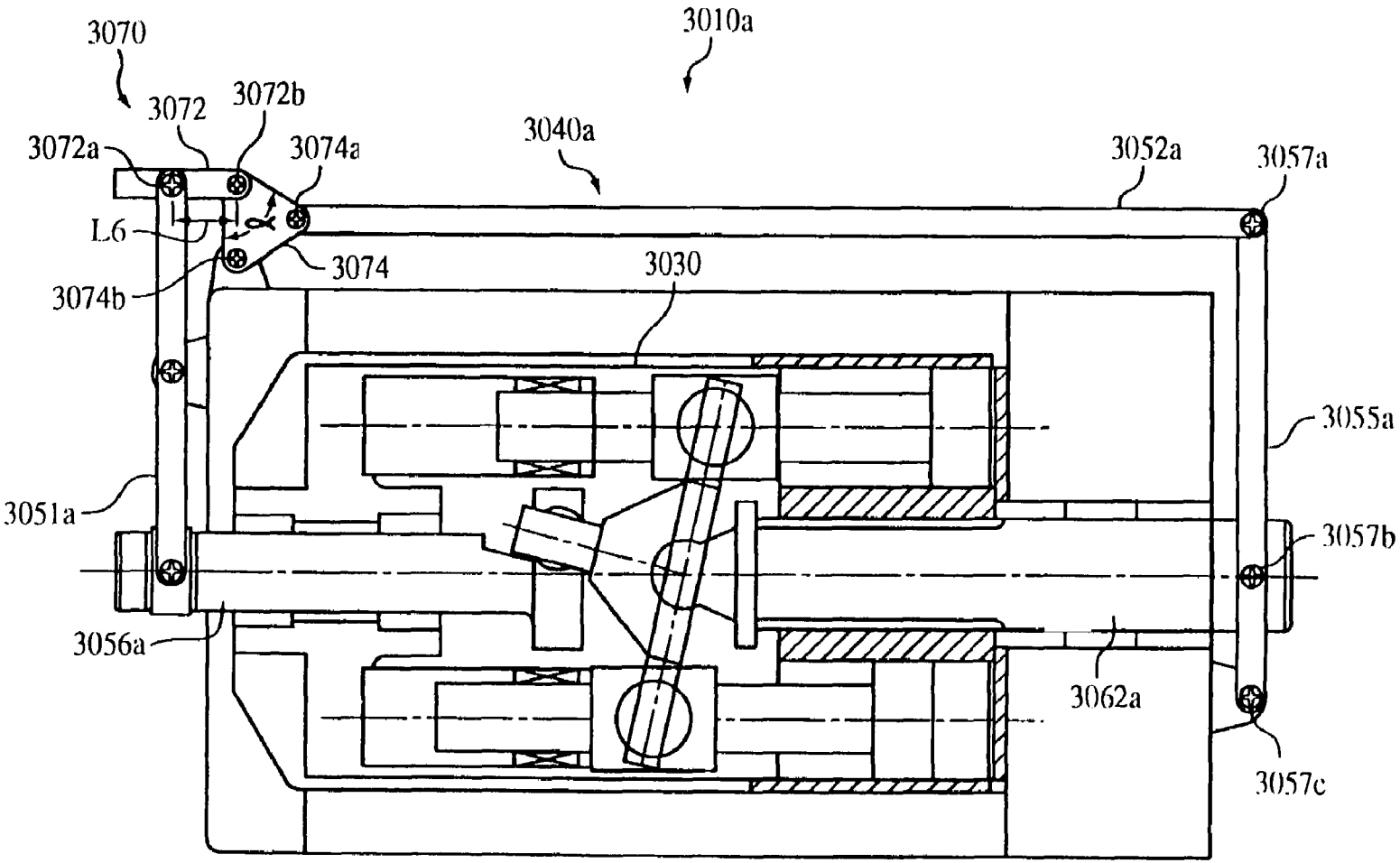
FIG. 60 is a partial cross-sectional view of a compressor with a non-linear stroke/clearance control mechanism.

The clearance distance obtained as the stroke of the pistons is adjusted can be further modified by incorporating second-order compensation. Referring to FIG. 60, a continuously variable capacity compressor 3010*a* includes a non-linear, stroke/clearance control mechanism 3040*a*. In mechanism 3040*a*, linkage rod 3052*a* is coupled to stroke control lever 3051*a* by a non-linear link 3070. Link 3070 includes a short link 3072 and a triangular grounded link 3074. Link 3072 is connected to stroke control lever 3051*a* by a pivot joint 3072*a*, and to link 3074 by a pivot joint 3072*b*. Link 3074 is connected to linkage rod 3052*a* by a pivot joint 3074*a*, and is grounded to case 3030 by a pivot joint 3074*b*. Lever 3055*a* is connected to rod 3052*a* at pivot joint 3057*a*. Stroke control lever 3051*a* is connected to a rotating stroke control arm 3056*a* and U-joint control lever 3055*a* is connected to an arm 3062*a* as described above with reference to FIG. 58. Links 3072 and 3074 create a second order term in the transfer function between stroke arm movement and U-joint movement. The transfer function can be modified by, for example, changing the length, $L_6$, of short link 3072 or the angle, $\alpha$, of triangular link 3074, to obtain a desired relationship.

The resulting curve for the non-linear mechanism of FIG. 60 is shown in FIG. 59. Zero clearance occurs at cone angles of 10.5 and 24 degrees, with a maximum clearance distance, d, of 23 mils occurring at a cone angle of 17 degrees. Thus, the clearance is maintained below 23 mils for a stroke range of 330 to 1000 mils, providing efficient operation over the entire stroke range. The ratio of clearance to stroke defines the efficiency, with a low ratio corresponding to high efficiency. For the non-linear mechanism, this ratio is less than 3% over the entire stroke range. FIG. 59 also includes a curve of the clearance, d, when no compensation mechanism is employed.

The ability to vary the capacity of the compressor using the mechanisms of FIGS. 58 and 60 allows the compressor to be started at minimum capacity and then be ramped up. This allows for a low starting torque. The non-linear mechanism also exhibits unloading at minimum stroke, as can be seen by the rise in clearance at 8 degrees and a stroke of 316 mils to 58 mils, thus limiting the gas compression forces and therefore the starting load placed on the motor.

Figure 61:
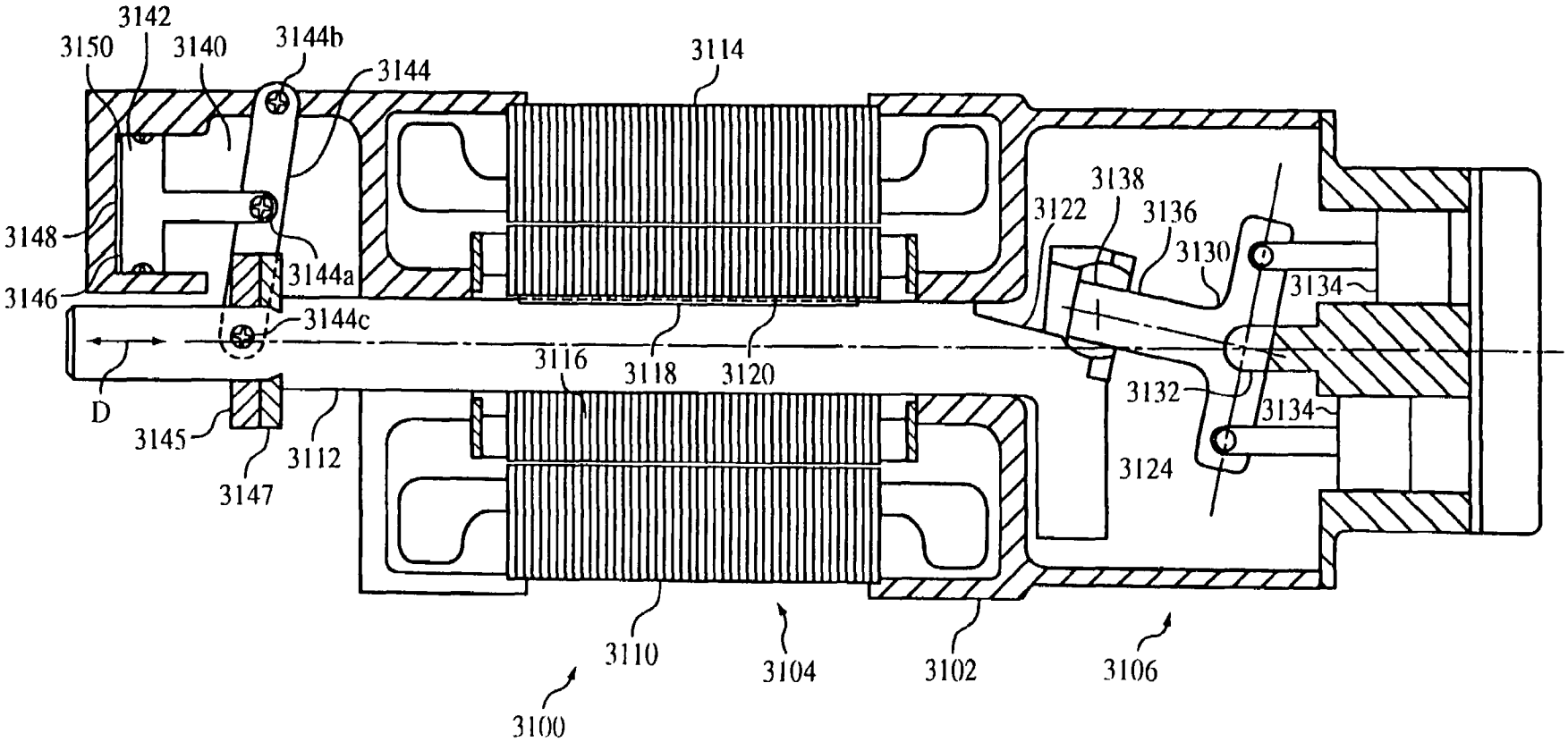
FIG. 61 is a cross-sectional view of an integral motor/compressor.

Referring to FIG. 61, an integral motor/compressor 3100 includes a housing 3102 defining a motor section 3104 and a compressor section 3106. Motor section 3104 houses a motor 3110 and a drive arm 3112. Motor 3110 includes a stator 3114 and a rotor 3116. Drive arm 3112 is mounted to rotate with rotor 3116 and to slide axially, arrow, D, relative to rotor 3116. To this end, drive arm 3112 has a spline 3118 received within a slot 3120 in rotor 3116. Mounted to an end 3122 of drive arm 3112 is a flywheel 3124 located in compressor section 3106. Also within compressor section 3106 are a transition arm 3130 supported by a U-joint 3132 and pistons 3134. The configuration of transition arm 3130, U-joint 3132 and pistons 3134 are as described above. Transition arm 3130 includes a nose pin 3136 slidably received within an opening 3138 defined by flywheel 3124.

As discussed above, axial movement of drive arm 3112 changes the stroke of pistons 3134. Housing 3102 defines a chamber 3140 in which a piston 3142 is located. Piston 3142 is coupled to drive arm 3112 by a control link 3144. Piston 3142 is attached to control link 3144 at a pivot 3144*a*. Link 3144 pivots about a fixed pivot 3144*b* and is a attached to a collar 3145 coupled to drive arm 3112 at a pivot 3144*c*, such that linear motion of piston 3142 causes linear motion of drive arm 3112 to change the stroke of pistons 3134. Drive arm 3112 rotates within collar 3145, and collar 3145 acts against a thrust washer 3147 that rotates with drive arm 3112 and absorbs the force of collar 3145 pushing against drive arm 3112. Between an end face 3146 of piston 3142 and an end wall 3148 of housing 3102 is a gas chamber 3150. By adjusting the gas pressure in gas chamber 3150, the axial position of drive arm 3112 can be changed, thus changing the stroke of pistons 3134.

Figure 62:
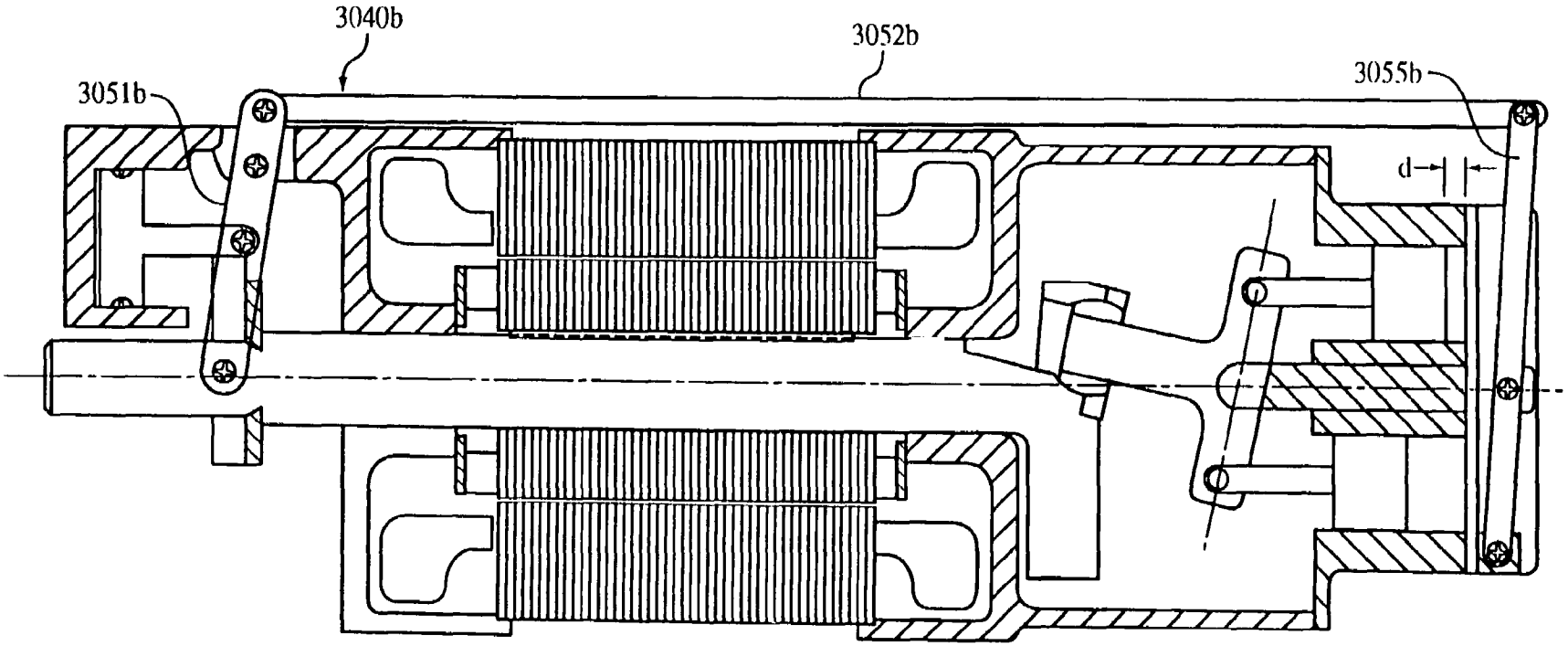
FIG. 62 is a cross-sectional view of the integral motor/compressor of FIG. 61 incorporating a linear stroke/clearance control mechanism.

Referring to FIG. 62, a stroke/clearance control mechanism 3040*b* that maintains the clearance distance, d, at the top of the piston stroke substantially constant as the stroke of the pistons is changed is shown incorporated with is integral/motor compressor 3100. As discussed above with reference to FIG. 58, mechanism 3040*b* includes a stroke control lever 3051*b*, a link rod 3052*b*, and a U-joint control lever 3055*b*. Mechanism 3040*b* functions as described above with reference to FIG. 58, with the clearance distance substantially zero at two points of the piston stroke. The mechanism of FIG. 60 can also be incorporated into integral/motor compressor 3100.

Compressors 3010 and 3010*a* and integral motor/compressor 3100 can include more than two piston assemblies. The stroke/clearance control mechanisms described above can used to vary the top clearance of an internal combustion engine so that the compression ratio remains substantially constant over a wide range of displacements, that is, the clearance distance, d, remains substantially the same percentage of the stroke as the stroke is varied. Any other desirable relationship can also be created by adjusting the shapes and or lengths of the various levers.

Figure 63:
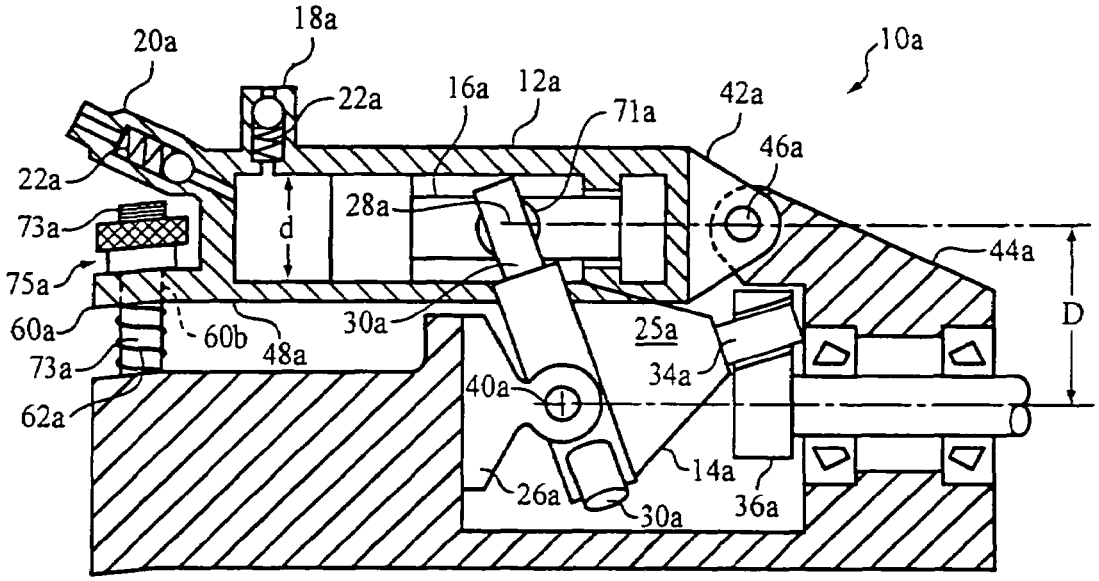
FIG. 63 is an illustration of a metering pump.
Figure 64:
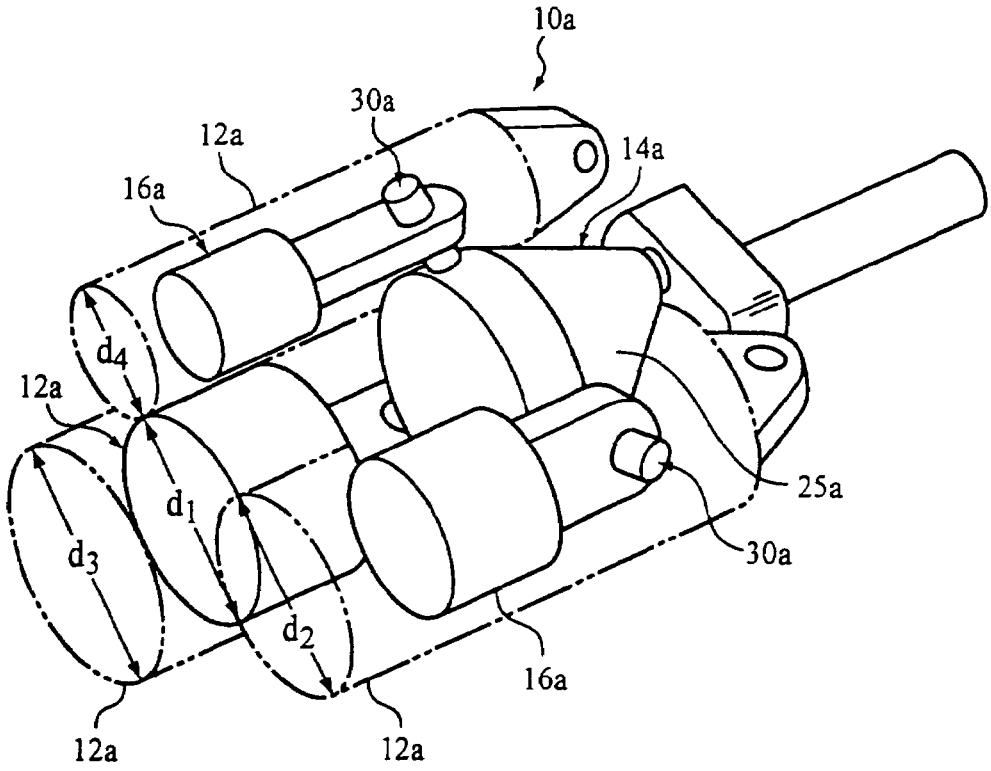
FIG. 64 is a simplified, isometric view of the metering pump of FIG. 63 with components removed for ease of illustration.

Referring to FIGS. 63 and 64, a metering pump 10*a* for delivering known amounts of various fluids includes a plurality of piston cylinders 12*a*, two, three or more cylinders, radially disposed about a central actuating mechanism 14*a*. Housed within each cylinder 12*a* is a piston 16*a* and a guide rod 16*b* supported by a guide bushing or sleeve bearing 16*c*. Cylinders 12*a* each include a fluid inlet 18*a* for delivering fluid into cylinder 12*a*, and a fluid outlet 20*a* for delivering metered fluid. At each of inlet 18*a* and outlet 20*a* a spring-loaded, ball check valve 22*a* is positioned to provide one-way fluid flow, though other types of valves can be used. Actuating mechanism 14*a* includes a transition arm 25*a* coupled to a stationary support 26*a* by, e.g., a U-joint. Transition arm 24*a* includes a plurality of arms 30*a*, each coupled to one of the cylinders 12*a* by a joint 71*a*, and an arm 34*a* coupled to a rotary member 36*a*. Various embodiments of actuating mechanism 14*a* and joint 71*a* have been described above.

The working volume and thus the output of cylinders 12*a* preferably differ, e.g., by a proportional relationship. This feature is particularly applicable where it is desired that the portions of various fluids to be mixed remain constant once determined and set. Metering pump 10*a* provides precise adjustment and accurate and repeatable performance as a precision positive displacement device.

The working volume of each cylinder, and thus the volume of metered fluid, is defined by the stroke of piston 16*a* and the inner diameter, d, of cylinder 12*a*. For each cylinder/piston combination, the diameter of the cylinder and/or the stroke of the piston can differ, permitting the pumping of different fluids in different but exact quantities. For example, to mix five different liquids, each liquid being a different percentage of the mixed fluid, five cylinders 12*a* are arranged about actuating mechanism 14*a* with each cylinder having a different diameter, d1-d5, such that equal strokes deliver the desired mix percentages from each cylinder. Alternatively, or in addition, the distance, D, of cylinders 12*a* from a central pivot 40*a* of transition arm 24*a* (as measured by the distance between central pivot 40*a* and a center 28*a* of joint 71*a*) differ to provide different strokes. For example, coarse values for each fluid is determined by the cylinder diameter, and fine adjustment is accomplished by positioning the cylinders at desired radial positions to individually adjust the stroke of the pistons.

To allow for individual stroke adjustment of the pistons, each cylinder 12*a* is pivotally connected at an end 42*a* of the cylinder to metering pump housing 44*a* by a pin 46*a*. At the opposite end 48*a* of the cylinder is a threaded rod 73*a* mounted to housing 44*a* and a knurled nut 75*a* received on rod 73*a*. Cylinder 12*a* includes an extension 60*a* with a through bore 60*b*. Extension 60*a* is received on rod 73*a* with rod 73*a* extending through bore 60*b*. As oriented in FIG. 63, nut 75*a* is positioned on rod 73*a* above extension 60*a*, and a spring 62*a* is positioned about rod 73*a* below extension 60*a*. Spring 62*a* acts between housing 4*a* and extension 60*a* to bias extension 60*a* toward nut 75*a*.

Turning nut 75*a* lowers or raises extension 60*a*, causing cylinder 12*a* to move about pivot pin 46*a*, bringing cylinder 12*a* closer or further from central pivot 40*a*. Since the angular swing of transition arm 24*a* is a constant, determined by the angular offset of arm 34*a*, adjusting the distance of cylinder 12*a* from central pivot 40*a* adjusts the stroke, which then remains constant. Thus, turning nut 75*a* to lower nut 75*a* on rod 73*a* slides extension 60*a* down rod 73*a* with cylinder 12*a* pivoting about pin 46*a*. This adjusts the position of piston 16*a* along arm 30*a* to reduce the stroke of piston 16*a*, and thus reduce the volume of pumped fluid. Turning nut 75*a* to raise nut 75*a* on rod 73*a* slides extension 60*a* up rod 73*a* with cylinder 12*a* pivoting about pin 46*a*, increasing the stroke of piston 16*a*, and thus increasing the volume of pumped fluid. Extension bore 60*b* has a larger diameter than the diameter of rod 73*a* to provide a clearance that accommodates the radial movement of extension 60*b* about pin 46*a*. The stroke of each piston 16*a* in metering pump 10*a* can be independently adjusted by turning the respective nut 75*a*.

The length of drive arm 30*a* determines the amount of stroke adjustment that is possible by changing distance, D. The length of drive arm 30*a* can be up to about three times the stoke length since the loads seen during metering are relatively small. In addition, the variable stroke mechanisms described above can be employed to permit the output to be varied over a wide range, while still maintaining the same proportions in the mix.

Metering pump 10*a* advantageously locks the fluid proportions to exact and repeatable values. A cylinder can be separately removed and replaced by one of a different diameter. The speeds and loads for the mixing operation are low enough to permit oil-less operations, and thus, a cleaner operating metering pump. Metering pump 10*a* is also applicable to applications where one fluid is being delivered, or various fluids are being mixed at equal proportions.

Figure 65:
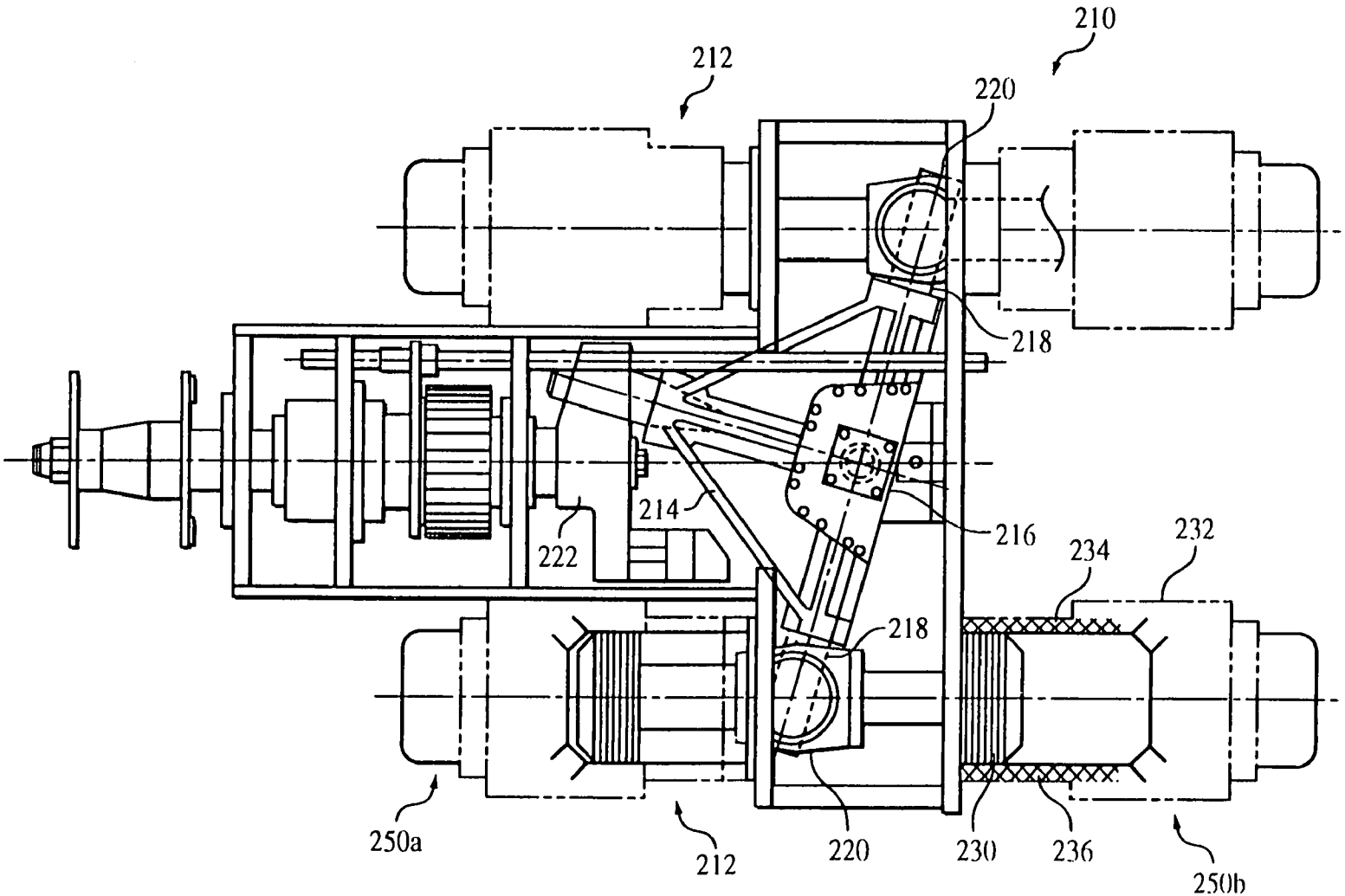
FIG. 65 is an illustration of a linear generator/motor assembly.

Referring to FIG. 65, a linear generator or motor 210 includes one or more piston assemblies 212 mounted circumferentially about a transition arm 214. Transition arm 214 is mounted to a universal joint 216, and drive pins 218 couple transition arm 214 to piston assemblies 212 via piston joint assemblies 220. Transition arm 214 is also coupled to a flywheel 222. When functioning as a generator, rotation of flywheel 222 causes motion of piston assemblies 212 that is linear in space and sinusoidal in time (i.e., simple harmonic motion). When functioning as a motor, the motion of piston assemblies 212 causes rotation of flywheel 222.

Each piston assembly 212 terminates in a permanent magnet 230 that reciprocates with the piston assembly. Each piston assembly 212 is housed within a non-magnetic cylinder 232 having a coil 234 located within the cylinder wall 236. Coil 234 is wound circumferentially about magnet 230. Rotation of flywheel 222 causes reciprocating, linear motion of magnet 230 such that alternating current is produced at coil 234 at the revolving frequency of flywheel 222. The waveform is adjustable by changing the shape of the coil and/or the magnetic field.

With three 120° spaced cylinders the alternating current produced is three-phase. Since the motion of magnet 230 is linear in space and sinusoidal in time and the voltage produced is proportion to the speed of the magnet, with three 120° spaced cylinders a coil winding having a uniform number of turns per inch produces a sinusoidal voltage output as long as the magnet remains within the coil during the reciprocating motion.

As a linear generator, rotation of flywheel 222 causes linear motion of piston assemblies 212 to generate power. As a linear motor, applying ac power to coil 234 causes piston assemblies 212 to reciprocate, which causes flywheel 222 to rotate. This is accomplished with no brushes or commutators.

Figure 66:
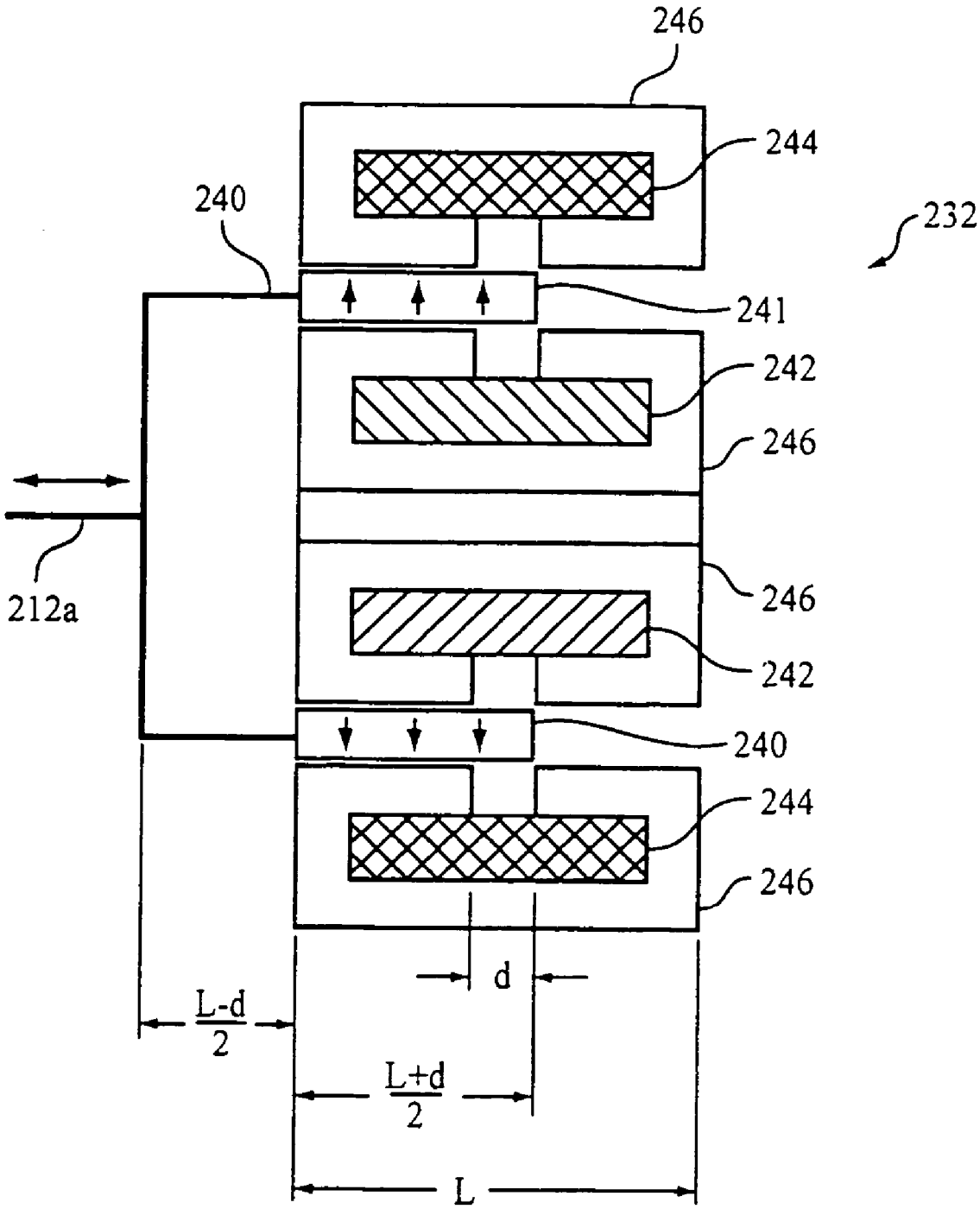
FIG. 66 is an illustration of an alternative embodiment of a magnet and coil of the assembly of FIG. 65.

Piston assemblies 212 can be single-ended or double-ended pistons. Magnet 230 and coil 234 can be positioned on one or both sides of a double-ended piston. Coil 234 can be inside or outside magnet 230, or both. For example, referring to FIG. 66, piston assembly 212*a* terminates in a magnetic tube 240 having a tubular portion 241 magnetized at right angles to the axis. Cylinder 232*a* includes an inner, cylindrical coil 242 positioned within tube 240 and an outer, cylindrical coil 244 positioned around the outside of tube 240. Coils 242, 244 are surrounded by transformer laminations 246. Magnetic tube 240 oscillates within coils 242, 244 driven by motion of piston assembly 212*a*, producing a sinusoidal voltage output. For a coil and lamination length of L and a gap width of d, the tube oscillates over a stroke distance (L−d)/2, and the tube is of length (L+d)/2. The length of the tube and the stroke can be adjusted to perfect the sinusoidal waveform.

Referring again to FIG. 65, in a hybrid generator configuration, one side 250*a* of a double-ended piston assembly 212 functions as a gasoline engine, and the other side 250*b* generates ac power. In a hybrid pump or compressor configuration, side 250*b* is a motor with ac power applied to coil 230 causing piston assembly 212 to reciprocate, and side 250*a* functions as a pump or compressor. In the hybrid configurations, the direct push from power to load along the line between two opposing ends of the piston assembly increases efficiency by eliminating rotating friction in the power path, and largely eliminates forces that need to be passed through the drive pins 218, transition arm 214, and universal joint 216. The drive pins 218, transition arm 214, and universal joint 216 do very little work, i.e., just synchronizing the pistons, and therefore can be made very light. The coil and magnet of FIG. 66 can also be used in the hybrid configurations.

Figure 67:
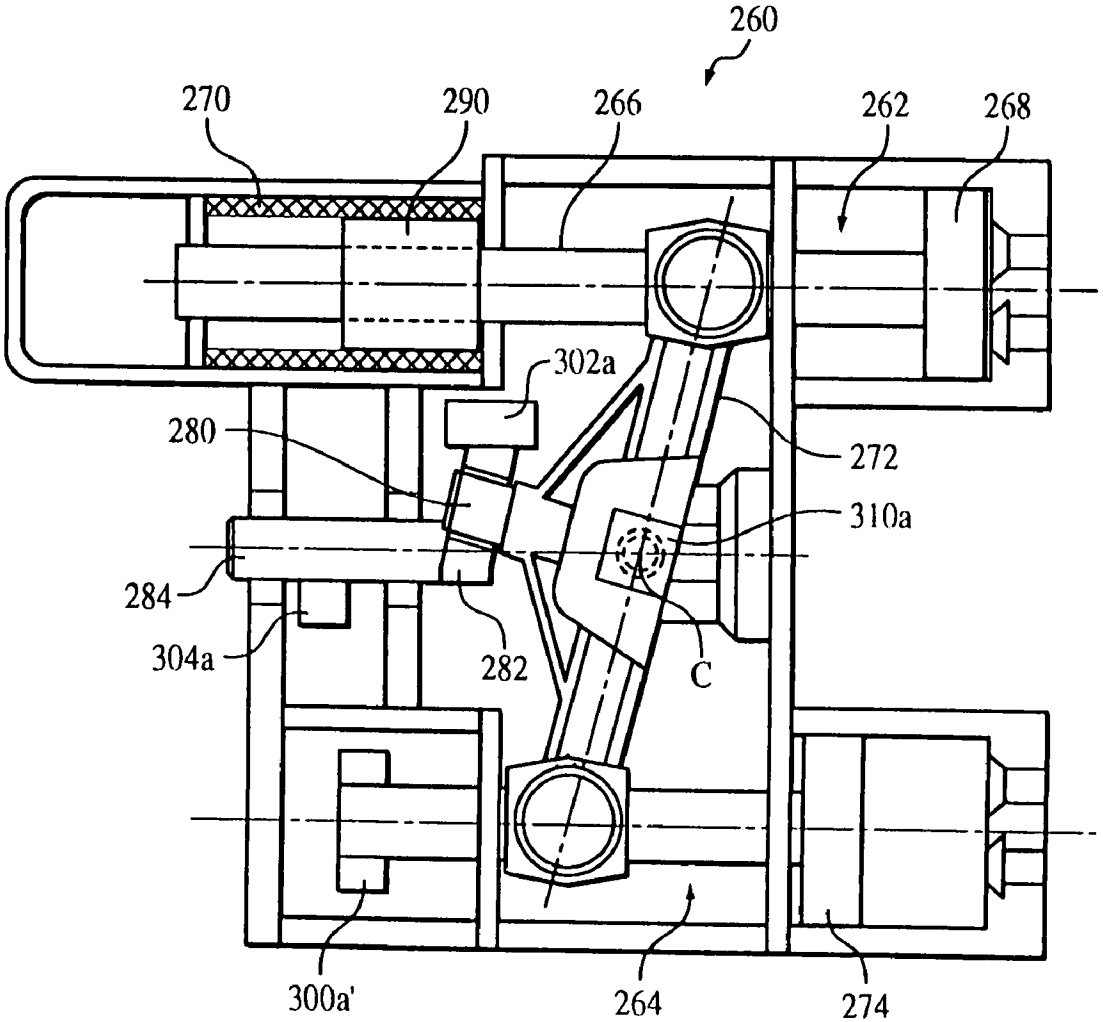
FIG. 67 is an illustration of a compressor or pump assembly including a single linear motor.

Referring to FIG. 67, a compressor or pump assembly 260 includes a double-ended piston assembly 262 and a single-ended piston assembly 264. Connected to a piston rod 266 of piston assembly 262 opposite piston head 268 is a linear electromagnetic motor 270, such as described above. The single motor 270 can drive both piston assemblies 262, 264 because motor 270 can both push and pull piston assembly 262. When motor 270 is driving to the right, as viewed in FIG. 67, the force is transferred directly from motor 270 to piston head 268, and thus to the load. Piston head 268 is driven to the right, and the motion of piston rod 266 is transferred by transition arm 272 to piston assembly 264, moving piston head 274 of piston assembly 264 to the left for an intake stroke. When motor 270 is driven to the left, the force is transferred directly to piston head 268, moving piston head 268 to the left for an intake stroke. Again, the motion of piston rod 266 is transferred by transition arm 272 to piston assembly 264, now moving piston head 274 to the right, and thus to the load.

The forces applied to piston assemblies 262, 264 are not transmitted through nose pin 280, flywheel 282, or drive shaft 284. The nose pin, flywheel, and drive shaft simply act to keep the motions of the pistons synchronized and sinusoidal. The assembly is efficient due to the high efficiency of motor 270, typically over 90%, and the direct transfer of load from motor 270 to piston assemblies 262, 264 through the transition arm acting as an efficient rocker arm.

Assembly 260 can be balanced, generally as described above. In particular, assembly 260 includes five counterweights 300*a*', 302*a*, 304*a*, and two not shown coupled to the transition arm with one positioned above the plane of the paper in FIG. 67, and one below the plane of the paper, such as counterweights 1160, 1162 shown in FIG. 45. Counterweight 300*a*' acts to equalize the weight of piston assemblies 262, 264, i.e., accounts for the added weight to piston assembly 262 from the magnet 290 of motor 270 and any extra length of piston rod 266. For a two piston assembly flat configuration, counterweights 302*a*, 304*a* create a rotary couple equal in magnitude and 180 degrees out of phase to the rotary couple of the piston assemblies and counterweights 1160, 1162 about the center, C, of universal joint 310*a*.

The hybrid generator can be used to drive the wheels of a vehicle through linear motors at the wheels, particularly three-phase or more linear motors with rotary shaft output. As the engine speed increases, the frequency of the a-c power produced rises, and thus the speed of the wheels increases synchronously with the generator. Alternatively, a hydraulic three-phase line can connect a hybrid pump to hydraulic motors at the wheels; or a single high pressure hydraulic line can run from the engine to each wheel, and then a hydraulic motor with valved input and output lines transfers power from the engine to the wheels without the need to be synchronous.

If the position of universal joint 216 is moved to act as a zero clearance compressor or a variable stroke constant compression ratio engine, as described above, the linear generator or motor is not sensitive to the precise position of the magnet. As the stroke is adjusted for some purpose on the engine side, the other side continues to function normally. Some overrun on the length of the magnet is required. The linear motor is also compatible for use as an integral electric motor/compressor.

Figure 68:
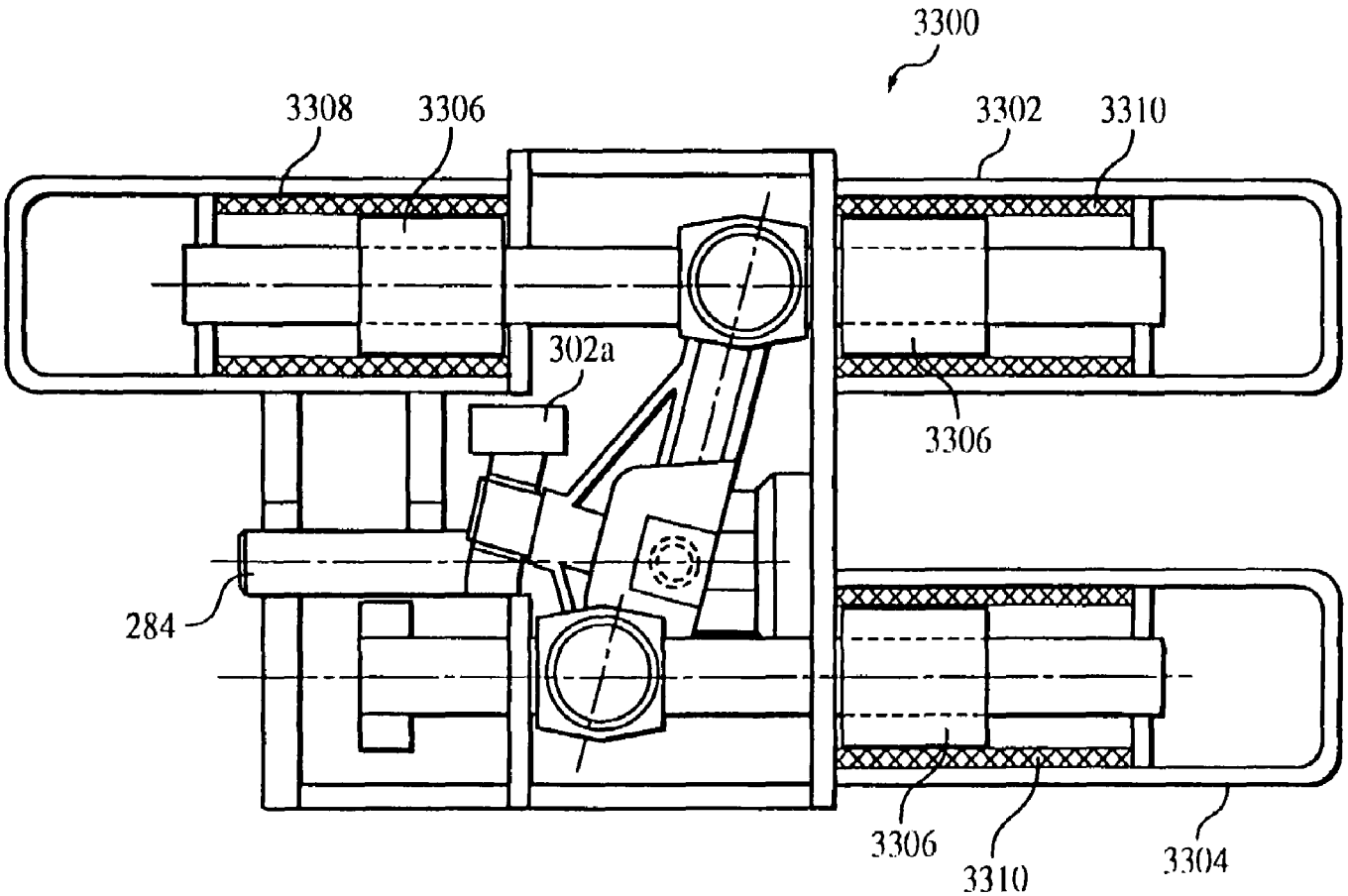
FIG. 68 is an illustration of a piston assembly that converts between phases.

Referring to FIG. 68, often it is useful or necessary to convert ac power from one form to another, i.e., from single-phase 120-volt power to three-phase 240-volt power, or vice versa. The mechanism shown in FIG. 68 performs this conversion using the left side of the mechanism for single-phase input or output, and the right side for three-phase input or output. The assembly 3300 includes a double-ended piston assembly 3302, and two single-ended piston assemblies 3304 (only one of which can be seen in the view of FIG. 68) that are spaced apart 120° from the double-ended piston assembly. All four pistons (one of which can not be seen in the view of FIG. 68) contain magnetic material 3306, and all four cylinders have windings for the input and output voltages as follows: winding 3308 on the left-hand side is wound for 120 volts ac, and three windings 3310 on the right side are wound for 240 volts ac, with the wires sized to support the required current demands.

The application of 120 volts to coil 3308 causes rotation of the shaft 284 and counterweight 302*a* at a constant synchronous speed equal to the ac input frequency, and correspondingly, each of the output coils 3310 generates a voltage at the same frequency. The magnitude of this secondary voltage depends, other things being equal, primarily upon the ratio of turns between the input and output coils. In this case that ratio would be 2:1. Each output has the same voltage, but the phase relationship is in accordance with the relationship in space among the three coils, i.e., 120° apart, to produce three-phase ac.

The mechanism works as well in reverse to convert three-phase 240-volt ac to single-phase 120-volt ac power. The mechanism could also convert between other phases by using a different number or configuration of piston assemblies.

Figure 69:
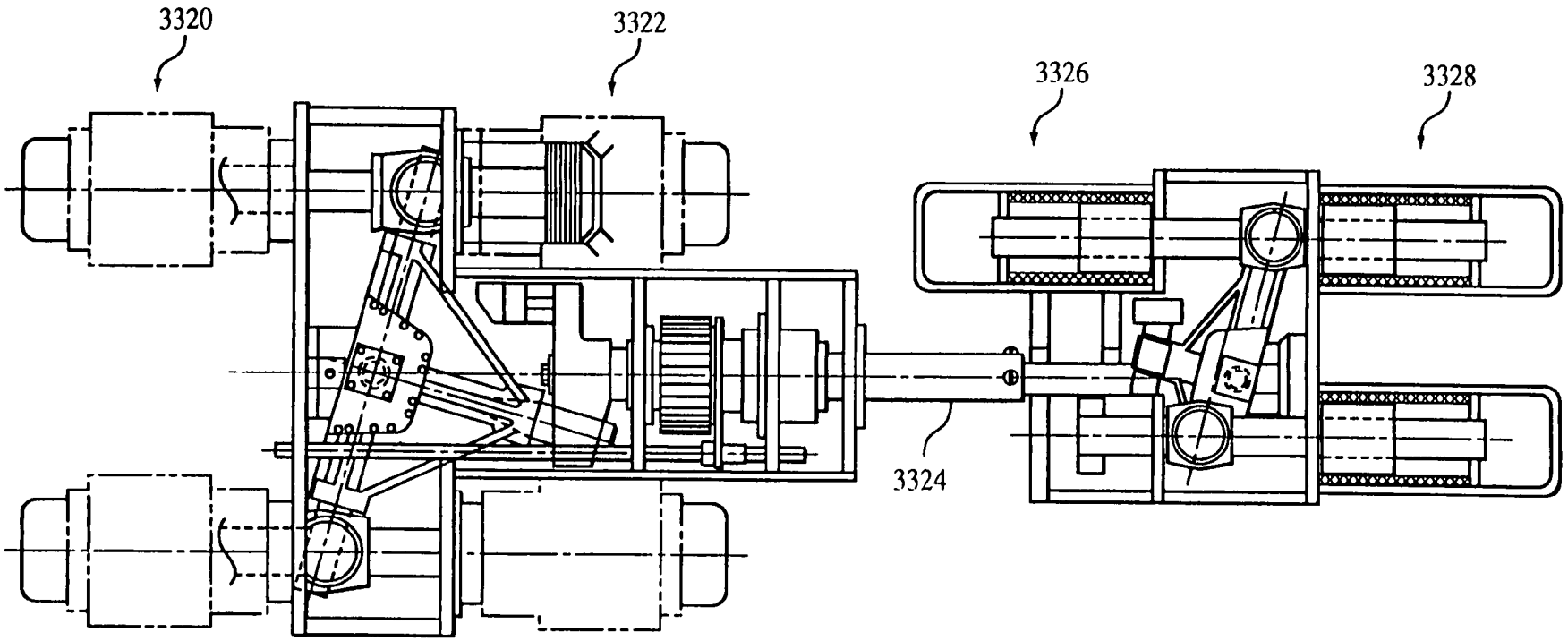
FIG. 69 is an illustration of an output shaft of one piston assembly driving another piston assembly.

The output shaft from the flywheel of various embodiments can be used to drive the flywheel of various other embodiments. For example, referring to FIG. 69, gasoline engine pistons 3320 drive air compressor pistons 3322, and the output shaft 3324 drives a 120 volt single phase ac generator 3326, and a 240 volt three phase ac generator 3328.

Other embodiments are within the scope of the following claims.

For example, the double-ended pistons of the forgoing embodiments can be replaced with single-ended pistons having a piston at one end of the cylinder and a guide rod at the opposite end of the cylinder, such as the single-ended pistons shown in FIG. 32 where element 604, rather than being a pump piston acts as a guide rod.

The various counterbalance techniques, variable-stroke and/or compression embodiments, and piston to transition arm couplings can be integrated in a single engine, pump, compressor, generator, or motor, and can be used in the various embodiments of engines, pumps, compressors, generators, and motors described above.

What is claimed is:

1. A variable stroke and clearance assembly, comprising:

a piston coupled to a rotating member and a universal joint, motion of the rotating member varying a stroke of the piston, and motion of the universal joint varying a clearance distance of the piston, and a linkage coupling the rotating member to the universal joint such that motion of the rotating member and motion of the universal joint are related, wherein the linkage comprises a non-linear linkage.

2. The assembly of claim 1 wherein the clearance distance is substantially equal to zero at two points of piston stroke.

3. The assembly of claim 1 wherein the clearance distance is near zero over a range of piston stroke.

4. The assembly of claim 1 wherein the clearance distance comprises less than approximately 23 mils.

5. The assembly of claim 4 wherein the range of piston stroke comprises about 330 to 1000 mils.

6. The assembly of claim 1 wherein the clearance distance increases at a low stroke to reduce starting torque.

7. The assembly of claim 1 wherein the linkage comprises a first arm, a second arm, and a third arm.

8. The assembly of claim 7 wherein the non-linear linkage is connected between the first arm and the second arm.

9. The assembly of claim 8 wherein the non-linear linkage includes a rod and a triangle.

10. The assembly of claim 1 further comprising a plurality of pistons coupled to the rotating member and the support.

11. The assembly of claim 10 wherein two pistons are circumferentially arranged about the rotating member and the support.

12. The assembly of claim 1 further comprising a guide rod coupled to the piston.

13. The assembly of claim 1 comprising a compressor.

14. The assembly of claim 1 comprising an integral motor/compressor.

15. The assembly of claim 14 wherein the linkage includes a gas piston linked to the rotating member for varying the stroke of the piston.

16. The assembly of claim 1 wherein the rotating member comprises a flywheel.

17. The assembly of claim 1 wherein the rotating member is configured for linear motion.

18. The assembly of claim 1 wherein the universal joint is configured for linear motion.

19. The assembly of claim 1 wherein the linkage is configured such that the clearance distance can be maintained substantially constant as the stroke is varied.

20. A method, comprising:

varying a stroke of a piston by motion of a rotating member coupled to the piston, and varying a clearance distance of the piston by motion of a universal joint coupled to the piston, the rotating member and the universal joint being coupled by a linkage such that motion of the rotating member and motion of the universal joint are related wherein the linkage comprises a non-linear linkage.

21. The method of claim 20 further comprising maintaining the clearance distance of the piston substantially constant as the stroke is varied.

22. A variable stroke and clearance assembly, comprising:

a piston coupled to a transition arm, the transition arm having a first section coupled to a rotating member and a second section coupled to a support, motion of the rotating member varying a stroke of the piston, and motion of the support varying a clearance of the piston, and a linkage coupling the rotating member to the support such that motion of the rotating member and motion of the support are inversely related, wherein the linkage comprises a non-linear linkage.

23. A variable stroke and clearance assembly, comprising:

a piston coupled to a rotating member and a universal joint, motion of the rotating member varying a stroke of the piston, and motion of the universal joint varying a clearance distance of the piston, and a linkage coupling the rotating member to the universal joint such that motion of the rotating member and motion of the universal joint are related, wherein the linkage comprises a first arm, a second arm, and a third arm.

24. The assembly of claim 23 wherein the linkage further comprises a non-linear linkage connected between the first arm and the second arm.

25. The assembly of claim 24 wherein the non-linear linkage includes a rod and a triangle.

* * * * *